US011589686B2

(12) United States Patent
Thorne

(10) Patent No.: US 11,589,686 B2
(45) Date of Patent: Feb. 28, 2023

(54) UNFOLDING PLAY YARD

(71) Applicant: Henry F. Thorne, Sewickley, PA (US)

(72) Inventor: Henry F. Thorne, Sewickley, PA (US)

( * ) Notice: Subject to any disclaimer, the term of this patent is extended or adjusted under 35 U.S.C. 154(b) by 169 days.

(21) Appl. No.: 16/904,061

(22) Filed: Jun. 17, 2020

(65) Prior Publication Data

US 2020/0390250 A1 Dec. 17, 2020

Related U.S. Application Data

(60) Provisional application No. 62/862,195, filed on Jun. 17, 2019.

(51) Int. Cl.
*A47D 13/06* (2006.01)

(52) U.S. Cl.
CPC ..... *A47D 13/063* (2013.01)

(58) Field of Classification Search
CPC ..... A47D 13/063
See application file for complete search history.

(56) References Cited

U.S. PATENT DOCUMENTS

| | | | |
|---|---|---|---|
| 4,811,437 | A | 3/1989 | Dillner et al. |
| 6,079,063 | A | 6/2000 | Cheng |
| 6,256,814 | B1 | 7/2001 | Drobinski |
| 6,336,234 | B1 | 7/2002 | Kuo |
| 6,623,079 | B2 | 9/2003 | Gregory |
| 6,948,197 | B1 | 9/2005 | Chen |
| 7,458,115 | B2 | 12/2008 | Chen et al. |
| 7,581,269 | B2 | 9/2009 | Chen et al. |
| 7,661,156 | B2 | 2/2010 | Thorne et al. |
| 7,752,688 | B2 | 7/2010 | Chen et al. |
| 7,770,245 | B2 | 8/2010 | Cheng et al. |
| 7,836,530 | B2 | 11/2010 | Thorne et al. |
| 7,930,776 | B2 | 4/2011 | Chen et al. |
| 7,950,081 | B2 | 5/2011 | Chen et al. |
| 7,958,578 | B2 | 6/2011 | Shan et al. |
| 8,006,326 | B2 | 8/2011 | Thomas et al. |
| 8,060,959 | B2 | 11/2011 | Thorne et al. |
| 8,458,829 | B2 | 6/2013 | Thorne et al. |
| D688,115 | S | 8/2013 | Wiegmann et al. |
| 8,650,678 | B2 | 2/2014 | Thorne et al. |
| 8,739,331 | B2 | 6/2014 | Gillett et al. |
| 8,756,727 | B2 | 6/2014 | Thorne et al. |
| 8,806,674 | B2 | 8/2014 | Thorne et al. |

(Continued)

FOREIGN PATENT DOCUMENTS

KR 10-1992-0007466 B1 9/1992

OTHER PUBLICATIONS

Information Disclosure Statement form filed in U.S. Appl. No. 13/610,998 on May 6, 2013.

(Continued)

*Primary Examiner* — David R Hare
*Assistant Examiner* — Adam C Ortiz
(74) *Attorney, Agent, or Firm* — David G. Oberdick; Chiara F. Orsini

(57) ABSTRACT

The present invention is an easy to open, close and transport child's play yard. The opening and closing of the play yard is controlled and driven by a central hub that is connected to at least three cam actuator assemblies, all of which are structured to control the joint angles between the central hub and the corner posts and between the corner posts and the upper rails.

9 Claims, 50 Drawing Sheets

(56) References Cited

U.S. PATENT DOCUMENTS

| | | | | |
|---|---|---|---|---|
| 8,955,175 | B2 | 2/2015 | Wiegmann et al. | |
| 8,973,181 | B2 | 3/2015 | Thorne et al. | |
| 9,060,621 | B2 | 6/2015 | Thorne et al. | |
| 9,301,624 | B2 | 4/2016 | Rosenthal et al. | |
| 9,345,339 | B2 | 5/2016 | Wang et al. | |
| 9,770,118 | B2 | 9/2017 | Mountz | |
| 2006/0225204 | A1 | 10/2006 | Bretschger et al. | |
| 2007/0017025 | A1 | 1/2007 | Myer | |
| 2008/0034497 | A1 | 2/2008 | Cheng | |
| 2008/0189854 | A1 | 8/2008 | Thorne et al. | |
| 2008/0196163 | A1 | 8/2008 | Thorne et al. | |
| 2009/0013463 | A1 | 1/2009 | Cheng | |
| 2009/0172879 | A1 | 7/2009 | Hus | |
| 2011/0031457 | A1 | 2/2011 | Thorne et al. | |
| 2012/0248394 | A1* | 10/2012 | Thorne | A47D 13/063 256/25 |
| 2012/0266381 | A1 | 10/2012 | Thorne et al. | |
| 2013/0239322 | A1 | 9/2013 | Thorne et al. | |
| 2013/0240815 | A1 | 9/2013 | Wiegmann et al. | |
| 2014/0041116 | A1 | 2/2014 | Rosenthal et al. | |
| 2014/0123385 | A1 | 5/2014 | Thorne et al. | |
| 2014/0165288 | A1 | 6/2014 | Wang et al. | |

OTHER PUBLICATIONS

Information Disclosure Statement form filed in U.S. Appl. No. 13/960,101 on Aug. 9, 2013.
Information Disclosure Statement form filed in U.S. Appl. No. 13/960,101 on Oct. 26, 2015.
Information Disclosure Statement form filed in U.S. Appl. No. 14/333,101 on Aug. 11, 2014.
Information Disclosure Statement form filed in U.S. Appl. No. 14/152,031 on Jan. 23, 2014.
Information Disclosure Statement form filed in U.S. Appl. No. 13/891,329 on Aug. 7, 2013.
Information Disclosure Statement form filed in U.S. Appl. No. 13/432,165 on Jul. 9, 2012.
Information Disclosure Statement form filed in U.S. Appl. No. 13/432,165 on Nov. 21, 2012.
Information Disclosure Statement form filed in U.S. Appl. No. 12/906,605 on May 5, 2011.
Information Disclosure Statement form filed in U.S. Appl. No. 11/675,098 on Jul. 10, 2008.
Information Disclosure Statement form filed in U.S. Appl. No. 11/675,098 on Dec. 16, 2008.

* cited by examiner

UNFOLDING PLAY YARD

CROSS-REFERENCE TO RELATED APPLICATION

This application claims priority to U.S. Provisional Application Ser. No. 62/862,195, filed Jun. 17, 2019, which application is incorporated by reference herein in its entirety.

BACKGROUND OF THE INVENTION

Field of the Invention

The present invention is directed to a child play yard and, more particularly, a child play yard that is easy to open and easy to close into a compact position when not in use.

Description of Related Art

Foldable play yards, play yards, playpens, portable cribs, and crib devices (herein collectively referred to as "play yard(s)") are well known, as exemplified by U.S. Pat. No. 4,811,437 for a "Foldable Play yard" to Dillner et al. The foldable device disclosed therein is light enough to be carried and, when collapsed, is a fairly convenient compact package. One major problem with such devices, though, is that they are difficult to handle because they are cumbersome to open and unwieldy to fold with clumsy operating mechanisms. Usually there is a need to pull up on a central lower mechanism and a need to unlatch upper rails when closing existing play yards.

Many known play yard designs require complex interconnections of linkages, cables and/or gear assemblies to obtain the desired qualities of easy operation and compact folding. However, such designs are often expensive to manufacture and require significant calibration during assembly to ensure that the play yards fold correctly. Additionally, the large number of pieces contributes to a heavier play yard that cannot be opened and closed or carried easily. Many play yards that are currently on the market employ a series of steps that the user must go through to open or close the play yard and, frequently, at least one of those steps is not intuitive. This suggests a market need for a lightweight, intuitive, easy to open and easy to close play yard.

It also is worth noting that most prior art play yards do not have a locking mechanism to keep the play yards in the closed position. Most of the prior art play yards require that something, like a storage bag or the mattress, be wrapped around the closed play yard to keep the play yard from opening when the play yard is stored or transported.

U.S. Pat. Nos. 8,756,727 and 8,458,829 for a "Foldable Child Enclosure" to Thorne et al. are examples of play yards that can be more expensive to manufacture, require significantly more calibration during manufacture and assembly to ensure that the play yards open and close correctly, and require a larger number of pieces, which contributes to their being heavier play yards. The designs of the '727 and '829 inventions require that the posts remain almost rigid and substantially parallel to a vertical axis to create a tension within the structure that is necessary to open the play yard and to maintain the stability of the play yard both when it is opening and when it is fully open. The structure of those play yards require a larger number of parts to achieve that stability and tension. In particular, the '727 and '829 inventions (and related inventions) utilize upper and lower leg assemblies that attach between corner posts and a central hub and form a parallelogram that acts to hold the corner posts in substantially vertical position—that is, where the deviation from vertical is no more than five degrees (5°).

In contrast, the present invention utilizes a novel cam actuator assembly in place of the upper and lower assemblies of the prior art. The cam actuator assembly operates to prevent the corner posts from collapsing during the opening and closing of the play yard and also allows the corner posts to tilt or flex inward and/or outward during opening and closing. The cam actuator assembly interacts with a central hub and, with respect to each corner post, includes (i) a base strut that pivotably attaches at the outer end of the strut to a corresponding corner post and that also pivotably attaches at the inner end of the strut to a central hub, (ii) a strut cam rod associated with and oriented along the side of the base strut, with the inner end of each strut cam rod slidably mounted within a straight cam slot in the inner end of the base strut and a corresponding arc-shaped cam slot in the central hub, and the outer end of the strut cam rod slidably mounted within an arc-shaped cam slot in the outer end of the base strut and a corresponding arc-shaped cam slot in the lower end of the corresponding corner post; and (iii) an actuator rod oriented along the same corner post. The actuator rod has a lower end that is slidably mounted within the cam slot in the outer end of the associated base strut and the corresponding cam slot in the lower end of the associated corner post and the upper end of the actuator rod is pivotably attached to a transfer link that is pivotably attached to an upper rail assembly. The structure and mechanisms used to achieve this operation and motion in the present invention require significantly fewer parts than the prior art structures. The play yard structures in the '727 and '829 patents use almost three times as many parts than the current invention, which again results in structures that are more costly to manufacture and weigh more than the current invention.

Another drawback of many play yards that are currently on the market is that the top, bottom and side rails are made of metal tubes, which are heavier and more expensive to manufacture than the top, bottom and side rails of the current invention. The top play yards on the market today range in weight from 18.1 lbs. to 35 lbs., with an average weight of 25 lbs. These various drawbacks to the play yards that are currently on the market create a need for a play yard that is simple and intuitive to open and close and is lightweight and robust while also being easy to operate and efficient to manufacture. The play yard and structures described in this application can be manufactured to be roughly four to six pounds lighter that play yards that are currently on the market and are simpler and more intuitive to operate.

In sum, the present invention overcomes the deficiencies of existing play yards by providing a play yard that (i) is lightweight, (ii) is easy to open, (iii) does not have side walls and corner posts that collapse during the opening and closing of the play yard, and (iv) is less expensive to manufacture when compared to similar products currently on the market. The present invention overcomes these deficiencies through the use of novel cam actuator assemblies. The present invention also is unique in employing a locking mechanism that is located at the lower end of the corner posts in one embodiment to keep the invention in the open position and a separate locking mechanism in the upper corners to keep the invention in the closed position.

BRIEF SUMMARY OF THE INVENTION

The present invention is directed to an easy to open, close and transport child's play yard. The opening and closing of the present invention play yard is driven by a central hub and at least three cam actuator assemblies, which are structured to control the joint angle between the central hub and the various parts of cam actuator assemblies. These joint angles, in turn, control the angles at the upper and lower ends of the corner post and enables the up and down motion of the central hub to control the motion of the corner posts and upper rail assemblies so that the play yard can move from an open to a closed state and vice versa primarily through the motion of the hub. Additionally, this structure controls for and/or prevents significant racking and swaying of the play yard during opening and closing.

One embodiment of the present invention is a play yard apparatus that has at least three corner posts. Each corner post has an upper end and a lower end. This play yard apparatus also has foldable upper rail assemblies with each upper rail assembly having two opposing outer ends. Each upper rail assembly is positioned between, and pivotably connected at its outer ends to, the upper ends of two adjacent corner posts. This play yard also has a central joint member, which may be a central hub. Finally, this play yard has a plurality of cam actuator assemblies connected to each corner post and to the central joint member or central hub. The cam actuator assemblies enable the up and down motion of the central hub to control the motion and position of the corner posts and the upper rail assemblies and to move the play yard apparatus between an open state and a closed state.

Another embodiment of the present invention is a cam actuator assembly. The cam actuator of this embodiment has a base strut that has a base strut outer end and a base strut inner end. This embodiment also has a strut cam rod, which has a strut cam rod outer end and a strut cam rod inner end. The strut cam rod is adjacent to the base strut and is slidably mounted or connected at the strut cam rod inner end to a cam slot in the base strut inner end and the strut cam rod outer end is slidably mounted or connected to a cam slot in the base strut outer end. Additionally, this embodiment has an actuator rod, which has an actuator rod upper end and an actuator rod lower end. The actuator rod lower end is slidably mounted or connected to the cam slot in the base strut outer end. Finally, this embodiment has a transfer link that has a transfer link upper end and a transfer link lower end. The transfer link lower end is pivotably attached to the actuator rod upper end. When the actuator rod and the transfer link are pulled downward, the upper rail assembly is pulled into a substantially horizontal position. When the base strut and the strut cam rod are pushed towards the lower end of the corner post, the base strut and the strut cam rod reach a substantially horizontal position.

Another embodiment of the present invention is a half frame assembly, which pivotally connects to a corner post of a folding structure. The corner post has an upper end and a lower end. The half frame assembly has the following: (i) one rail having a rail outer end pivotably connected to the corner post upper end and having a rail inner end; and (ii) one cam actuator assembly. The cam actuator assembly comprises the following: (i) a base strut having a base strut outer end with a first arc-shaped cam slot connected to a second arc-shaped cam slot in the corner post lower end and a base strut inner end having a straight cam slot and connected to a third arc-shaped cam slot in a central joint member; (ii) a strut cam rod having a strut cam rod outer end and a strut cam rod inner end, wherein the strut cam rod is adjacent to the base strut and is slidably mounted at the strut cam rod inner end to the straight came slot in the base strut inner end and wherein the strut cam rod outer end is slidably mounted to the first arc-shaped cam slot in the base strut outer end; (iii) an actuator rod having an actuator rod upper end and an actuator rod lower end, wherein the actuator rod lower end is slidably mounted or connected to the first arc-shaped cam slot in the base strut outer end; and (iv) a transfer link having a transfer link upper end and a transfer link lower end, wherein the transfer link lower end is pivotably connected to the actuator rod upper end and the transfer link upper end is pivotably connected to the rail outer end. The half frame assembly is operable to interact with additional half frame assemblies associated with all corner posts of the folding structure to control the opening and closing of the folding structure.

Another embodiment of the present invention is a frame assembly, which is pivotally connected to two adjacent corner posts of a folding structure, each corner post having an upper end and a lower end. This frame assembly comprises the following: (i) an upper rail assembly have two opposing ends, wherein each upper rail assembly opposing end is pivotably connected to an adjacent one of the corner post upper ends; and (ii) two cam actuator assemblies. Each cam actuator assembly comprises the following: (i) a base strut having a base strut outer end and a base strut inner end; (ii) a strut cam rod having a strut cam rod outer end and a strut cam rod inner end, wherein the strut cam rod is adjacent to the base strut and slidably mounted at the strut cam rod inner end to a cam slot in the base strut inner end and wherein the strut cam rod outer end is slidably mounted to a cam slot in the base strut outer end; (iii) an actuator rod having an actuator rod upper end and an actuator rod lower end, wherein the actuator rod lower end is slidably mounted to the cam slot in the base strut outer end; and (iv) a transfer link having a transfer link upper end and a transfer link lower end, wherein the transfer link lower end is pivotably connected to the actuator rod upper end and wherein the transfer link lower end is pivotably connected to the corresponding upper rail assembly opposing end. This frame assembly is operable to interact with additional frame assemblies associated with all corner posts of the folding structure to control the opening and closing of the folding structure.

BRIEF DESCRIPTION OF THE SEVERAL VIEWS OF THE DRAWINGS

For the purpose of facilitating understanding of the invention, the accompanying drawings and descriptions illustrate preferred embodiments thereof, from which the invention, various embodiments of its structures, construction and method of operation and many advantages may be understood and appreciated. The accompanying drawings are hereby incorporated by reference.

DETAILED DESCRIPTION OF THE INVENTION

Figure 1:
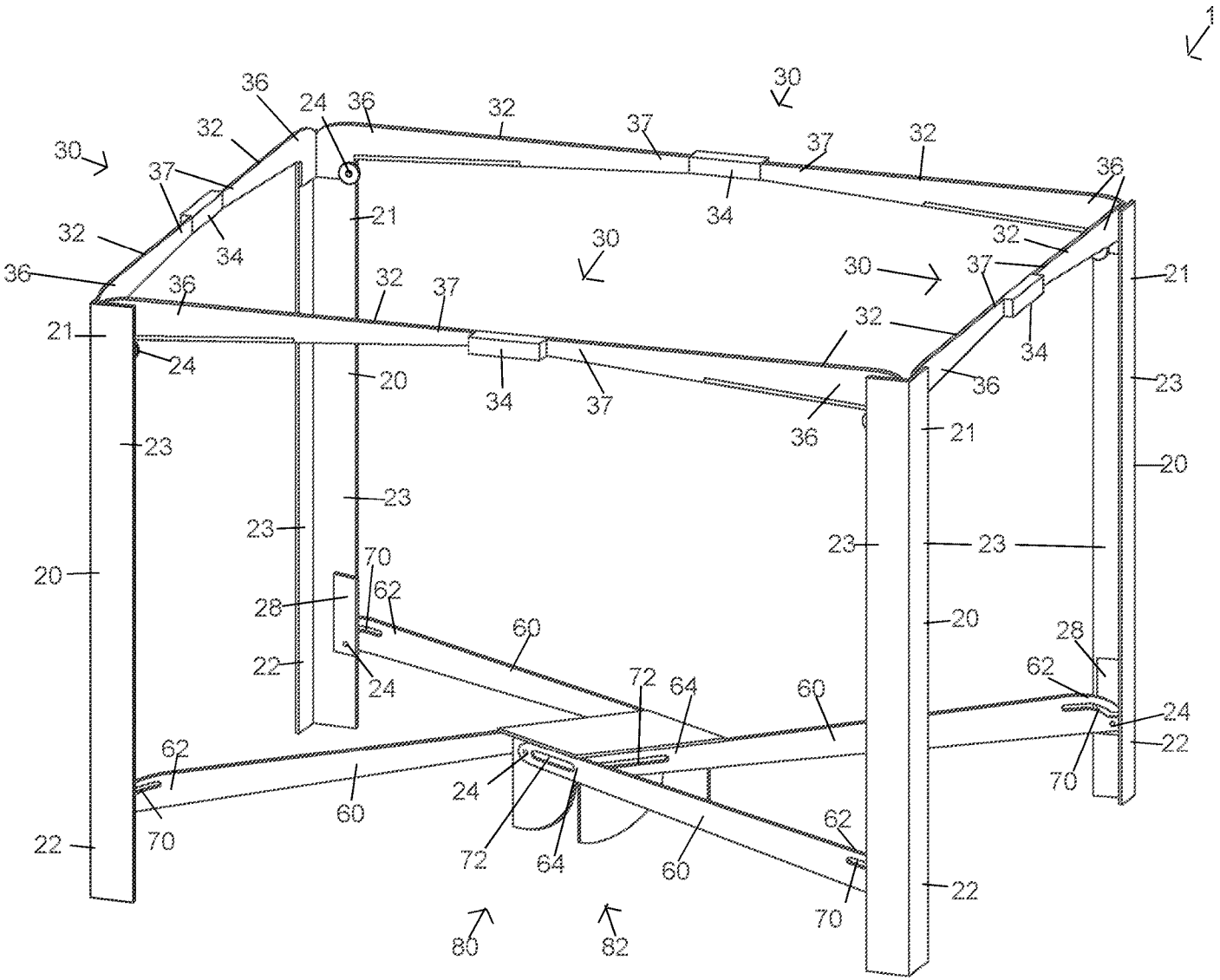
FIG. 1 is a play yard according to one embodiment of the present invention in the fully open position.

The following describes example embodiments in which the present invention may be practiced. This invention, however, may be embodied in many different ways and the description provided herein should not be construed as limiting in any way. Among other things, the following invention may be embodied as systems, methods or devices. The following detailed descriptions should not be taken in a limiting sense. The accompanying drawings are hereby incorporated by reference.

In this document, the terms "a" or "an" are used, as is common in patent documents, to include one or more than one. In this document, the term "or" is used to refer to a nonexclusive "or" such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

For purposes of the description hereinafter, the terms "upper", "lower", "right", "left", "vertical", "horizontal", "top", "bottom", "lateral", "longitudinal", and derivatives thereof shall relate to the invention as it is oriented in the figures. However, it is to be understood that the invention may assume alternative variations and step sequences, except where expressly specified to the contrary. It also is to be understood that the specific devices and processes illustrated in the attached drawings and described in this specification are simply exemplary embodiments of the invention. Hence, specific dimensions and other physical characteristics related to the embodiments disclosed herein are not to be considered as limiting.

As used herein, the terms "pivot" and "pivot point", when used as nouns (and "pivotably" when used as an adjective) mean a structural and functional connection between at least two components which allows at least partial rotation of the at least two components relative to one another. For example, a pivot between a rod and a strut means a physical connection between the rod and the strut that permits at least partial rotation of the rod relative to the strut, and vice versa. The pivot may include a hole in one or both of the rod and the strut, and an axial member extending through the hole(s) to constrain the rod and the strut to each other about a rotational axis. The axial member may include a pin, bolt, screw, bearing, bushing, wheel, or combination thereof to facilitate rotation of the first and second links relative to each other. It will be obvious to one skilled in the art that there are numerous structures and mechanisms that can be used to create pivot points between two or more elements to achieve the structural goals of the present invention and all such structures and mechanism as included within the scope of this application.

While the disclosure has been described in detail and with reference to specific embodiments thereof, it will be apparent to one skilled in the art that various changes and modifications can be made thereto without departing from the spirit and scope of the embodiments. Thus, it is intended that this application covers modifications and variations of this disclosure provided they come within the scope of the appended claims and their equivalents.

Figure 2:
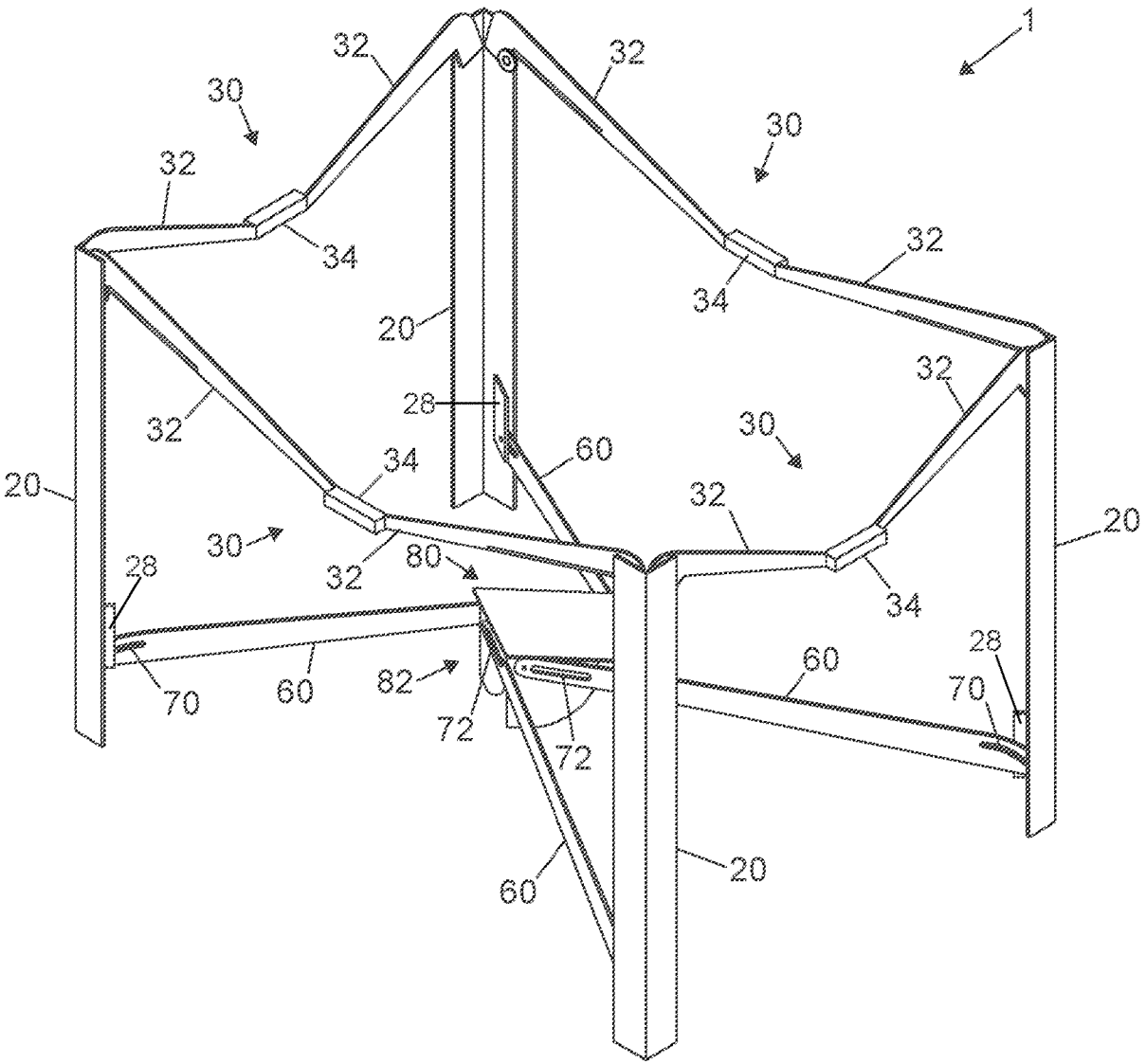
FIG. 2 is a play yard according to one embodiment of the present invention in an intermediate position.
Figure 48:
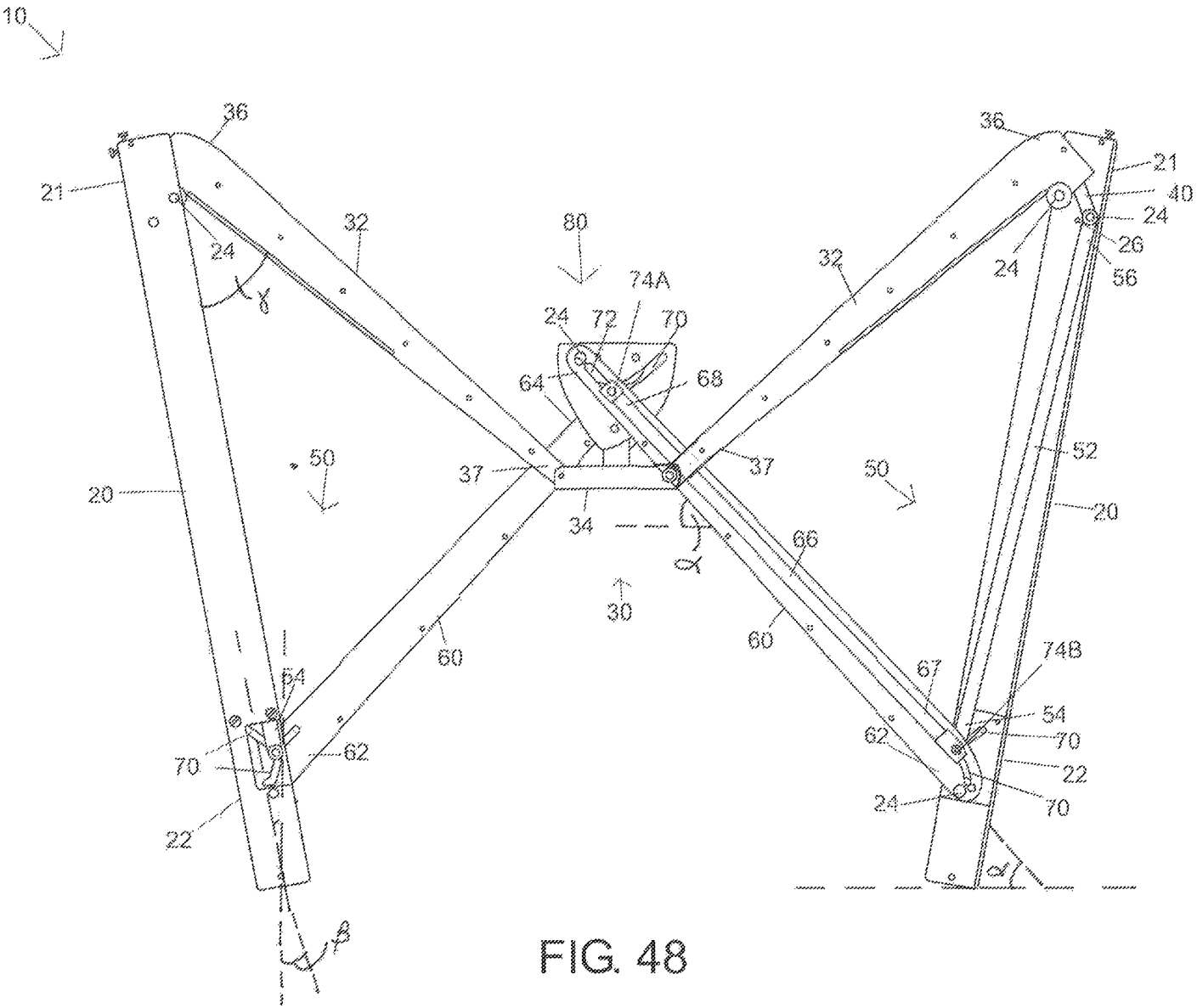
FIG. 48 is an illustrative frame assembly according to one embodiment of the present invention in an intermediate position.

The present invention is directed to a child's play yard 1, as shown in FIGS. 1 and 2 that is relatively easy to open and to close and, in some embodiments, will stay closed without a separate locking feature while other embodiments of the present invention may incorporate the use of a corner post locking mechanism to keep the play yard 1 in the closed position. As is explained in more detail below, in the present invention, the associated movements of the central hub 80 and each cam actuator assembly 50 determine a joint angle at the central hub 80 and formed by the intersection of the longitudinal orientation of each base strut 60 and the floor plane (angle $\alpha$ as shown in FIG. 48). In turn, these joint angles, through interaction with the interconnected parts of the cam actuator assembly 50, control an angle measured at the lower end 22 of the corner posts 20 between vertical and the actual orientation of the corner post 20 (angle $\beta$ as shown in FIG. 48) and also an angle measured at the upper end 21 of corner post 20 and formed by the respective orientations of the corner post 20 and the pivotably connected rail 32 of upper rail assembly 30 (angle $\gamma$ as shown in FIG. 48). This control of the angles at the upper end 21 and lower end 22 of each corner post 20 enables the up and down motion of the central hub 80 to control the motion of the corner posts 20 and upper rail assemblies 30 so that the play yard 1 can move from an open to a closed state and vice versa primarily through the motion of the hub 80. Additionally, this structure controls for and/or prevents significant racking, which is the tendency for sides of a play yard 1 and corner posts 20 to sway in response to movement of the central hub 80. The present invention is also directed to a play yard 1 that is relatively lightweight and easy to transport.

FIGS. 1 and 2 illustrate a play yard 1 having four base struts 60 (more fully described herein) that attach to four flanges or tabs 28, which tabs 28 are oriented inward toward the central hub 80 (more clearly illustrated in FIG. 2). These tabs 28 connect to the four corner posts 20 (as shown in FIGS. 1, 2, 6 and 8). For all embodiments of the present invention, it should be understood that the base struts 60 (and associated strut cam rods 66 and actuator rods 52) may connect directly to the corner posts 20 or they may connect to a flange or tab 28, which then connects to the corner posts 20. All discussion herein of the base struts 60, strut cam rods 66 and actuator rods 52 connecting to the corner posts should be understood to include the options of a direct connection to the corner posts 20 and/or a connection to a flange or tab 28, which then connects to the corner post 20. The tabs 28 may be oriented at any angle coming off from the corner post 20 towards the central hub 80 and they may be of a variety of lengths, widths and heights. Additionally, the play yard 1 as shown in FIGS. 1 and 2 is a simplified illustration (lacking some of the details of the cam actuator assemblies 50) to illustrate the relative positioning of the corner posts 20, base struts 60, rail assemblies 30 and central joint member 82 when one embodiment of the present invention play yard 1 is in the fully open (FIG. 1) and an intermediate positions (FIG. 2).

Figure 3:
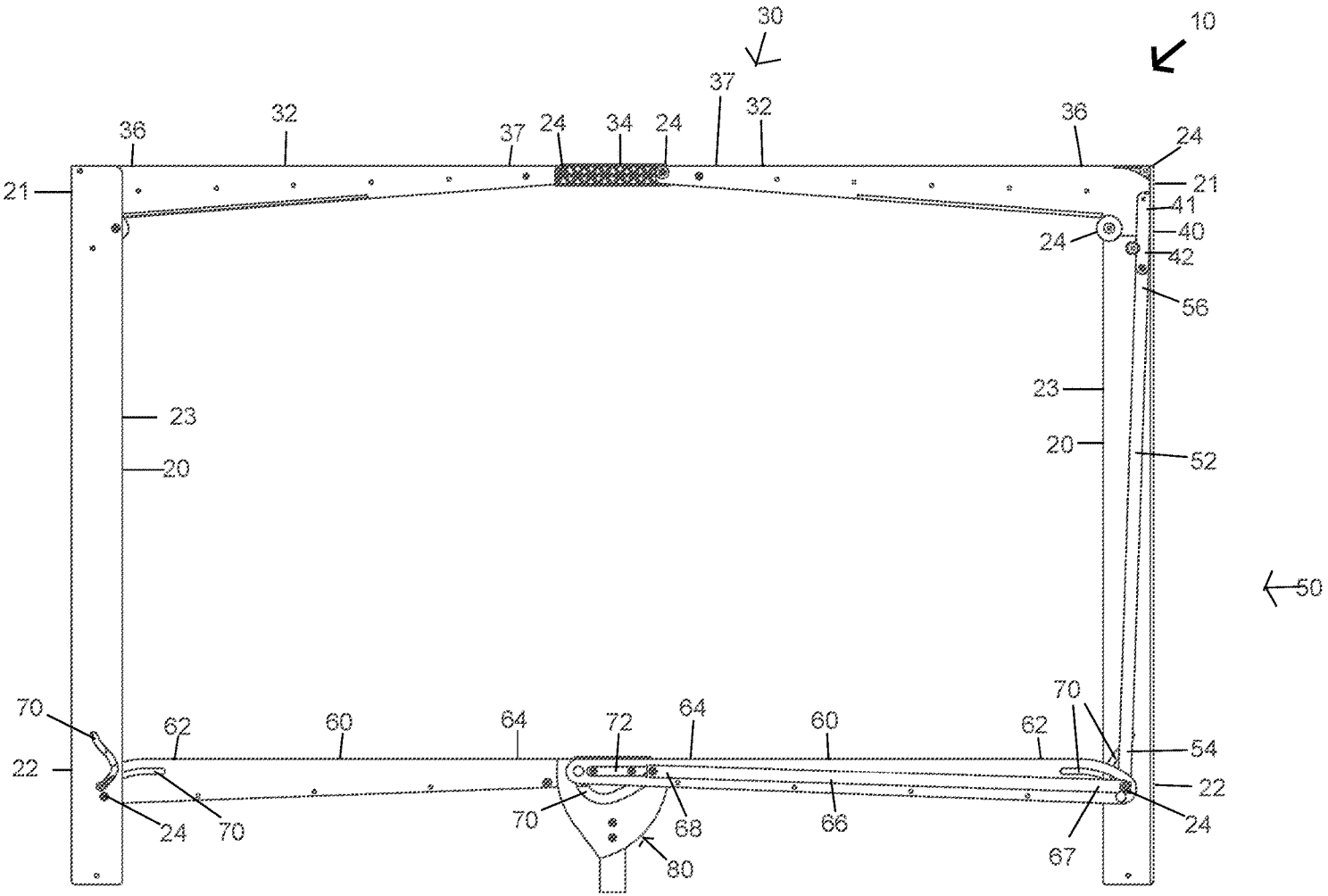
FIG. 3 is an illustrative frame assembly according to one embodiment of the present invention in the open position.
Figure 4:
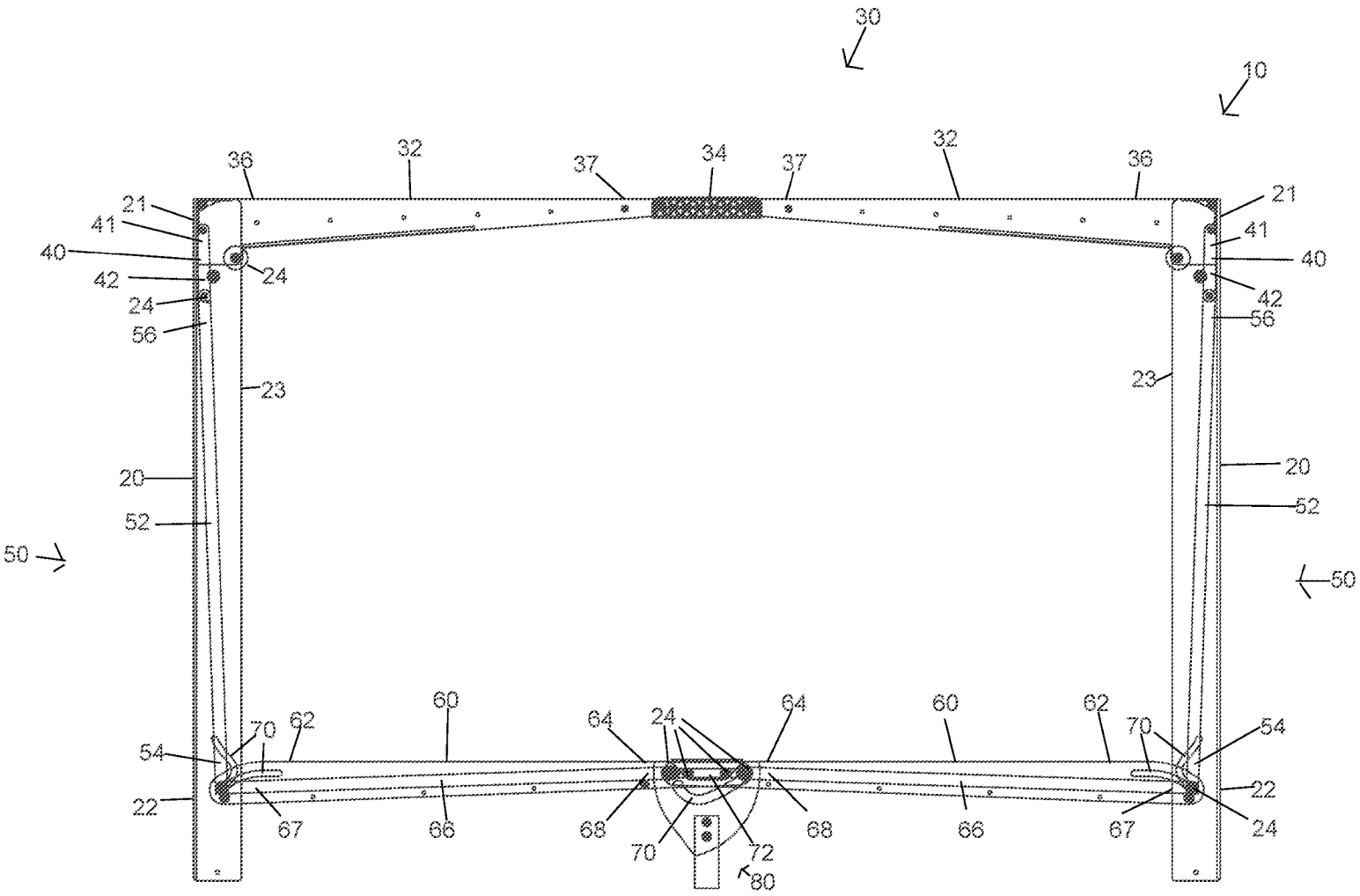
FIG. 4 is an alternative view of the frame assembly of FIG. 3 showing hidden parts.
Figure 5:
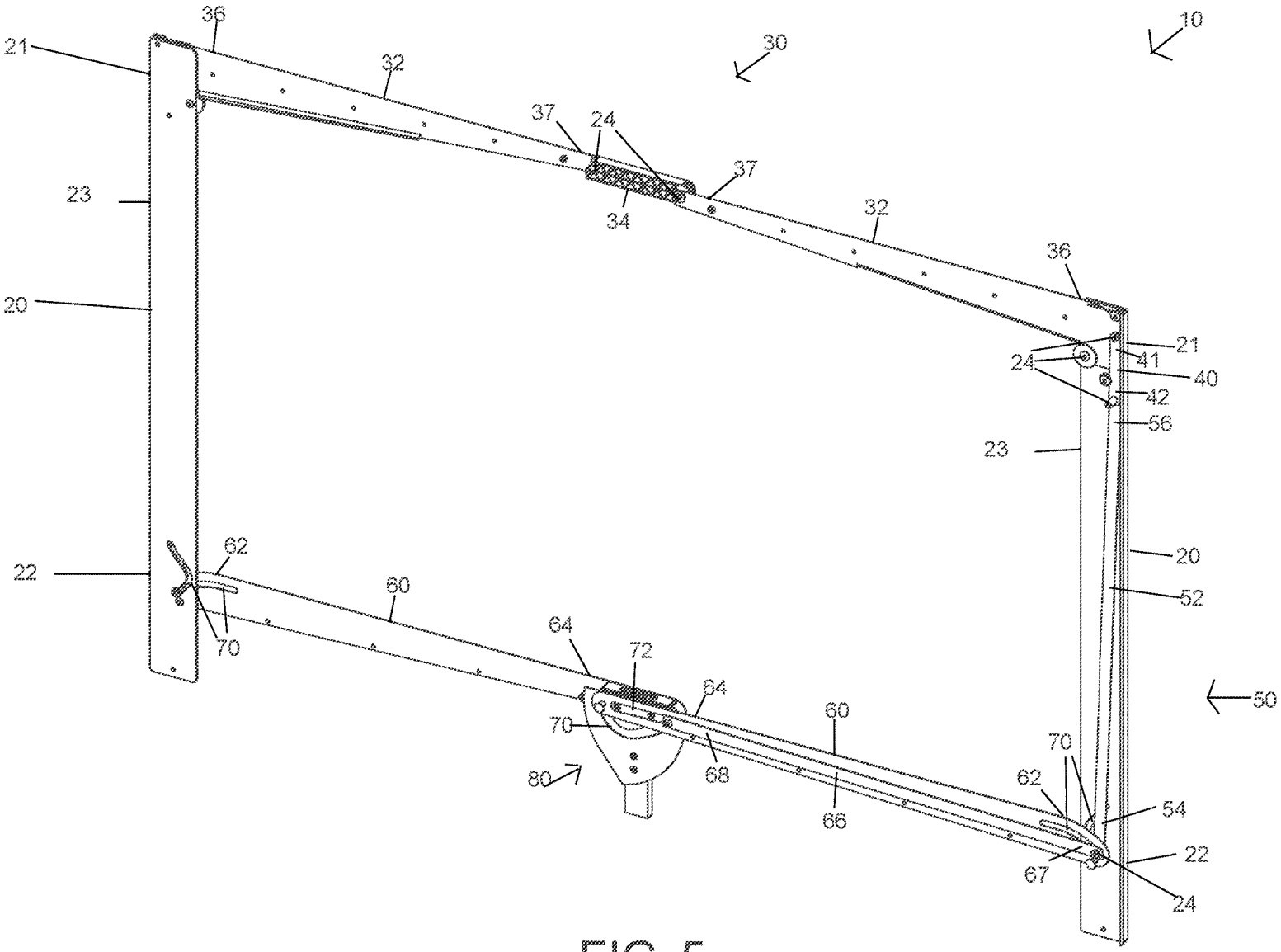
FIG. 5 is a perspective view of the illustrative frame assembly of FIG. 3.
Figure 6B:
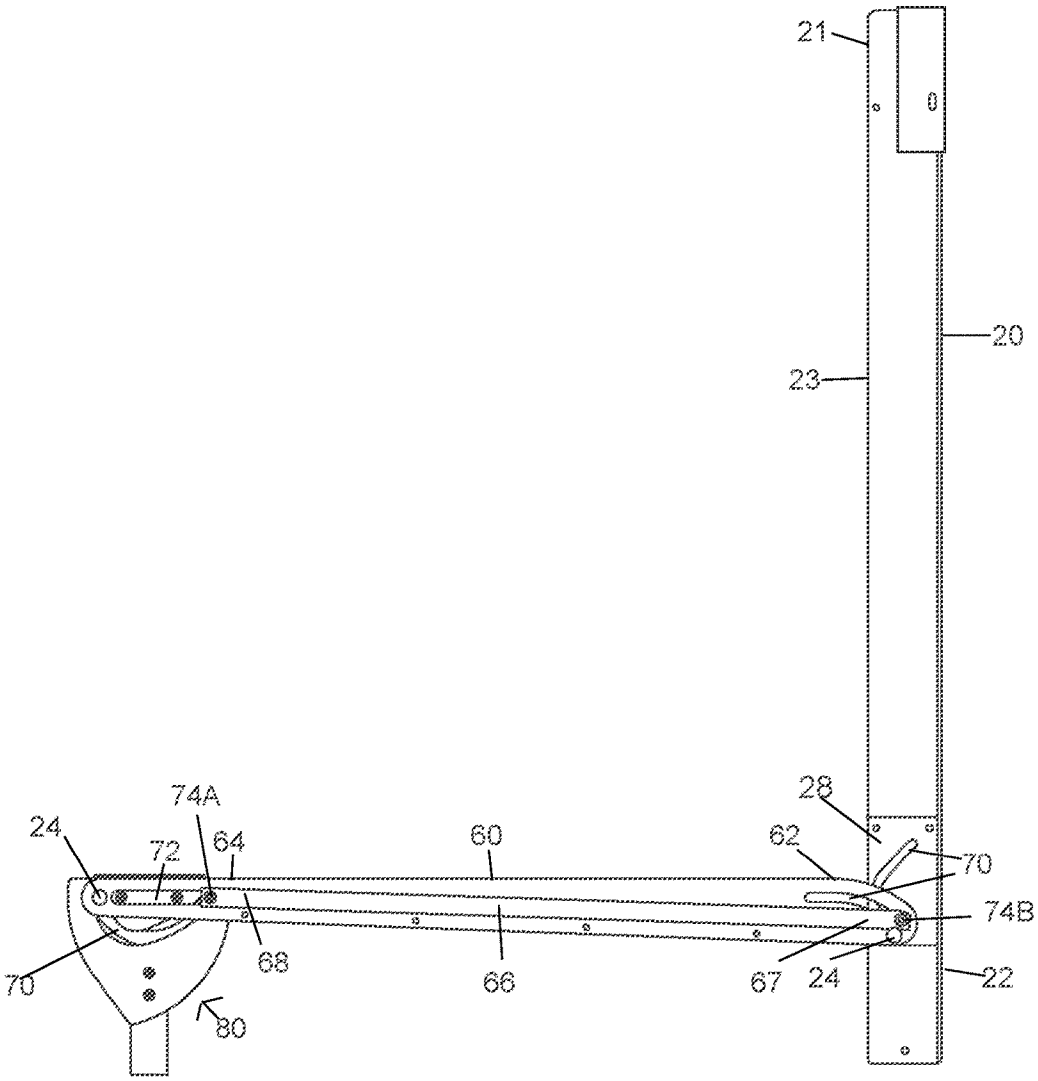
FIGS. 6A and 6B illustrate the movement of parts of a cam actuator assembly from a closed position to an open position.
Figure 6A:
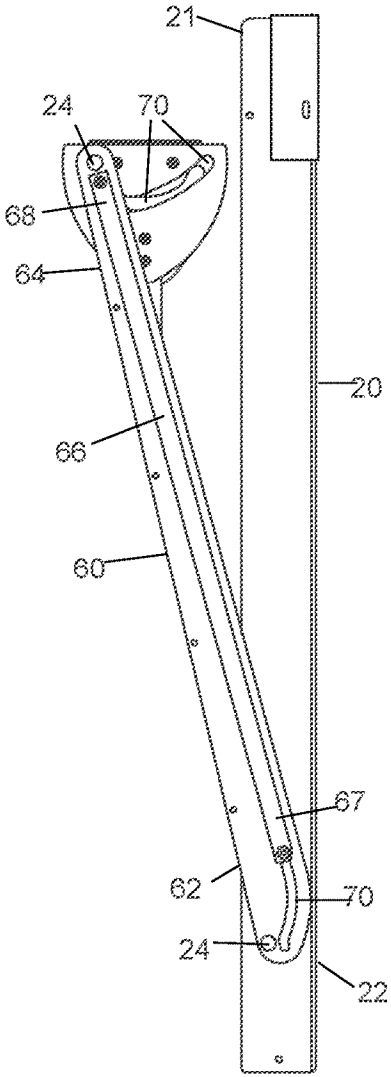
Figure 7A:
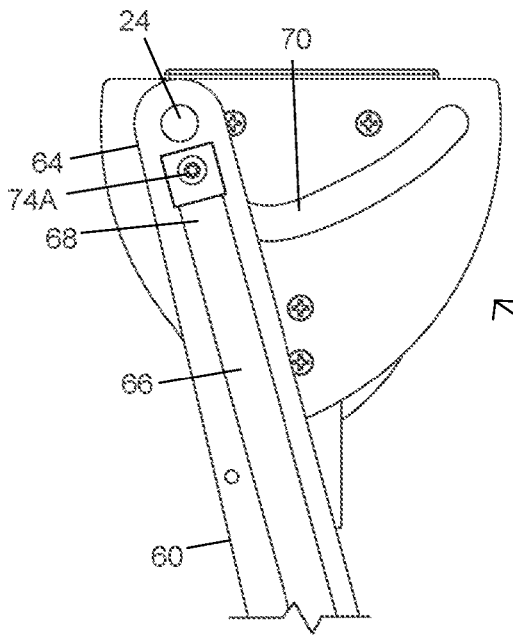
FIGS. 7A and 7B illustrate the movement of a base strut in an arc-shaped cam slot from a closed position to an open position.
Figure 7B:
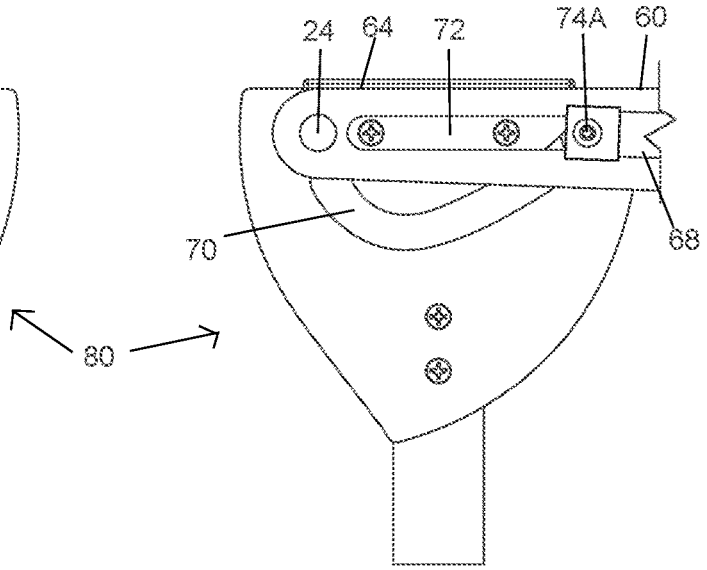
Figure 8C:
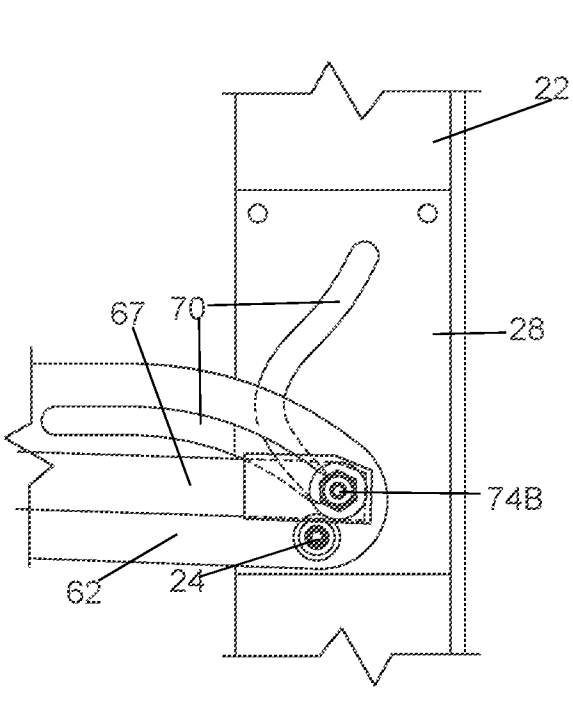
FIGS. 8A, 8B and 8C illustrate the movement of a base strut outer end and a strut rod outer end in two arc-shaped cam slots at a corner post lower end.
Figure 8B:
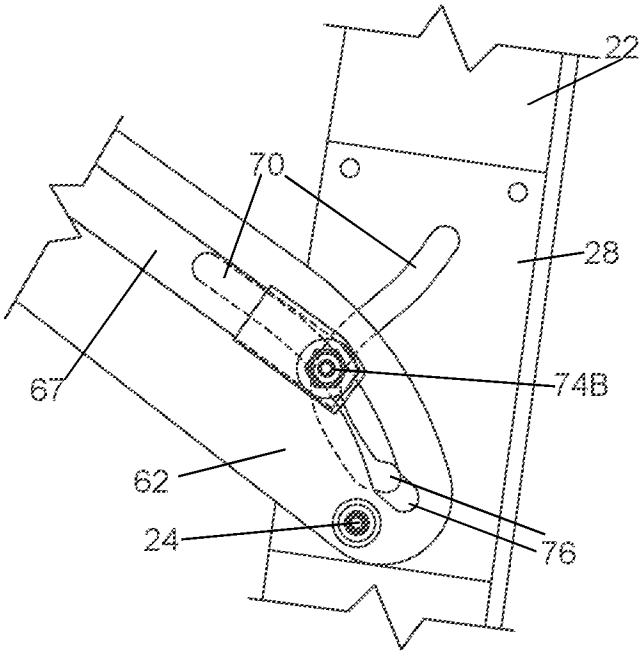
Figure 8A:
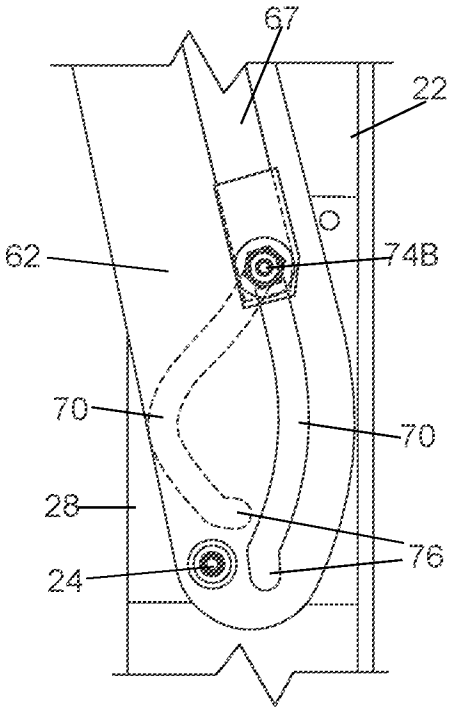
Figure 9C:
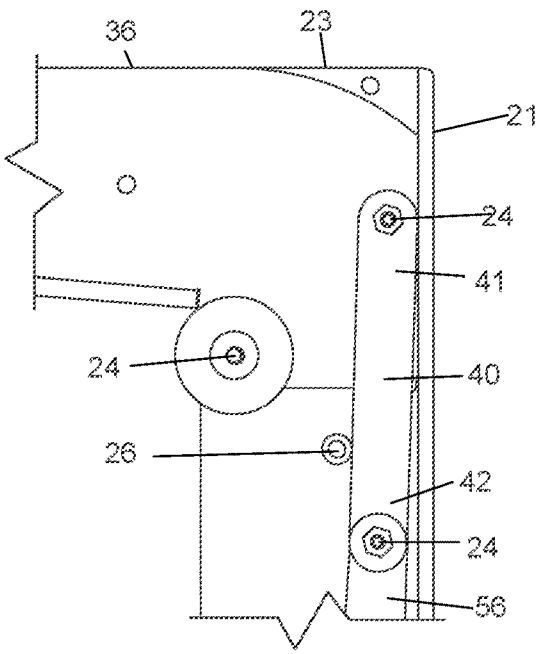
FIGS. 9A, 9B and 9C illustrate the movement of a rail and a transfer link at a corner post upper end from a closed position to an open position.
Figure 9B:
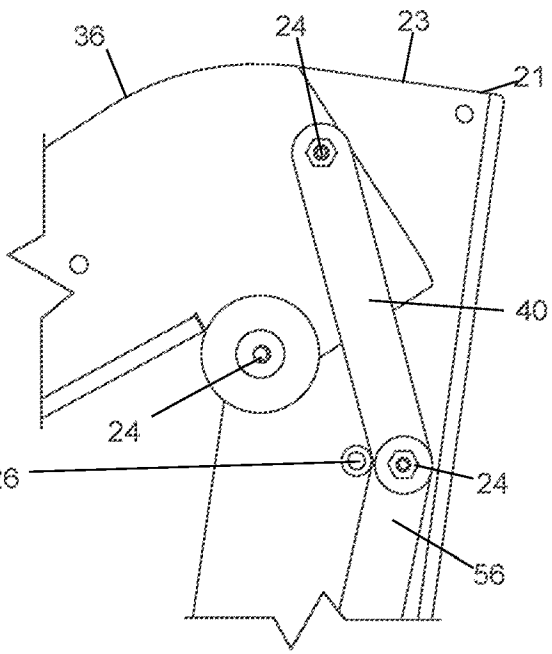
Figure 9A:
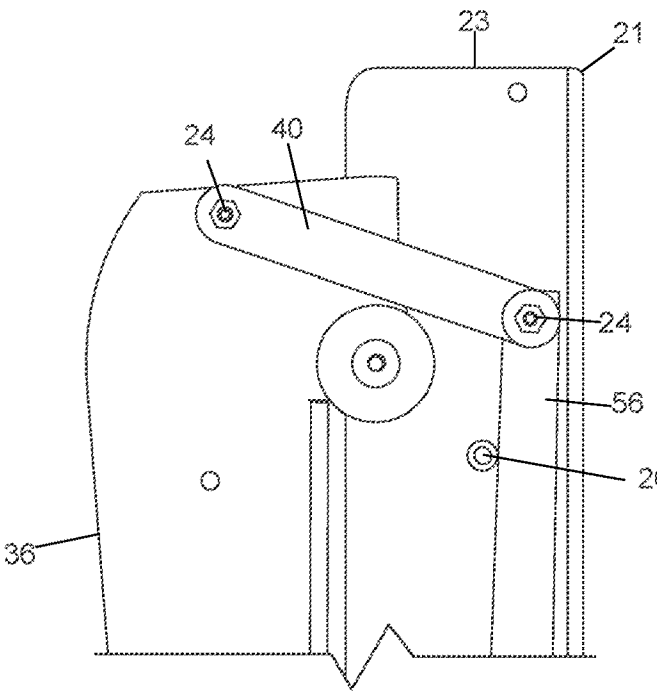
Figure 10C:
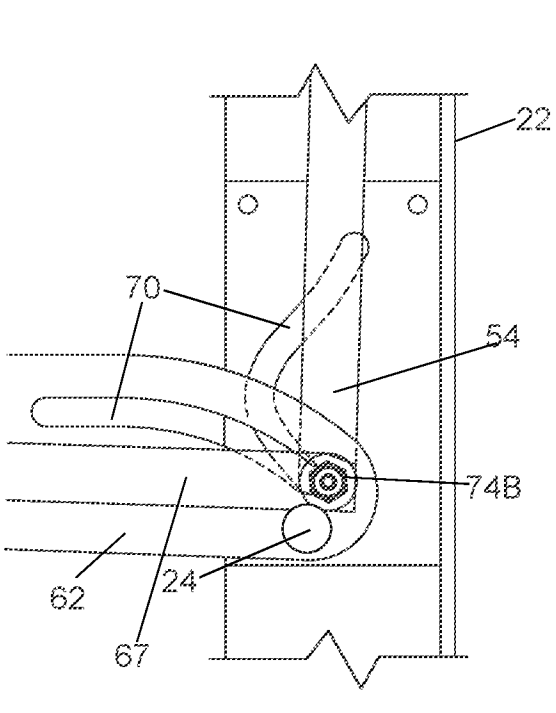
FIGS. 10A, 10B and 10C illustrate the movement of a base strut and a strut cam rod in two arc-shaped cam slots at the corner post lower end from a closed position to an open position.
Figure 10B:
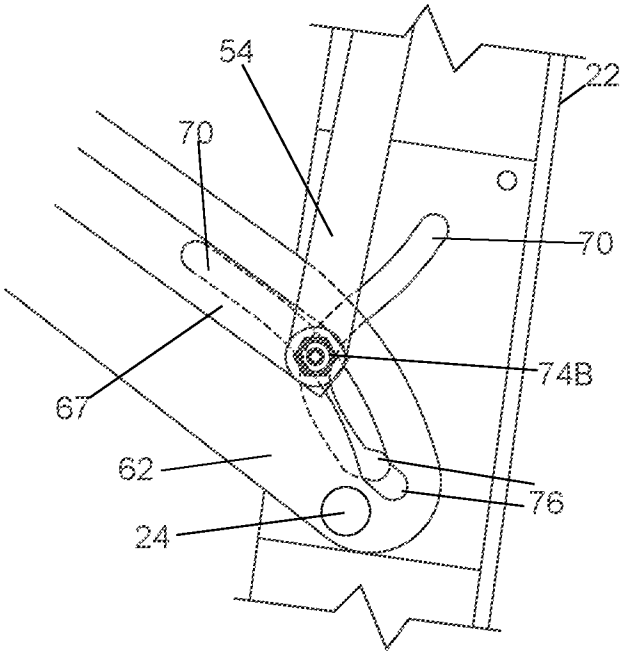
Figure 10A:
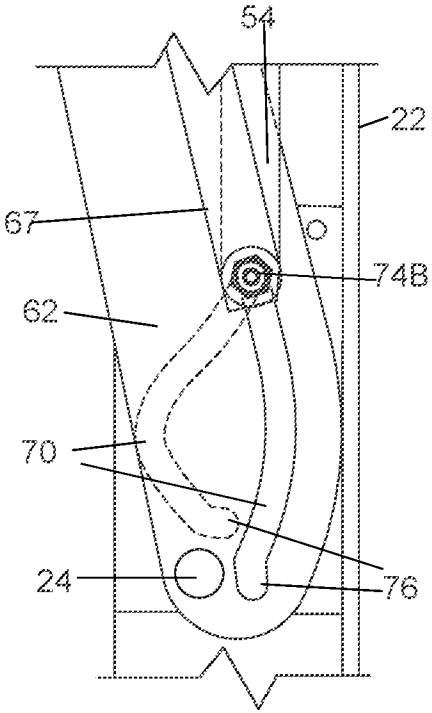
Figure 11A:
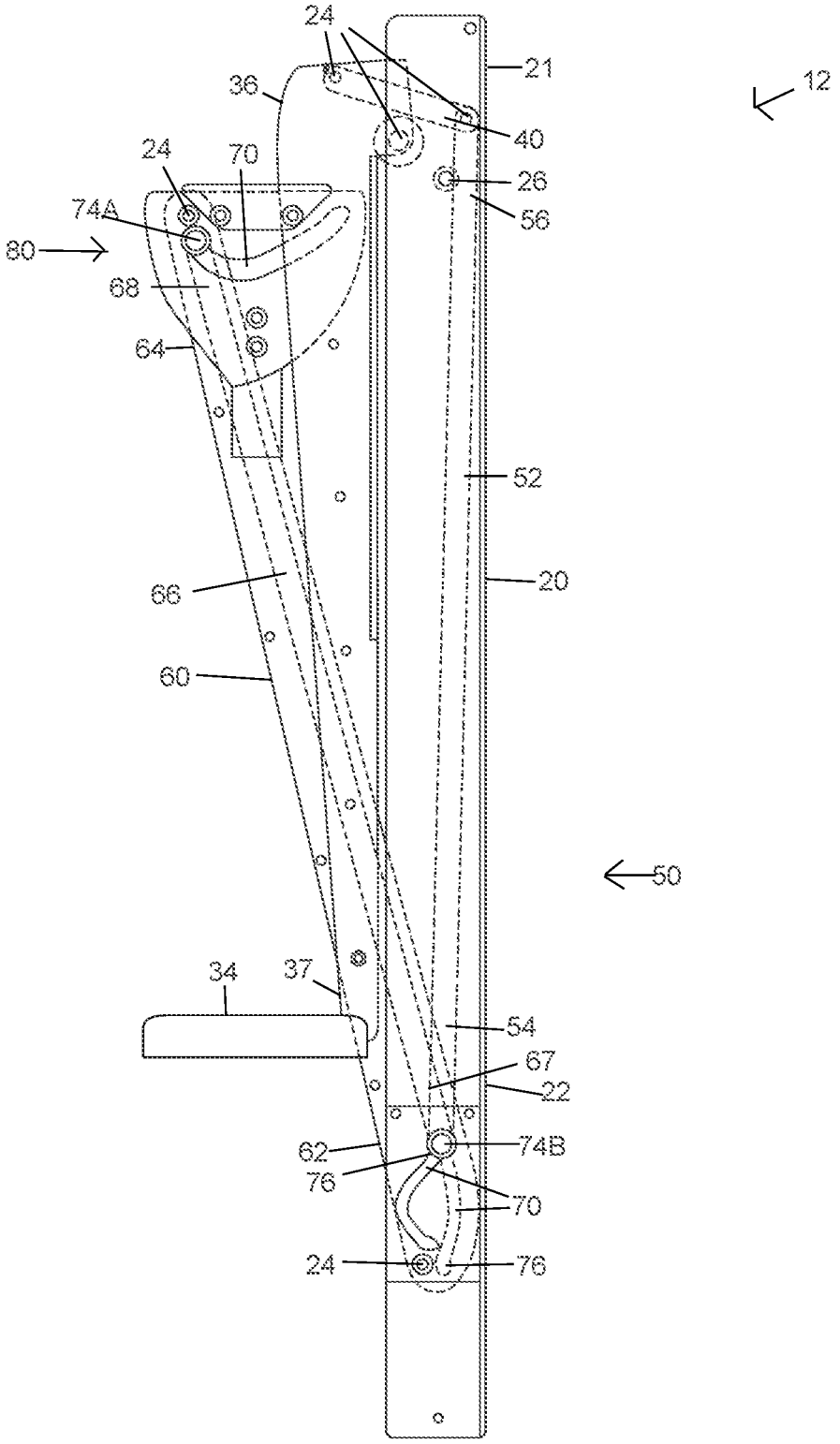
FIGS. 11A, 11B and 11C illustrate a half frame assembly moving from a closed position to an open position.
Figure 11B:
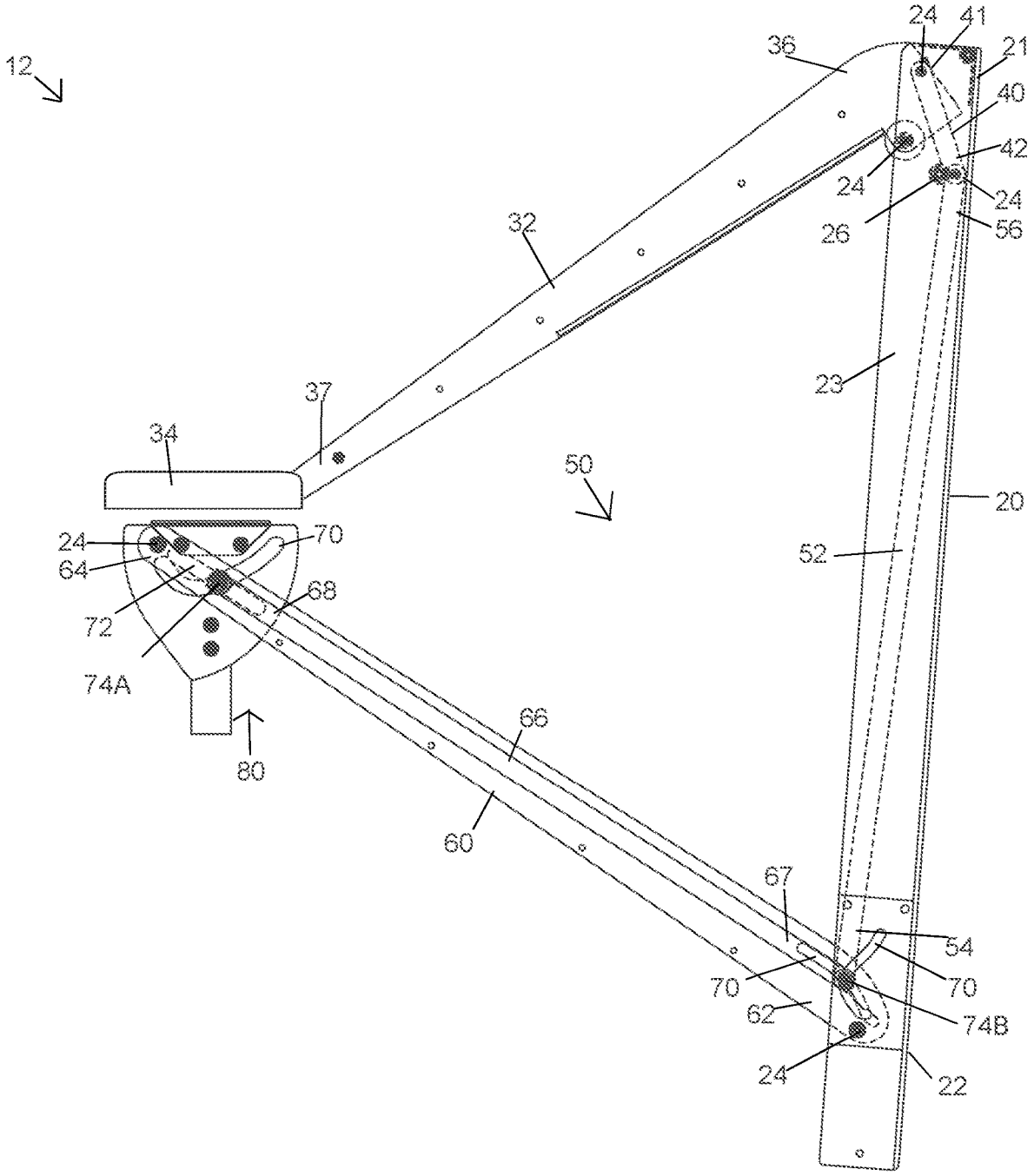
Figure 11C:
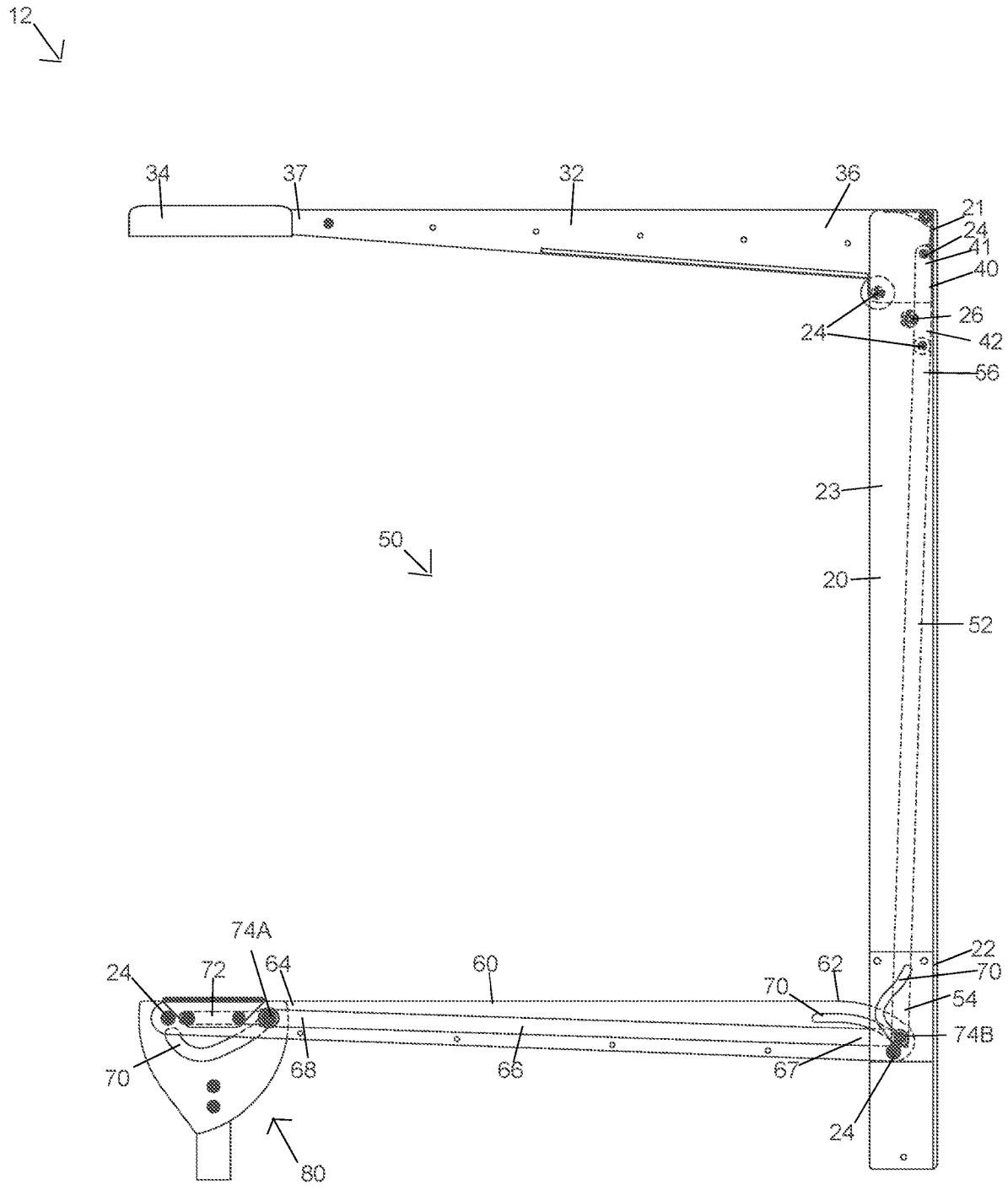

FIGS. 3, 4 and 5 show an illustrative frame assembly 10 in an open position depicting components for use in one embodiment of the present invention. In contrast to FIGS. 1 and 2, this illustrative frame assembly 10 is fully situated in a vertical plane and is pivotally connected to two adjacent corner posts 20 of a folding structure, with each corner post 20 having an upper end 21 and a lower end 22. This frame assembly 10 includes (i) an upper rail assembly 30 pivotably connected at each end 36 to the upper ends 21 of the corner posts 20, which folds downward when the play yard 1 (or other folding structure) is closed and remains in a horizontal position when the play yard 1 is opened, and (ii) two cam actuator assemblies 50, each cam actuator assembly 50 connected to an upper end 21 of a corner post 20, to the lower end 22 of the corner post 20 and to the hub 80 and each cam actuator assembly 50 folding upward when the play yard 1 is closed, and locking with each cam actuator assembly's base strut 60 in an approximately horizontal position when the play yard 1 is opened (as shown in detail in FIGS. 3 through 6). As shown in FIGS. 4 and 5, the upper rail assembly 30 is comprised of first and second rails 32 that are connected by an upper joint member 34 in the middle of the upper rail assembly 30. As shown in FIGS. 11A through 11C and 19 through 30, each cam actuator assembly 50 has a base strut 60 that pivotably attaches to a central joint member 82, and each base strut 60 also pivotably attaches to a corresponding corner post's 20 lower end 22. As described more fully below, the central joint member 82 in an operating play yard 1 can be a central hub 80. The cam actuator assembly 50 also includes a strut cam rod 66 and actuator rod 52 associated with each of the base struts 60 (as shown in FIGS. 3, 4 and 19 through 30), with each strut cam rod 66 slidably connected or mounted (i) at an inner end 68, to a corresponding straight cam slot 72 in the inner end 64 of the associated base strut 60 and an arc-shaped cam slot 70 in the central hub 80 (as shown in FIGS. 31 through 33 and 40 through 42) and (ii) at an outer end 67 to corresponding arc-shaped cam slots 70 in the outer end 62 of the associated based strut and the lower end 22 of the associated corner post 20 (as shown in FIGS. 34 through 36, 43 and 44). Each actuator rod 52 has (i) a lower end 54 that is slidably mounted within the arc-shaped cam slot 70 in the outer end 62 of the associated base strut 60 and the corresponding arc-shaped cam slot 70 in the lower end 22 of the associated corner post 20 (also shown in FIGS. 34 through 36 and 44) and (ii) an upper end 56 that is pivotably attached to an transfer link 40 that also is pivotably attached to an upper rail assembly 30 (as shown in FIGS. 37 through 39, 45 and 46). The opening and closing of the play yard 1 (or folding structure) comprised of these frame assemblies 10 is controlled and driven by the central hub 80 (or, more broadly, the central joint member 82) that is connected to at least three cam actuator assemblies 50, all of which are structured to control the joint angles between the central hub 80 and the corner posts 20 and between the corner posts 20 and the upper rails 32.

By comparison, and as discussed below, the embodiment shown in FIGS. 1 and 2 has a single central hub 80 to which all cam actuator assemblies 50 connect and whereby the cam actuator assemblies 50 are not located in the same vertical plane as the upper rail assemblies 30. This same distinction between embodiments exists for the half frame assembles 12 (shown in FIGS. 11A through 14, 19 through 30) that comprise frame assembly 10. For ease of understanding the various parts and connections of the present invention, FIGS. 3 through 48 illustrate the various assemblies as being situated in a vertical plane. It should be understood that, depending upon the ultimate structure of the play yard 1 or the desired folding structure, these various assemblies may be assembled in a vertical plane or they may be assembled at the various angles described in connection with FIGS. 1 and 2.

The play yard 1 of the present invention can be comprised of three or more sides, as shown in FIGS. 1 and 2. The illustrative frame assembly 10 shown in FIGS. 3 through 5 and 48 is adapted for use with a play yard 1 in a manner whereby two adjacent corner posts 20 and the upper rail assembly 30 define a single side of the play yard 1 (also illustrated in FIGS. 1 and 2). As shown in FIGS. 1, 2 and 48, the cam actuator assemblies 50, in actual assembly and operation, connect between corner posts 20 and a central hub 80 in the middle of the play yard 1. The central hub 80 is configured to allow for corresponding interaction with the base struts 60. In the four-sided play yard 1, the cam actuator assemblies 50 form a cross or "X" at the bottom of the play yard 1 when fully opened (as shown in FIGS. 1 and 2). This direct connection of the base strut 60 to the corner post 20 eliminates several parts and some complication in design over prior art play yards in this field. As depicted in FIGS. 3 through 5, the illustrative frame assembly 10 has two halves or half frame assemblies 12 (shown in FIGS. 11A through 14, 19 through 30). The individual half frame assemblies 12 are shown in various perspectives and in various positions in FIGS. 6A through 14 and FIGS. 19 through 30. For the various embodiments of the present invention, the frame assembly 10 is operable to interact with additional frame assemblies 10 associated with all corner posts 20 of a folding structure or play yard 1 to control the opening and closing of the folding structure or play yard 1. Similarly, the half frame assembly 12, of the various embodiments of the present invention, is operable to interact with additional half frame assemblies 12 associated with all corner posts 20 of a folding structure or play yard 1 to control the opening and closing of the folding structure or play yard 1.

FIGS. 2 and 48 shows one embodiment of a play yard and an illustrative frame assembly 10 in an intermediate position, between fully open and fully closed. As more clearly shown in FIG. 48, the corner posts 20 of the present invention flex or tilt outward at the upper corners, away from being parallel to a central vertical axis when the play yard 1 is in the intermediate positions between fully opened and fully closed. During opening and closing, the corner posts 20 will tilt outward at least as far as 15° from vertical and inward at least as much as 5° from vertical, with a full range of motion of at least 20°. In one embodiment of the present invention, the corner posts 20 will tilt out to a maximum of 12° from vertical during the opening of the play yard 1 and tilt inward during closing of the play yard 1. In other embodiments, the corner posts 20 can tilt out more than 15°.

Unlike prior art play yards, the play yard 1 of the current invention does not require the creation of a rigid parallelogram with substantially vertical corner posts 20 and formed by upper and lower leg assemblies to create tension on the sides and corners of the play yard to maintain its shape and structure. Instead, as described more fully herein, the shape, structure and tension is created and maintained via the upper rails 32, the cam actuator assemblies 50, the various corners, and the central hub 80 of the present invention.

FIGS. 3 through 5 show one embodiment of an illustrative frame assembly 10 in the fully open position. A play yard 1, according to the present invention, will consist of at least three sides wherein a plurality of upper rails 32 are connected to each other by a plurality of upper joint members 34 and to the upper corners 21 of a plurality of corner posts 20 (as shown in FIGS. 1 and 2). As described above, each corner post 20 also connects to one end of the cam actuator assembly 50, and the central hub 80 is at the middle of all cam actuator assemblies 50 that join the central hub 80 at the center of the play yard 1. The upper rails 32 and corner posts 20 as viewed from the top down define a polygonal shape, such as a square or rectangle, but other polygonal shapes can be created using different numbers of corner posts 20, upper rails 32, and cam actuator assemblies 50, etc.

As shown in FIGS. 11A through 14 and FIGS. 19 through 30, each half frame assembly 12 is designed to be pivotally connected to a corner post 20 of a folding structure or play yard 1. Each half frame assembly 12 has the following: (i) one rail 32 having a rail outer end 36 pivotably connected to the corner post upper end 21 and having a rail inner end 37; and (ii) one cam actuator assembly 50. FIGS. 19 through 30 also show the upper joint member 34 connected to the one rail 32. This joint member 34 allows the first and second rails 32 of the upper rail assembly 30 to fold down during closing (shown in FIGS. 2 and 48). FIGS. 19 through 30 also show one cam actuator assembly 50 and the central joint member 82 interposed at the inner end of the cam actuator assembly 50. Therefore, a four-sided play yard 1 will have four corner posts 20, four upper rail assemblies 30, at least four cam actuator assemblies 50 and one central hub 80 or one central joint member 82 (as shown in FIGS. 1 and 2).

The corner posts 20 of the present invention may be comprised of a rigid material, such as metal, that is formed to present flat projecting edges 23 at various angles depending upon the shape of the play yard 1, including at a substantially 90-degree angle at the upper end 21 of each corner post 20. Each flat projecting edge 23 at the upper end 21 of each corner post 20 provides a pivotable point of connection for the upper rail assemblies 30. The following is a description of the connection of one upper rail 32 to one side of one corner post 20 at the upper end 21 of the corner post 20. It will be obvious to one skilled in the art that this connection may be duplicated on the other flat projecting edges 23 of the corner post 20 at the upper corner 21 and then on both flat projecting edges 23 of all corner posts 20.

Figure 37:
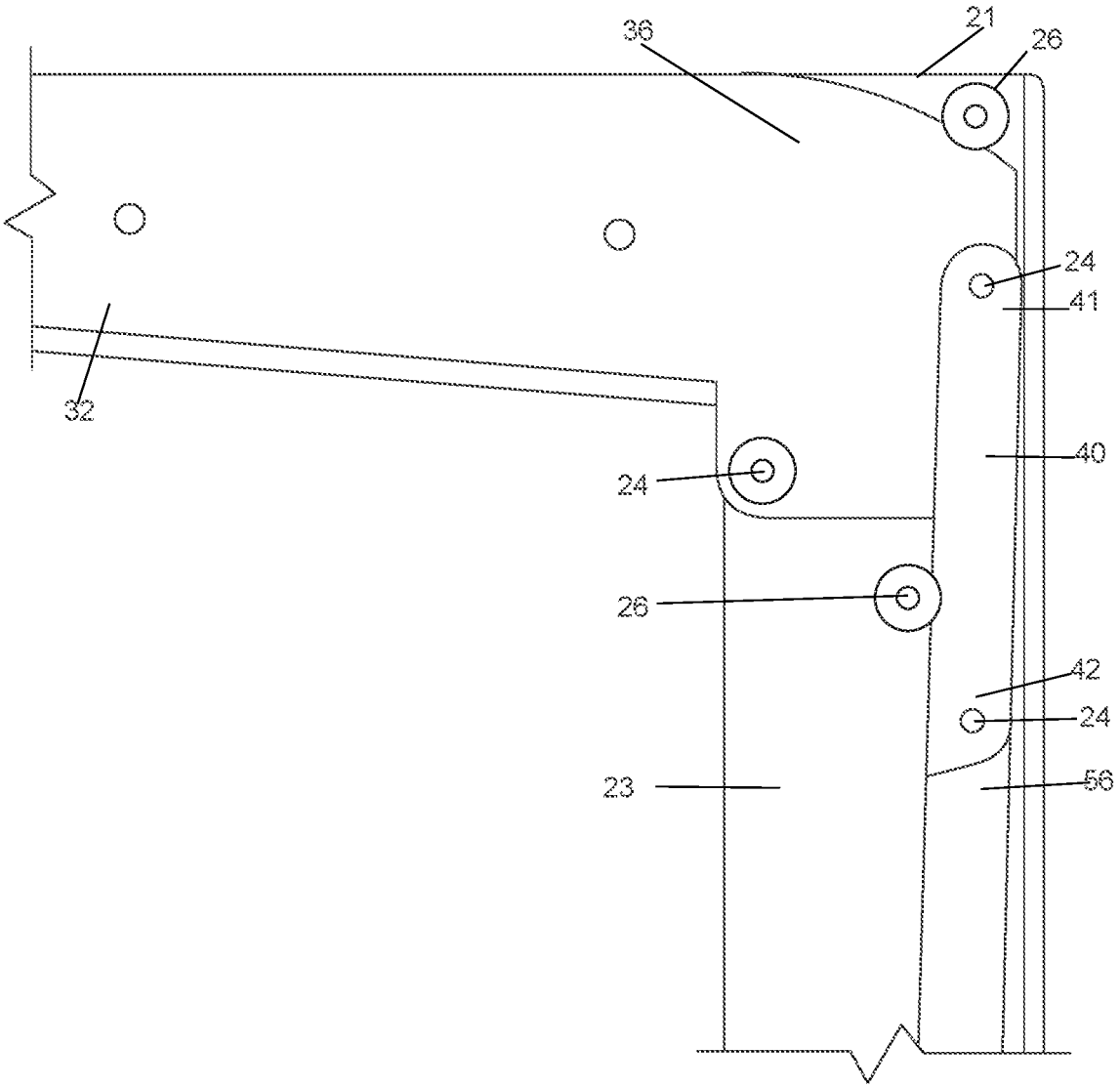
FIG. 37 illustrates the interconnections of a rail, a corner post upper end, a transfer link, and an actuator rod upper end according to one embodiment of the present invention in the open position.
Figure 38:
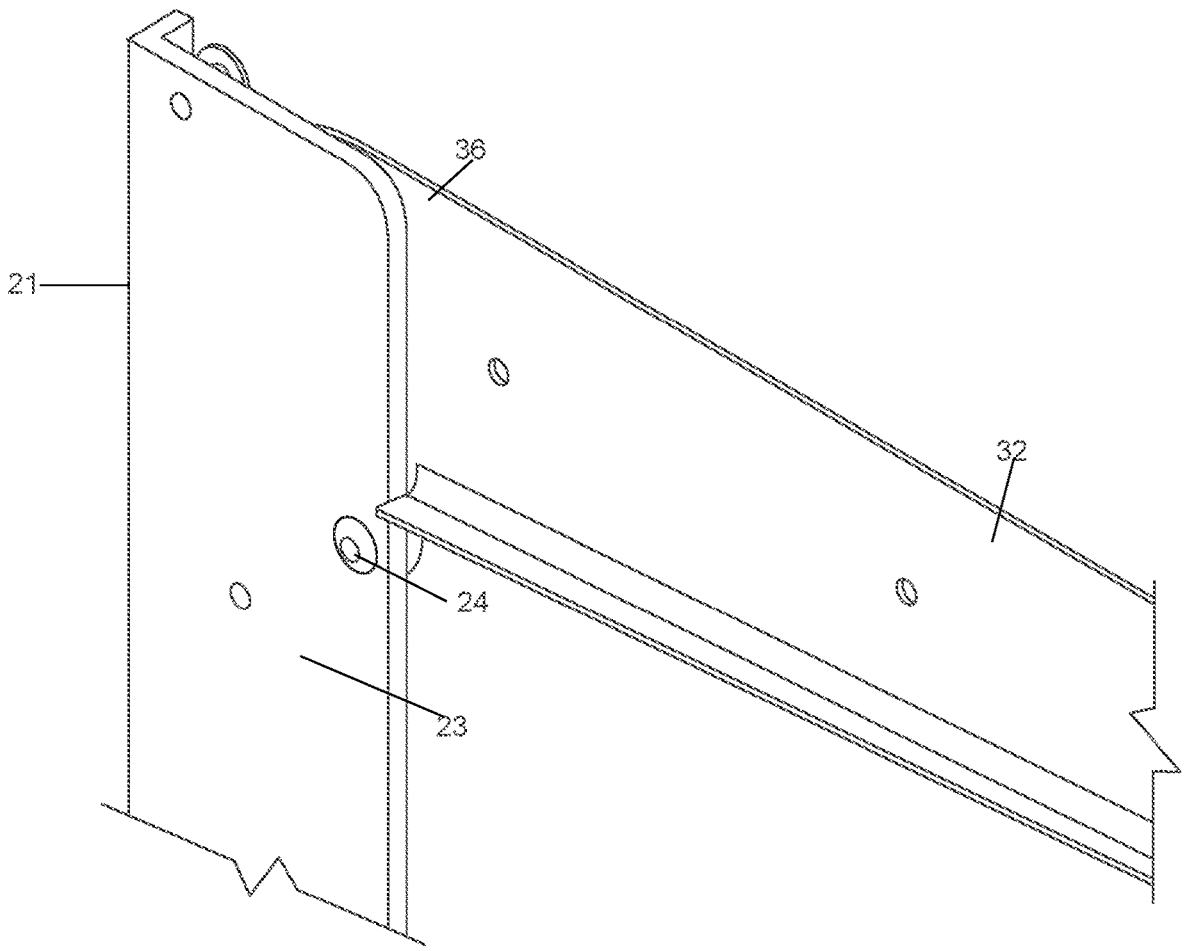
FIG. 38 is a front view of an upper corner of FIG. 37.
Figure 39:
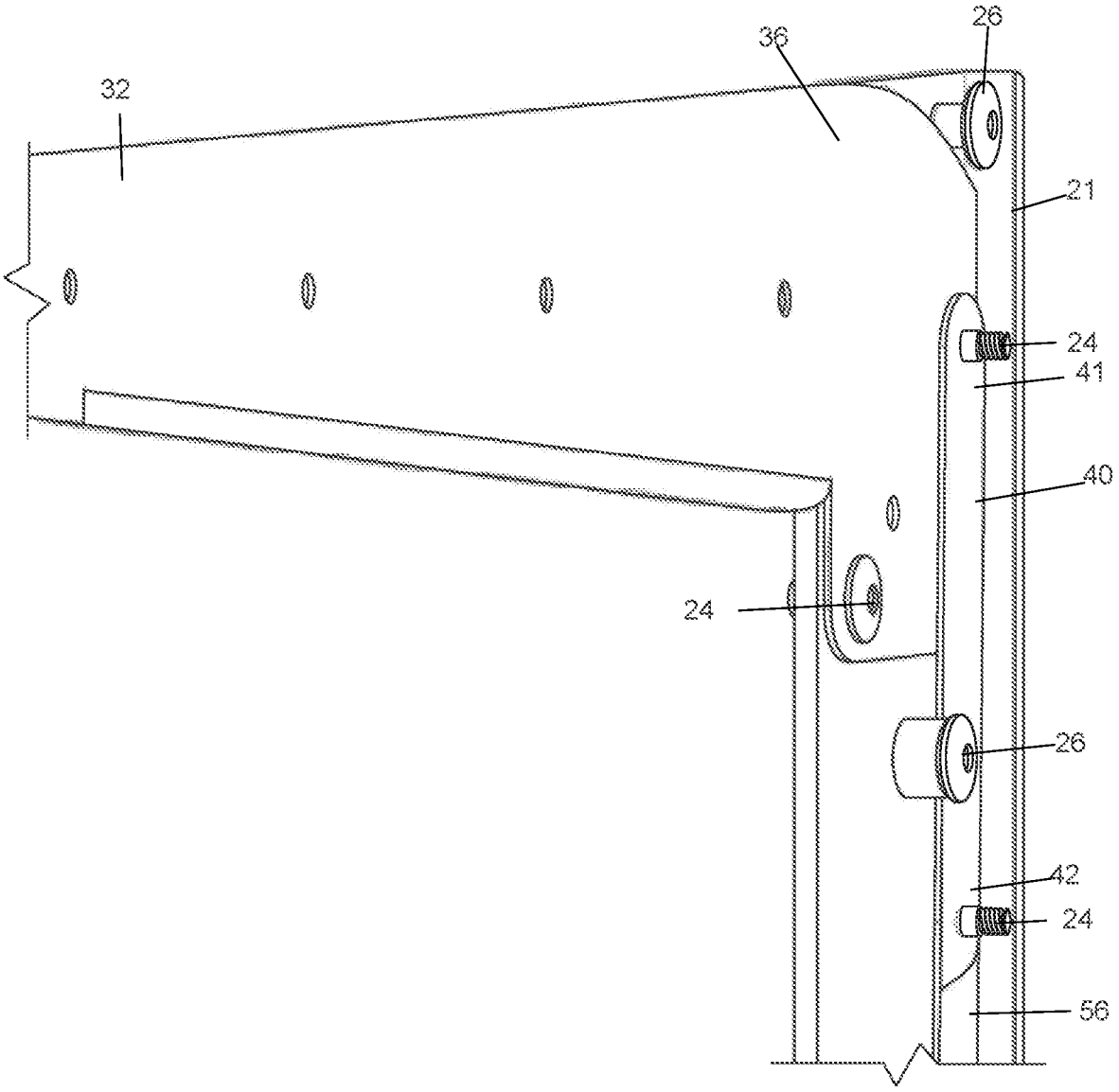
FIG. 39 is a perspective view of FIG. 37.
Figure 40:
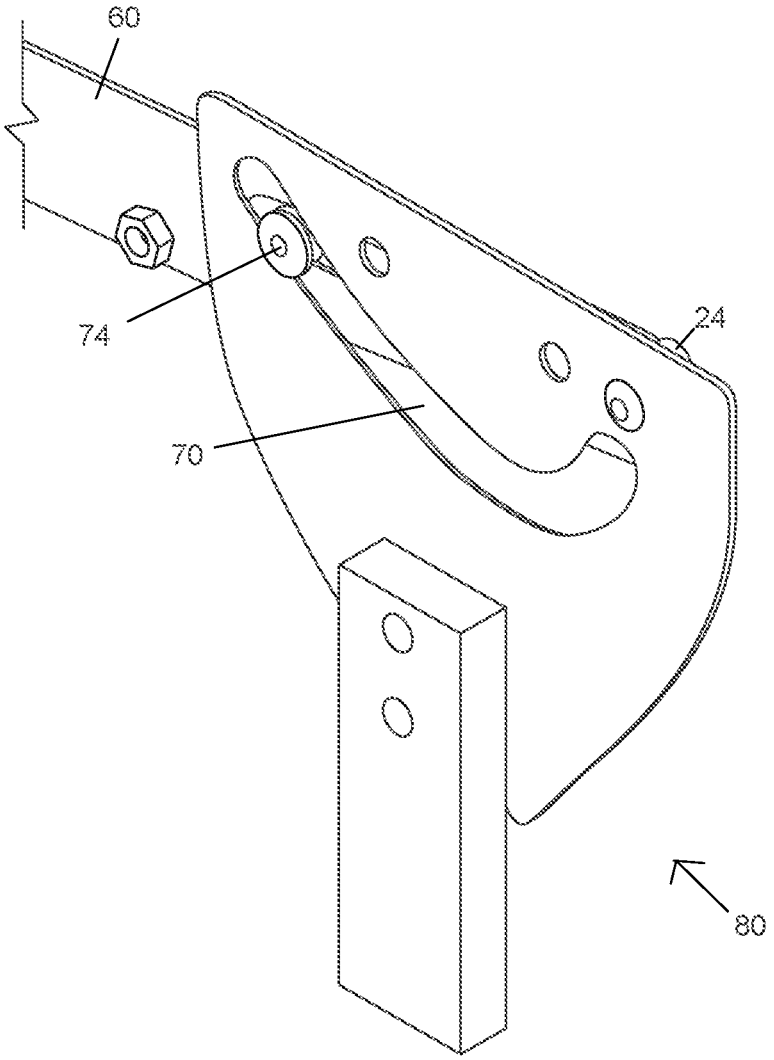
FIG. 40 is a perspective view of a hub according to one embodiment of the present invention in an almost open, but not locked, position.
Figure 41:
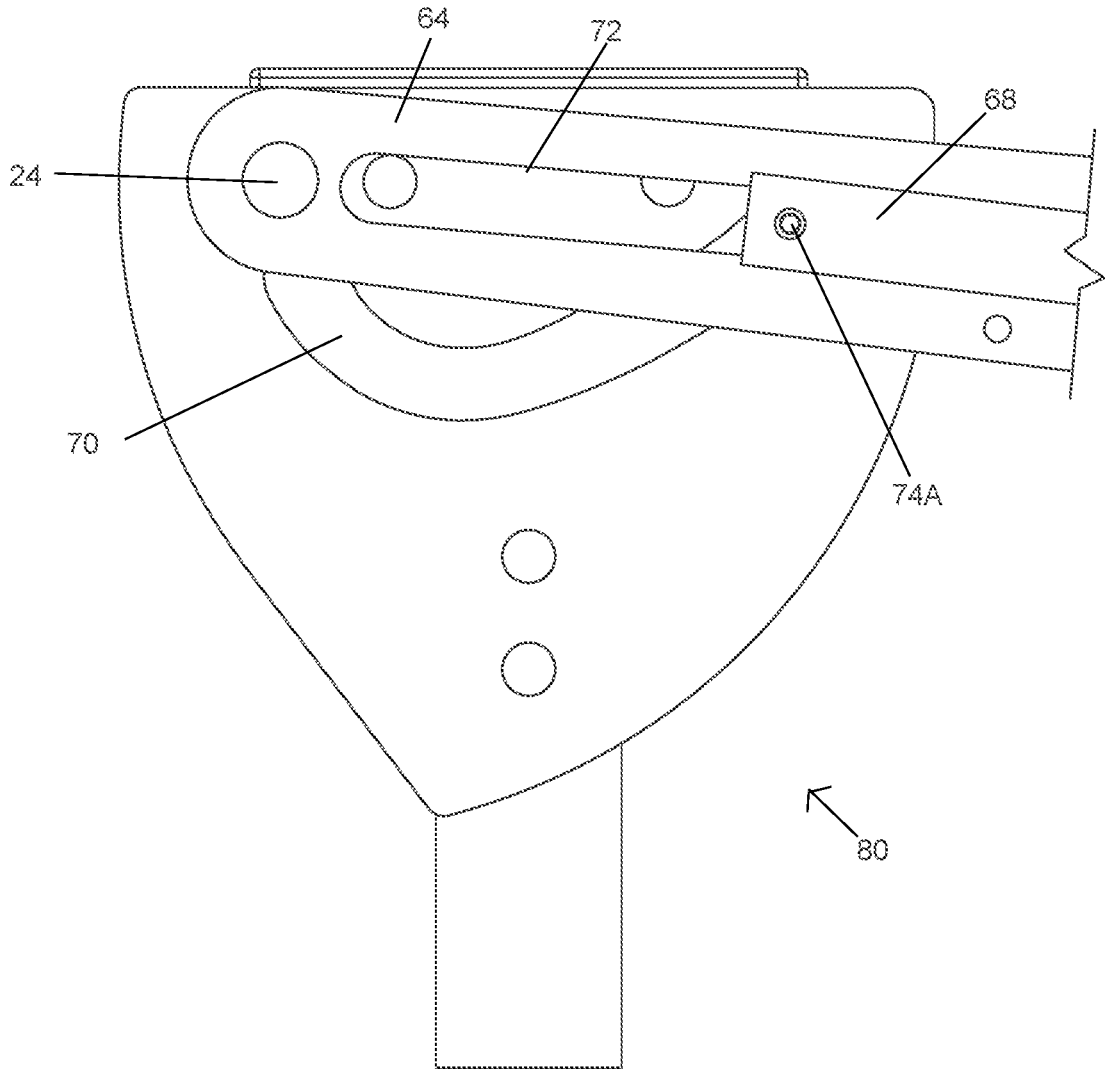
FIG. 41 is an alternative view of hub of FIG. 40.
Figure 42:
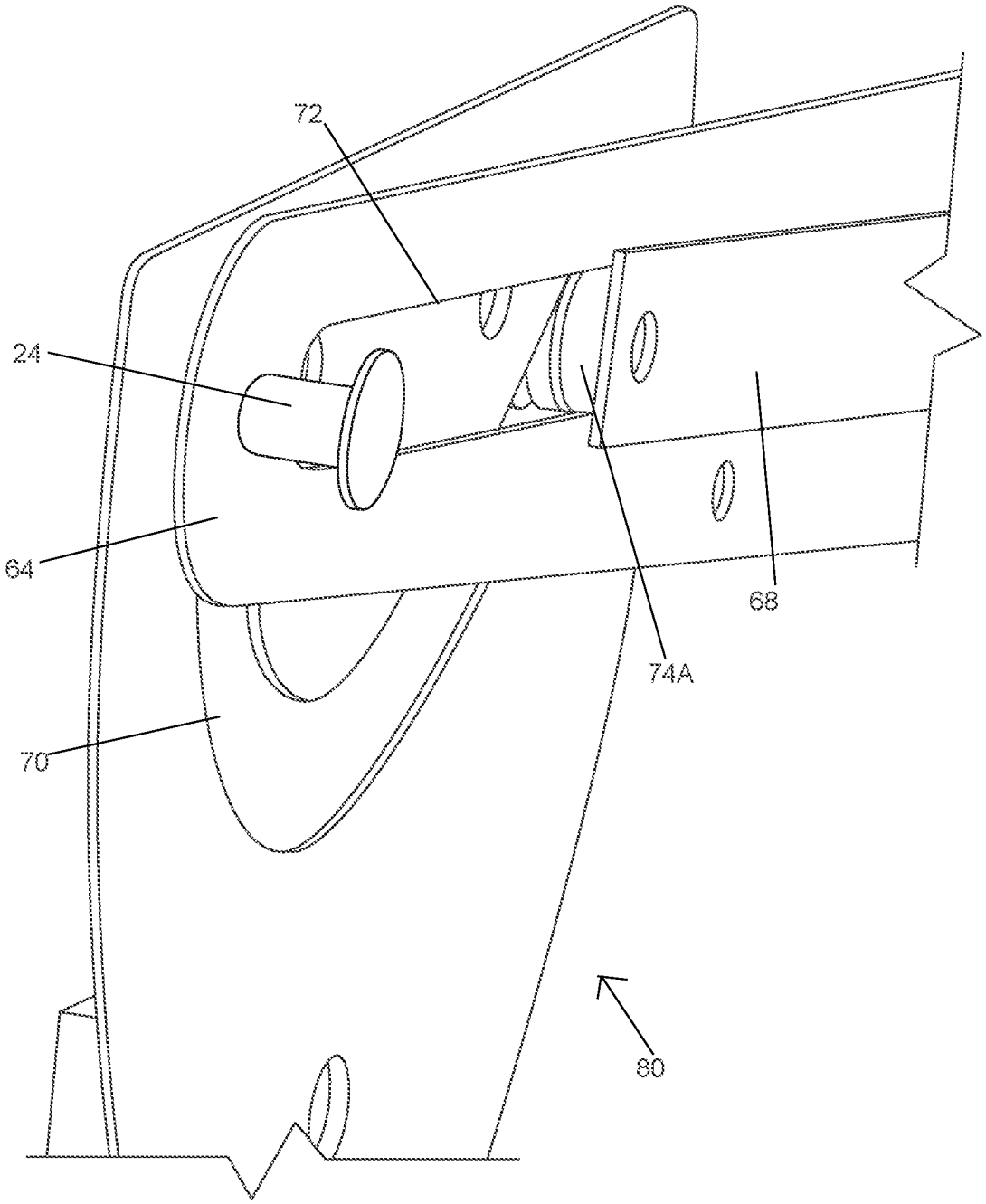
FIG. 42 is another perspective view of the hub according to FIGS. 40 and 41.
Figure 43:
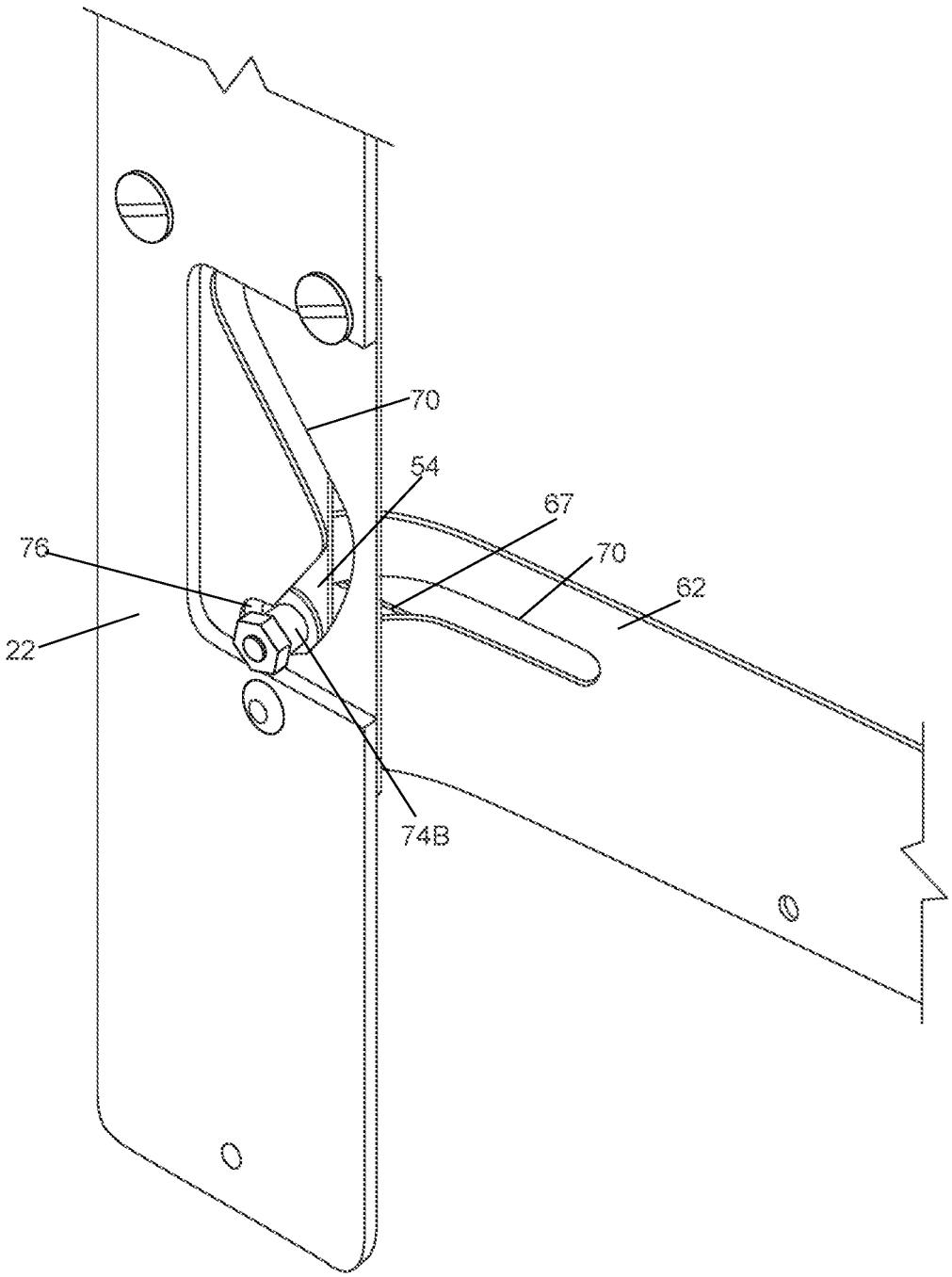
FIG. 43 illustrate a corner post lower end according to one embodiment of the present invention in an almost open, but not locked, position.
Figure 44:
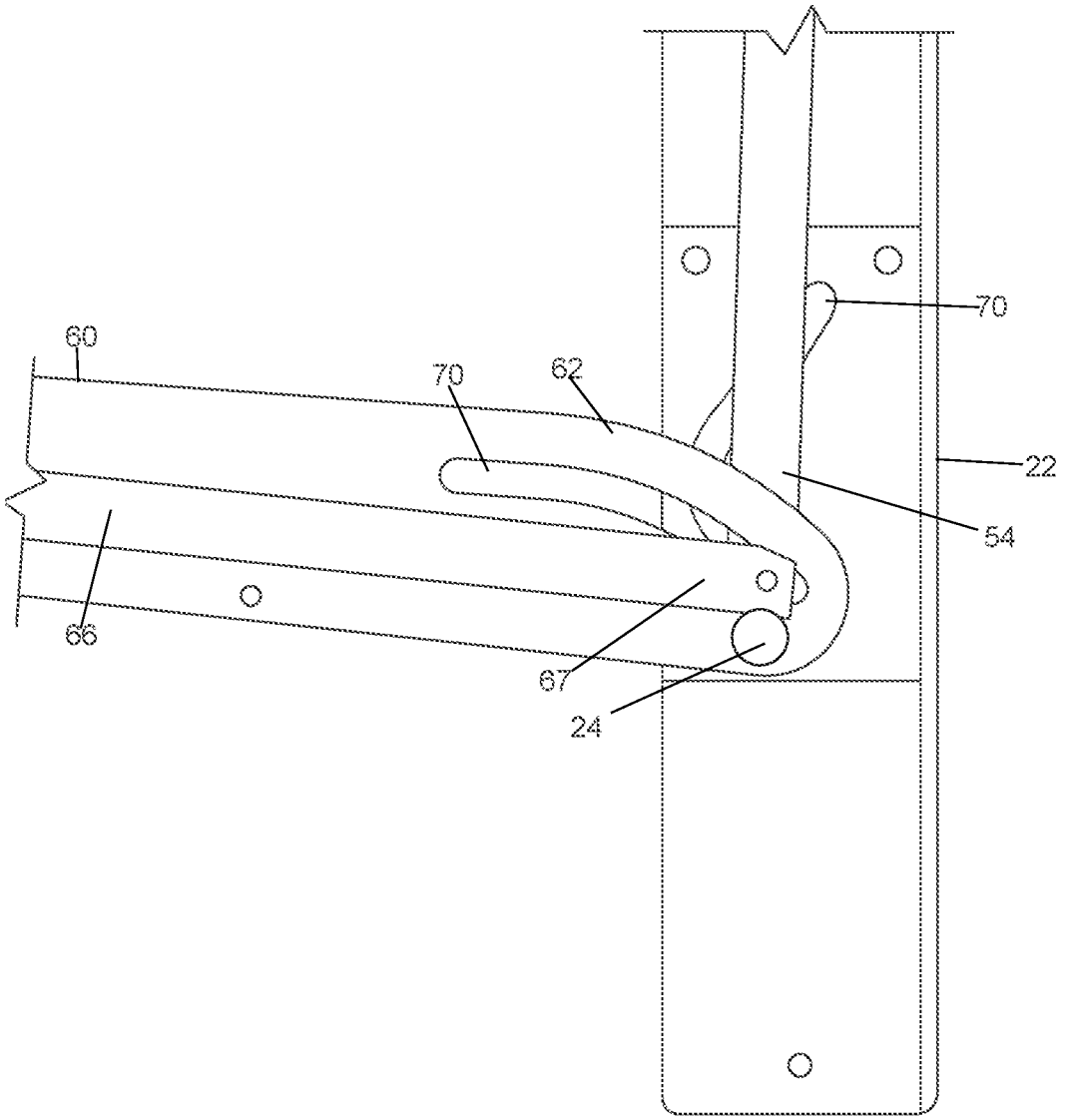
FIG. 44 is an alternative view of the lower corner of FIG. 43.
Figure 45:
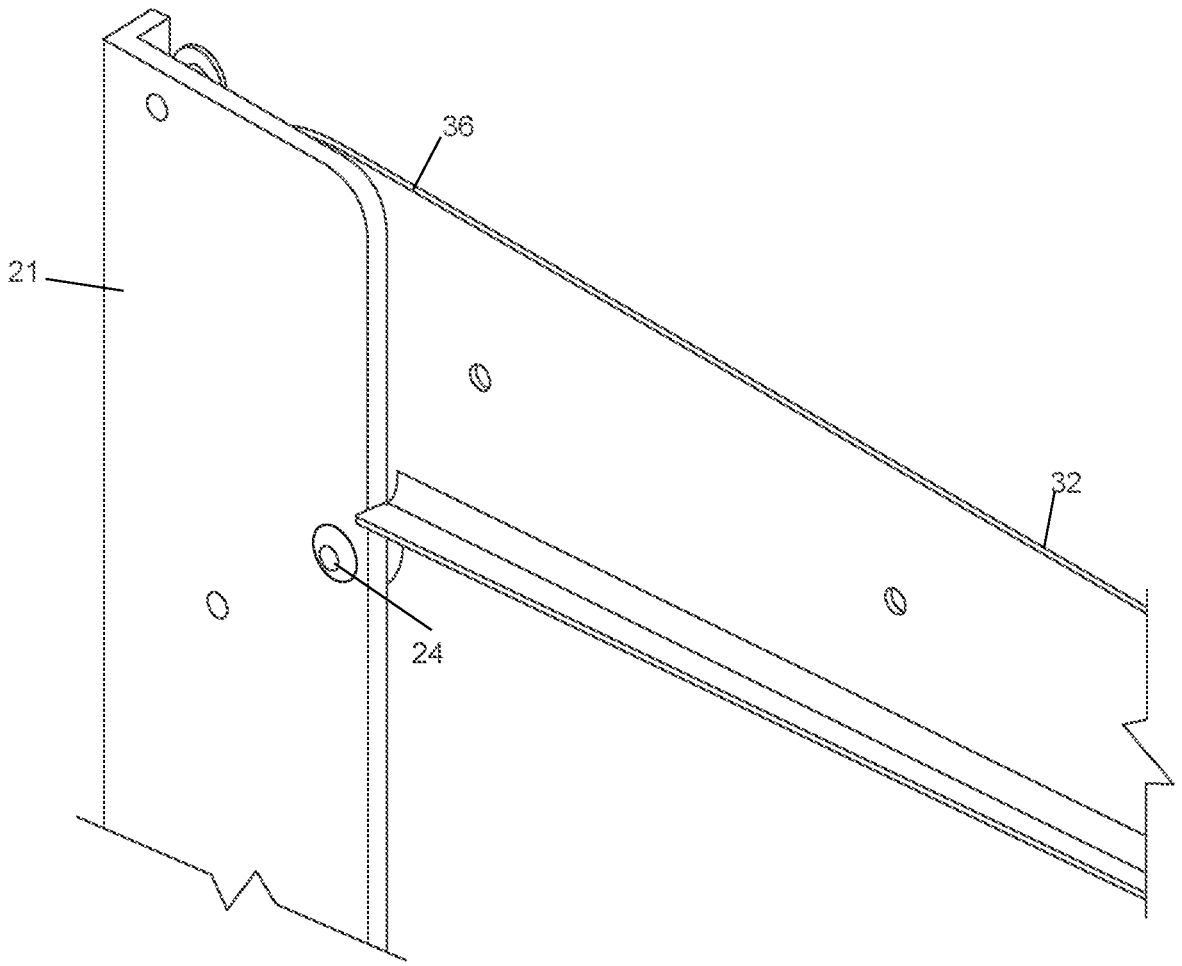
FIG. 45 is a front view of an upper corner according to one embodiment of the present invention.
Figure 46:
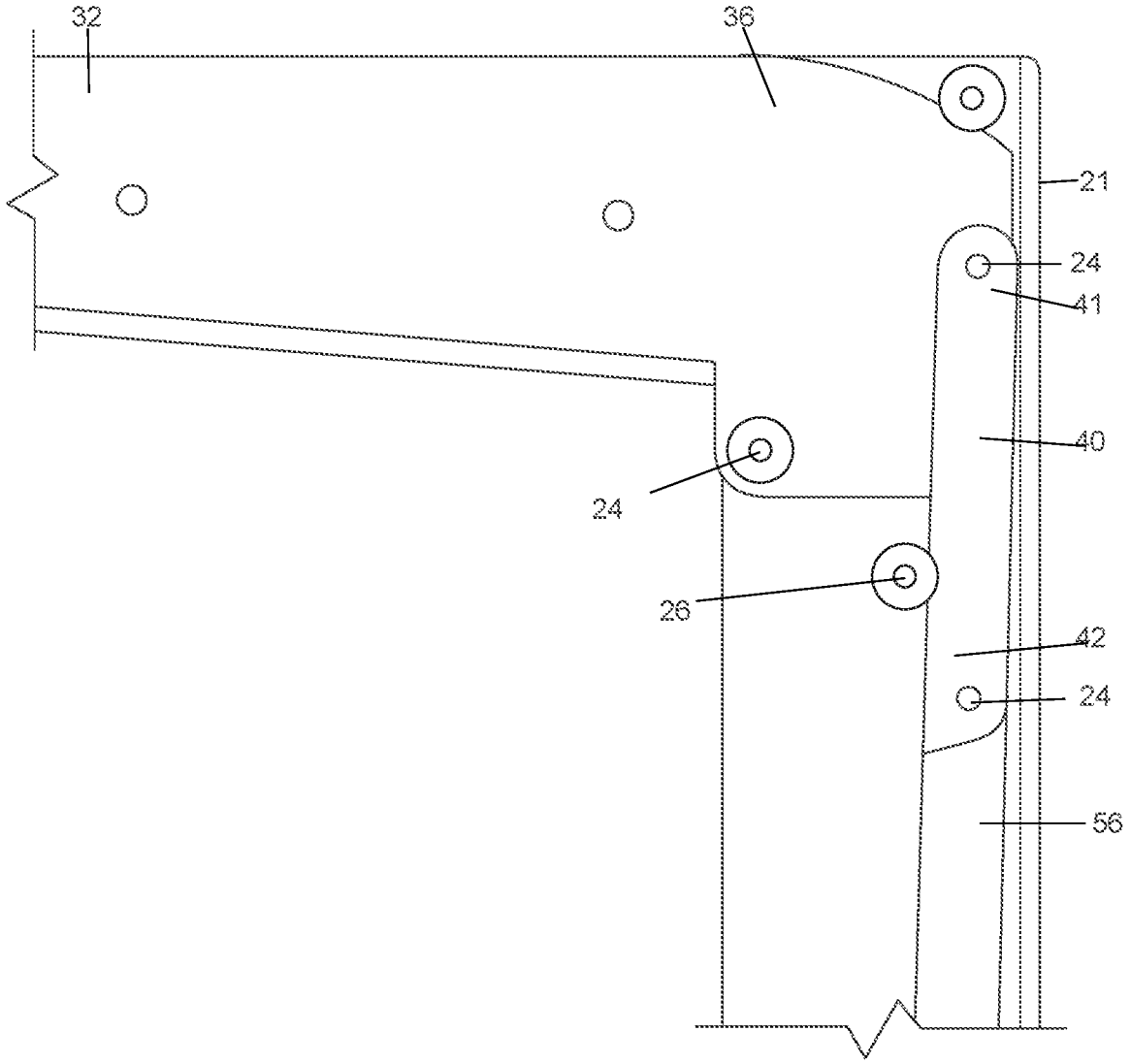
FIG. 46 is a rear view of the upper corner of FIG. 45.

FIGS. 11A through 16, 19 through 30 and 37 through 39 show the upper end 21 of one side of the corner post 20 where one rail 32 of the upper rail assembly 30 connects to one flat projecting edge 23 of the corner post 20. As can be seen in FIGS. 37 through 39, the outer end 36 of one rail 32 of the upper rail assembly 30 is pivotably connected at a pivot point 24 to the corner post 20, and the outer end 36 of the one rail 32 also pivotably connects to an upper end 41 of a corresponding transfer link 40 that, in turn, is pivotably connected, at the lower end 42 of the transfer link 40, to the upper end 56 of a corresponding actuator rod 52. The actuator rod 52 is part of the cam actuator assembly 50, as discussed above and more fully below, and is oriented along and moveably attached in an arc-shaped cam slot 70 located in the lower end 22 of the corner post 20. The transfer link 40 rests against and is movably secured in part by a guidepost 26 attached at the upper end 21 of the corner post 20 (as shown in FIGS. 37 through 39). In operation, and as shown generally in FIGS. 9A through 9C, 11A through 11C, 12 through 14, and 19 through 30, when the play yard 1 is opened—by pushing the central hub 80 downward—each cam actuator assembly 50 functions to pull its actuator rod 52 downward and also to maintain an upright orientation of the corner posts 20. This downward movement of the actuator rod 52, in turn, pulls the attached transfer link 40 downward against the guidepost 26 when the play yard 1 is nearly open. The downward movement of the transfer link 40 acts to pull the attached upper rail assembly 30 into an approximately horizontal position.

The present invention utilizes a central hub 80 to drive the opening of the play yard 1, and portions of the central hub 80 are shown in detail in FIGS. 7A, 7B, 31, 32, 33, 40, 41 and 42. FIGS. 6A, 6B, 8A through 8C, 10A through 10C, 17, 18, and 34 through 36 show the lower ends 22 of the corner posts 20 and specifically the attachments to the base struts 60. In operation, a user pushes down on the central hub 80, which, in turn, pushes all four base struts 60 and associated strut cam rods 66 away from the central hub 80 and toward the lower corners of the play yard 1 structure (illustrated in FIGS. 6A and 6B, 7A and 7B, 8A through 8C, 9A through 9C, 10A through 10C and 11A through 11C). If a locking mechanism is used in the upper corners of play yard 1 to keep the invention in the closed position, the locking mechanisms are released before the central hub 80 can be pushed down. The downward movement of the central hub 80 causes cam wheel 74A associated with strut cam rod 66 of the cam actuator assembly 50 to move in an arc within the cam slot 70 of the central hub 80 and to push outward in the corresponding cam slot 72 in the inner end 64 of the base strut 60 as is shown in detail in FIGS. 7A and 7B. This movement transfers to the outer end 67 of the strut cam rod 66, whereby cam wheel 74B moves outward in an arc within the cam slot 70 at the outer end 62 of the base strut 60 and the cam slot 70 in the lower end 22 of the corner post 20 as is shown in detail in FIGS. 8A through 8C and 10A through 10C. The outer end 67 of the strut cam rod 66 is pivotably attached to the lower end 54 of the actuator rod 52 so that the lower end 54 of the actuator rod 52 similarly moves in an arc within the cam slot at the outer end 62 of the base strut 60 and the cam slot 70 in the lower end 22 of the corner post 20, also shown in FIGS. 8A through 8C and 10A through 10C. The transfer of movement to the actuator rod 52 acts to keep the corner posts 20 in an upright orientation without collapse, and, as described above, also acts to pull the upper rail assemblies 30 upward into a substantially horizontal position (shown in FIGS. 9A through 9C). It also results in the corner post 20 angle being locked in by the height of the central hub 80. There is a wide range of motion for the cam actuator assemblies 50 as the central hub 80 moves up and down and when the play yard 1 is transitioning from fully open to fully closed and vice versa. In particular, with respect to the angle formed at the central hub 80 by the intersection of the vector of longitudinal orientation of base strut 60 and a horizontal line perpendicular to the vector of vertical movement of central hub 80, the movement of the central hub 80 moves each cam actuator assemble 50 anywhere from 110-degrees from horizontal when the central hub 80 and play yard 1 are in the fully closed position to 15-degrees below the horizontal when the central hub 80 and play yard 1 are in the fully open position. In one embodiment of the present invention, the cam actuator assemblies 50 are at 70-degrees from the horizontal in the closed position and at 0-degrees from horizontal in the open position. It will be obvious to one skilled in the art that there are a variety of ways to connect the various parts of the invention to the arc-shaped cam slots 70 and to the straight cam slots 72. One embodiment of the present invention uses cam wheels 74 to make these various connections, for example, using a cam wheel 74A to connect each strut cam rod 66 to an arc-shaped cam slot 70 in the central hub 80 at its inner end 68 and a cam wheel 74B to connect the outer end 67 of each strut cam rod 66 to an arc-shaped cam slot 70 in the lower corner 22 of the corner post 20.

In one embodiment of the present invention, and unlike other play yards that maintain a rigid and substantially vertical orientation of the corner posts, the upper ends 21 of the corner posts 20 can tilt or flex inwards and outwards during the opening and closing of the play yard 1 (as shown in FIG. 48), but the actuator rod 52 operates to prevent any inward or outward collapse of the corner posts 20.

When the play yard 1 is fully opened, the position of each actuator rod 52 and each cam actuator assembly 50 is locked by resting cam wheels 74B in corresponding extensions 76 in the cam slot 70 located at the lower end 22 of each corner post 20. Cam slot extensions 76 are shown in FIGS. 17 through 19, 21 through 27, 35, and 43.

Figure 12:
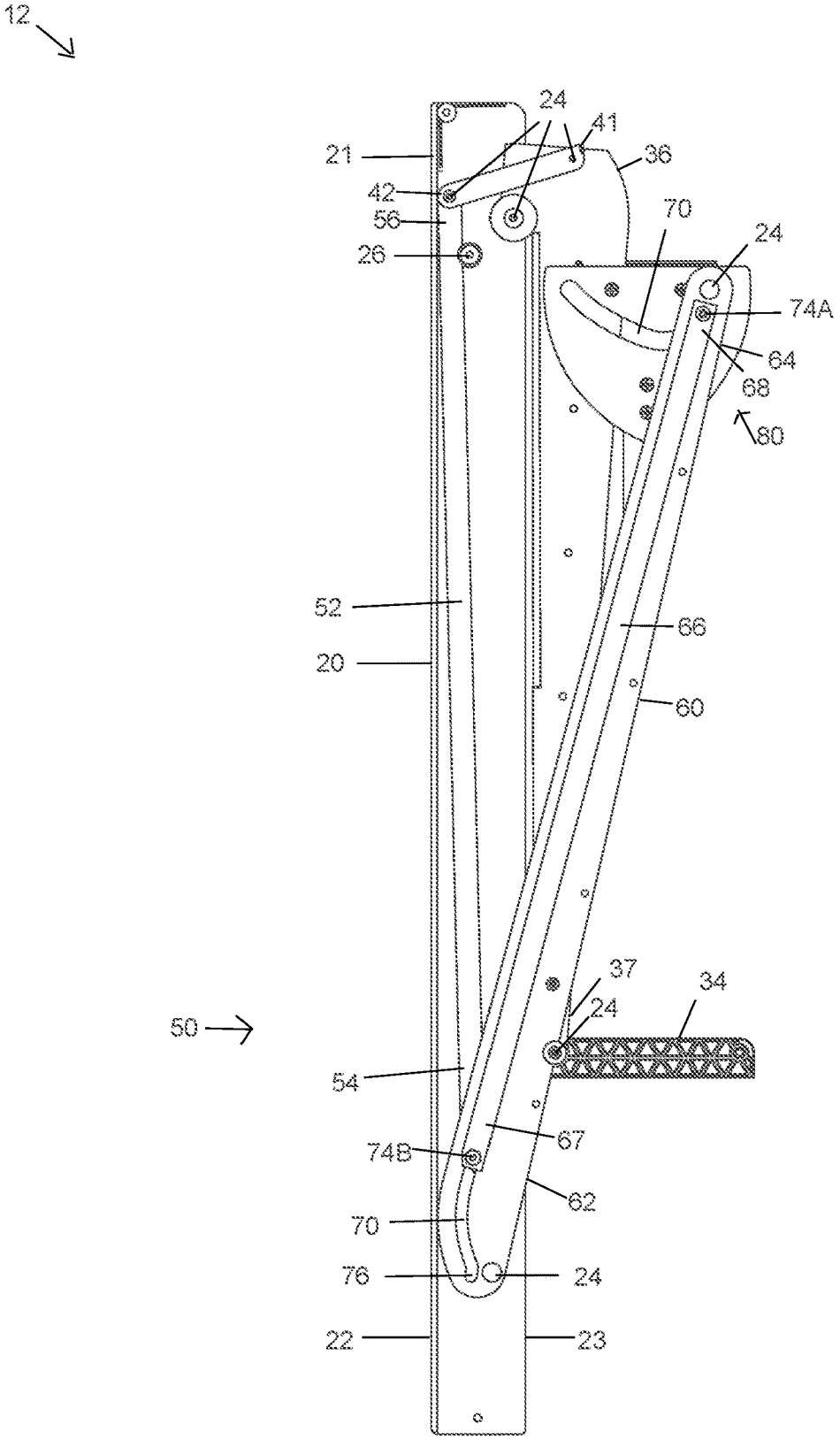
FIG. 12 shows a half frame assembly according one embodiment of the present invention in a closed position.
Figure 13:
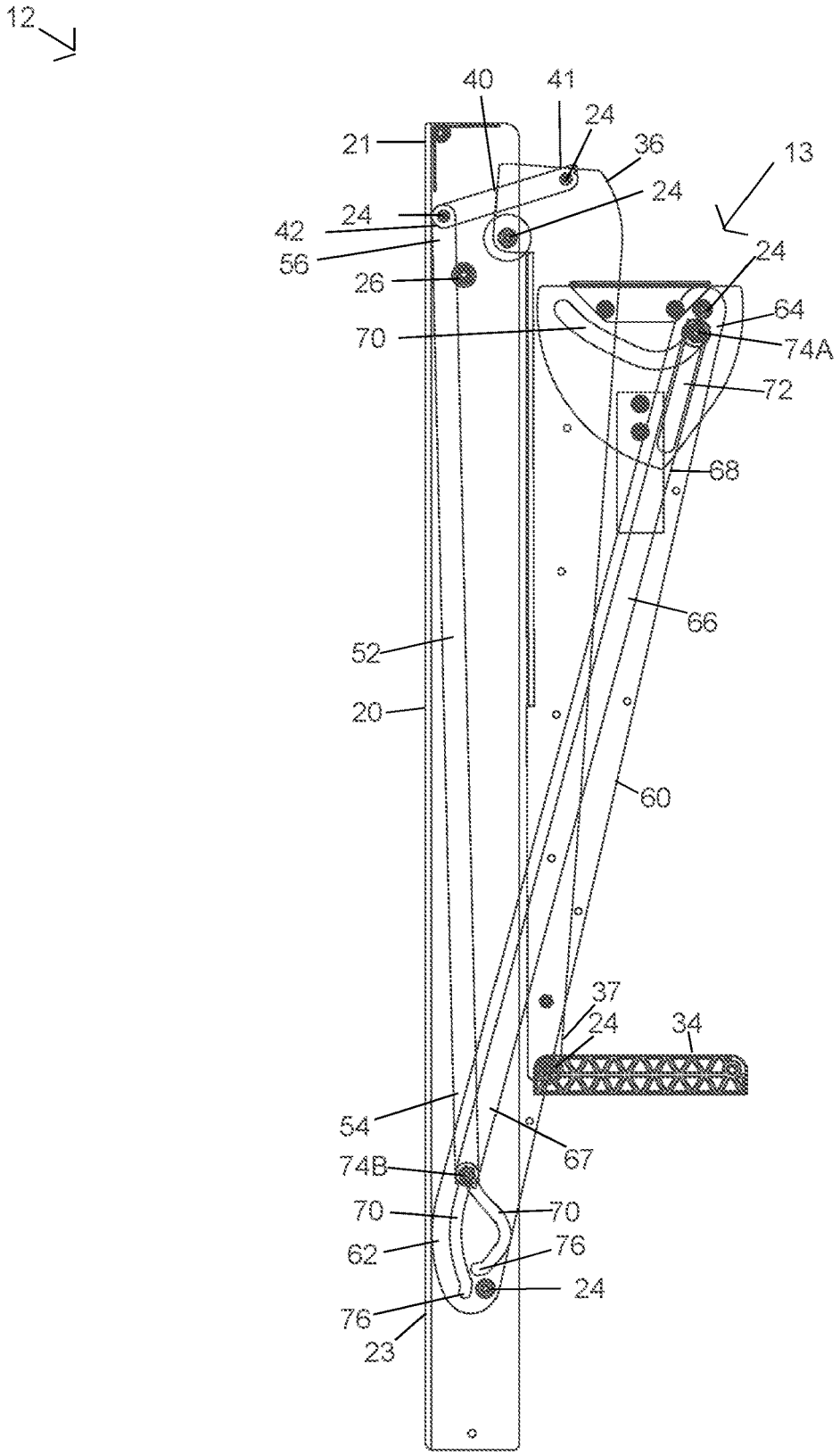
FIG. 13 shows the half frame assembly of FIG. 12 with all hidden lines and parts visible.
Figure 14:
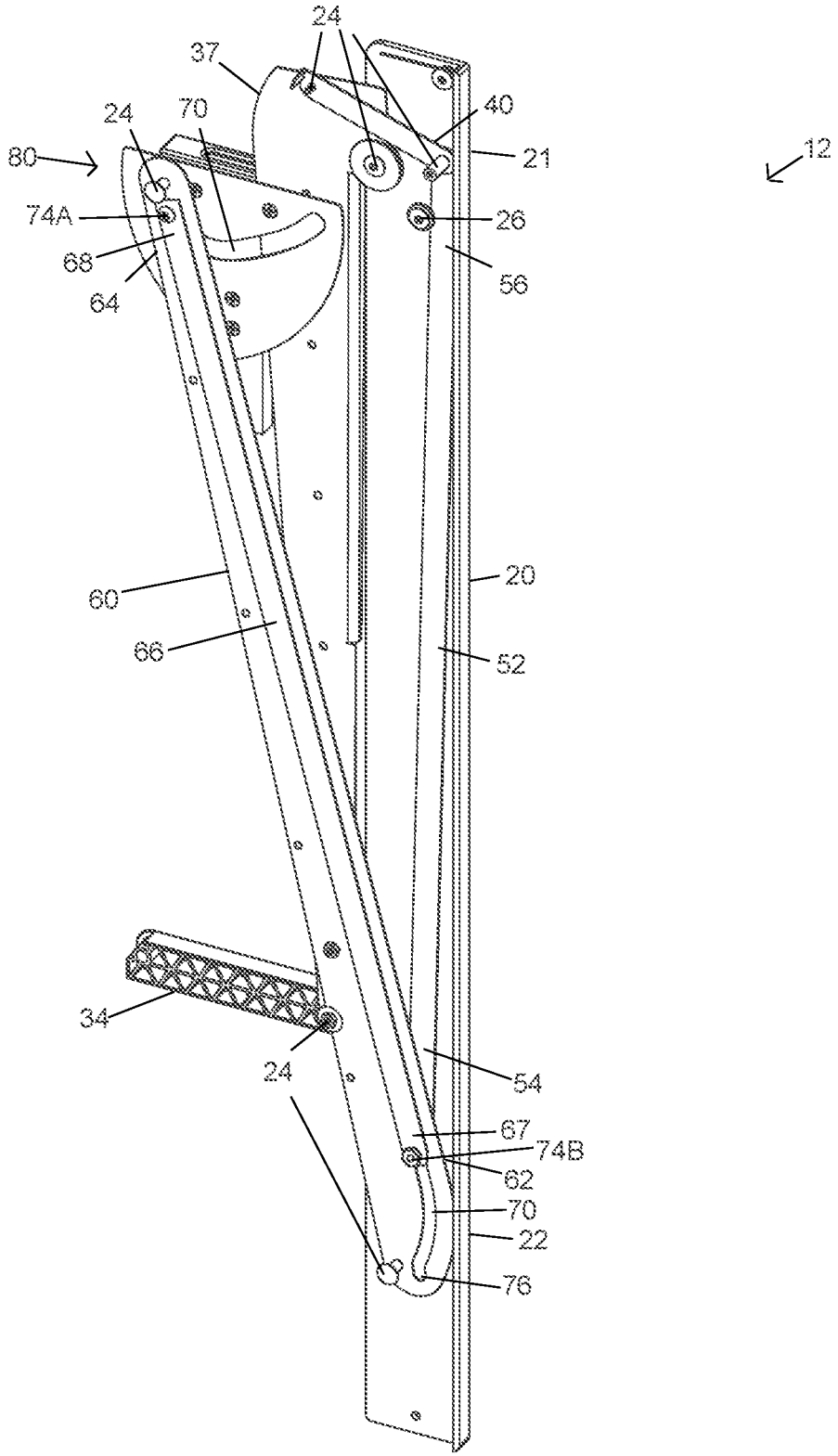
FIG. 14 is a perspective view of the half frame assembly from FIG. 12.
Figure 15:
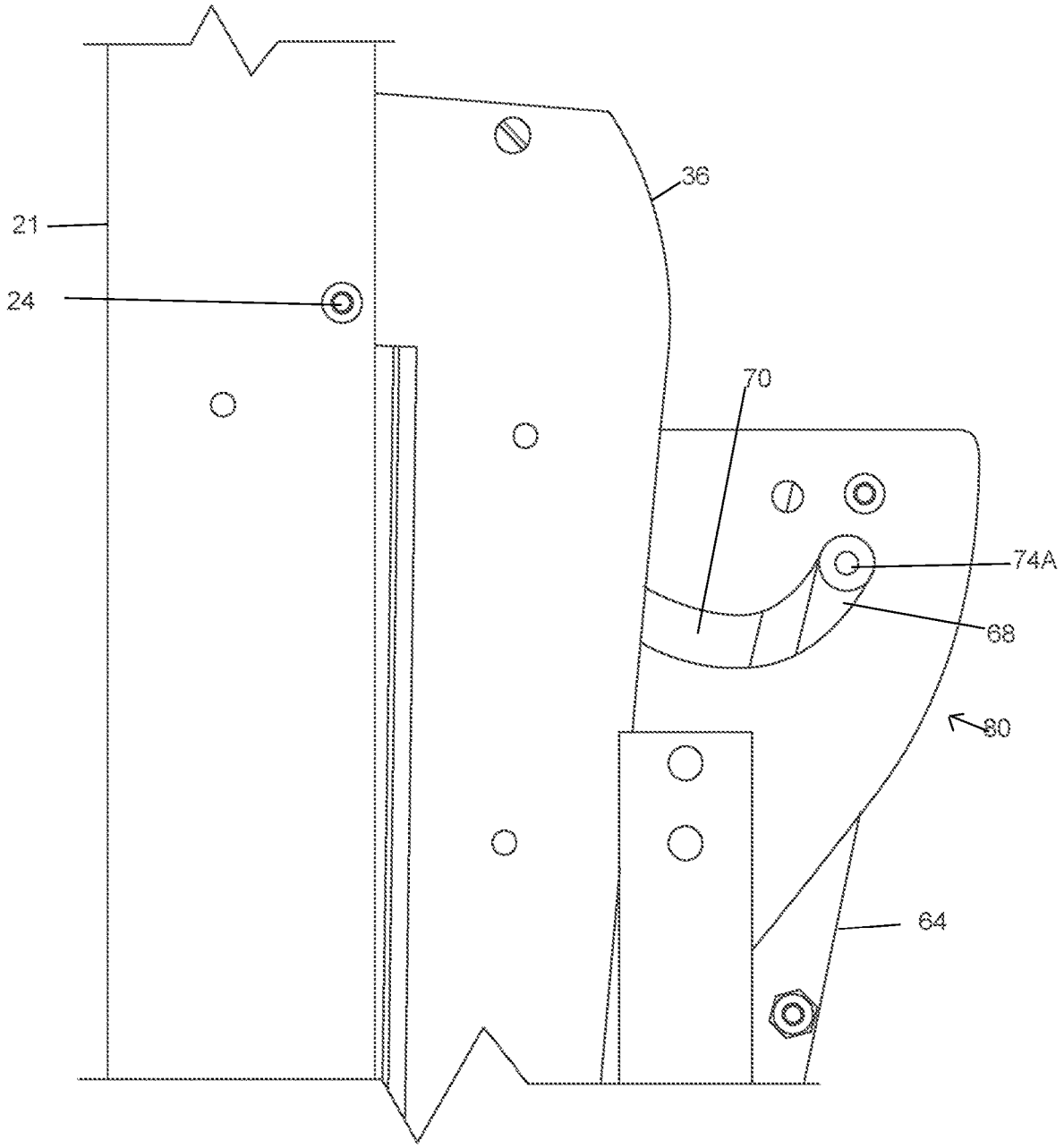
FIG. 15 is a front view of an upper corner and a hub according to one embodiment of the present invention in a closed position.
Figure 16:
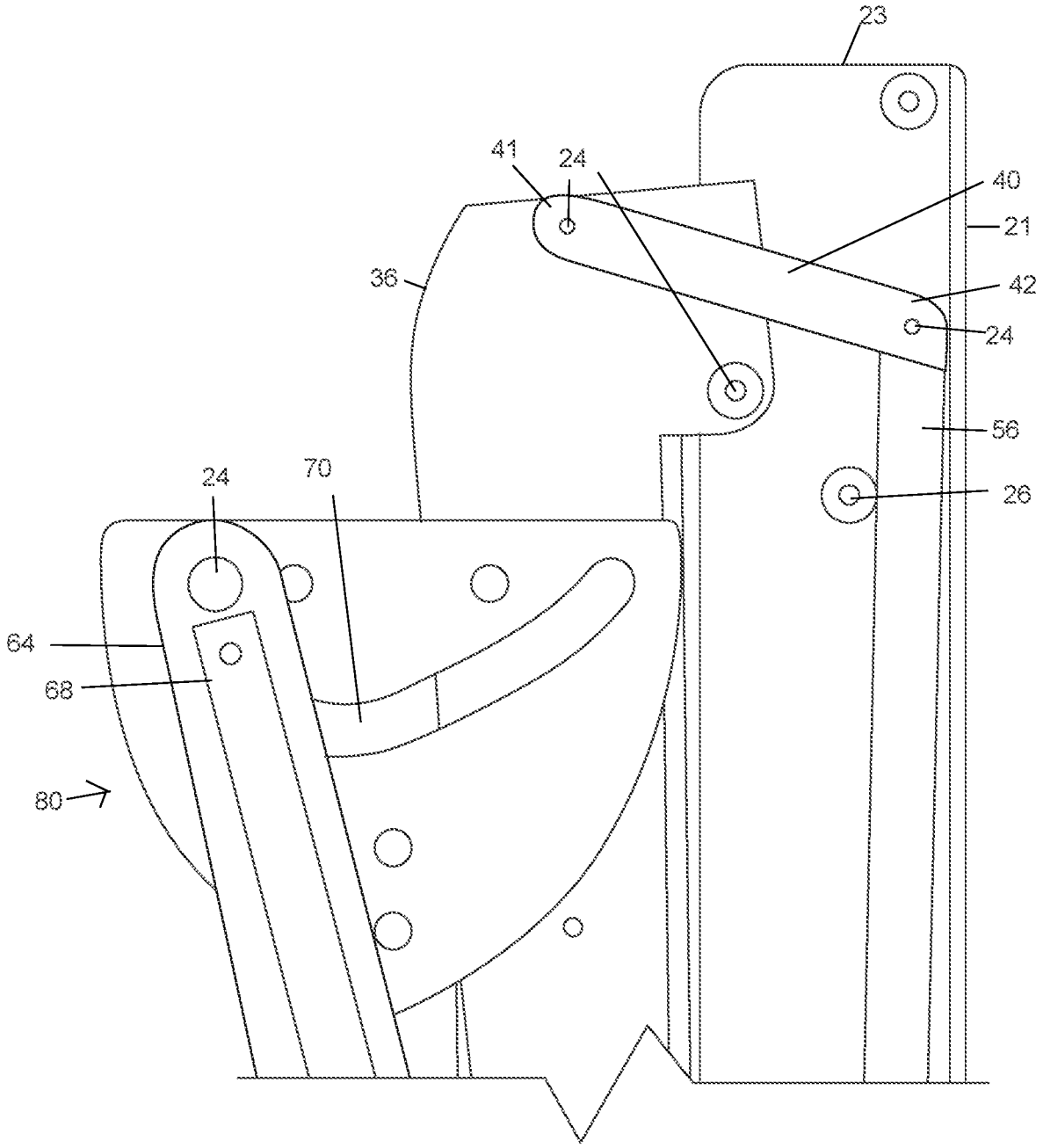
FIG. 16 is a rear view of an upper corner and a hub according to one embodiment of the present invention in a closed position.
Figure 17:
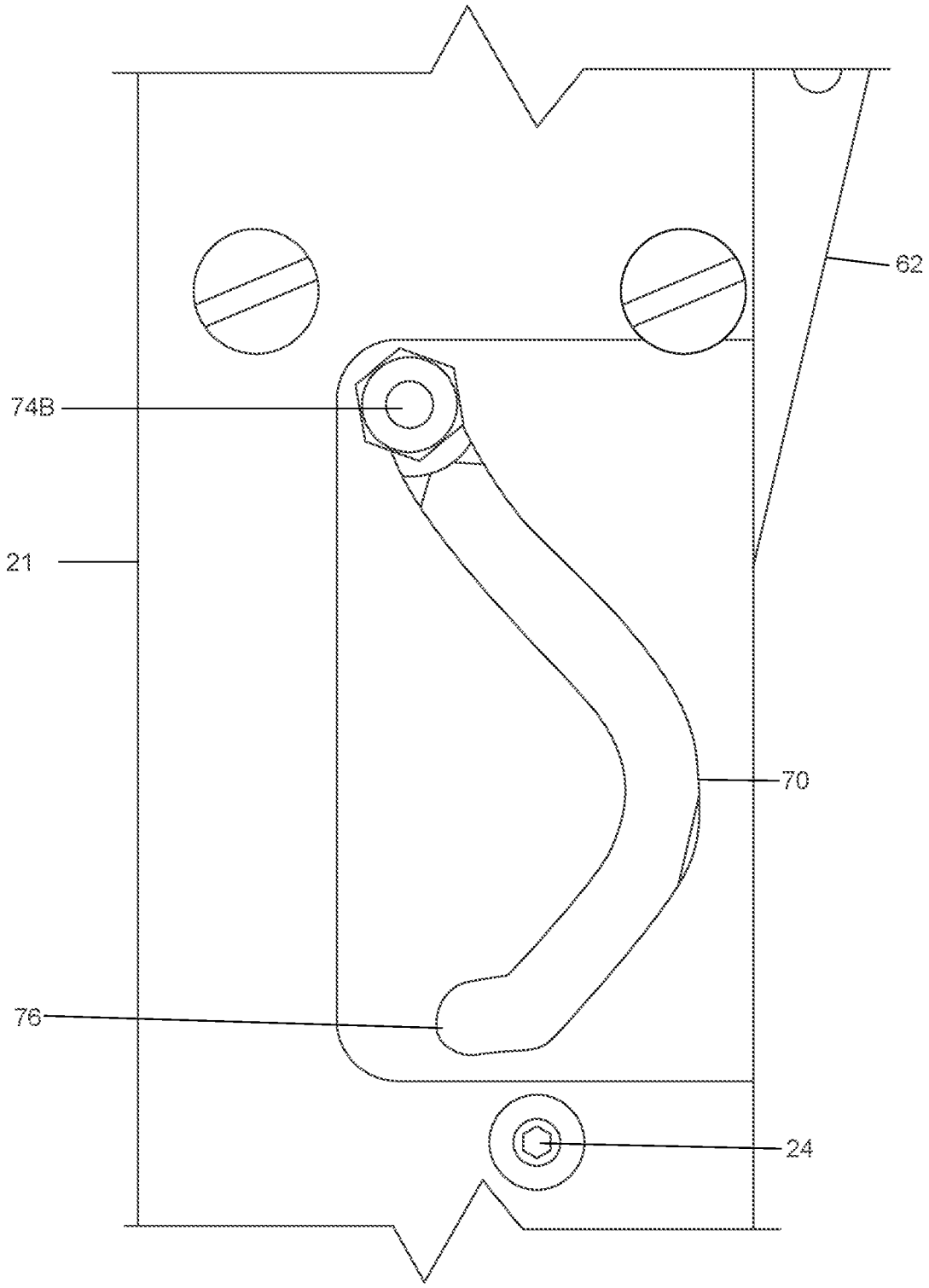
FIG. 17 is a front view of a lower corner according to one embodiment of the present invention in a closed position.
Figure 18:
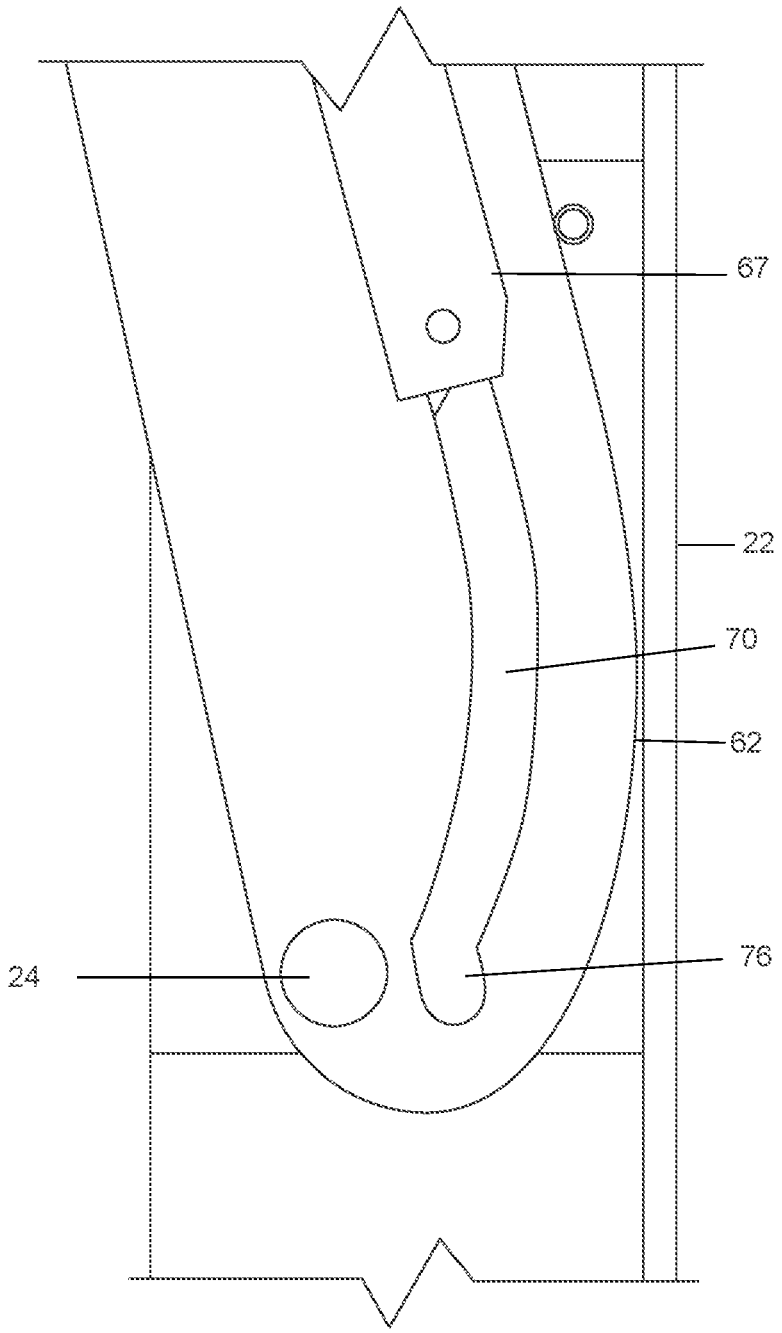
FIG. 18 is a rear view of a lower corner according to one embodiment of the present invention in a closed position.
Figure 19:
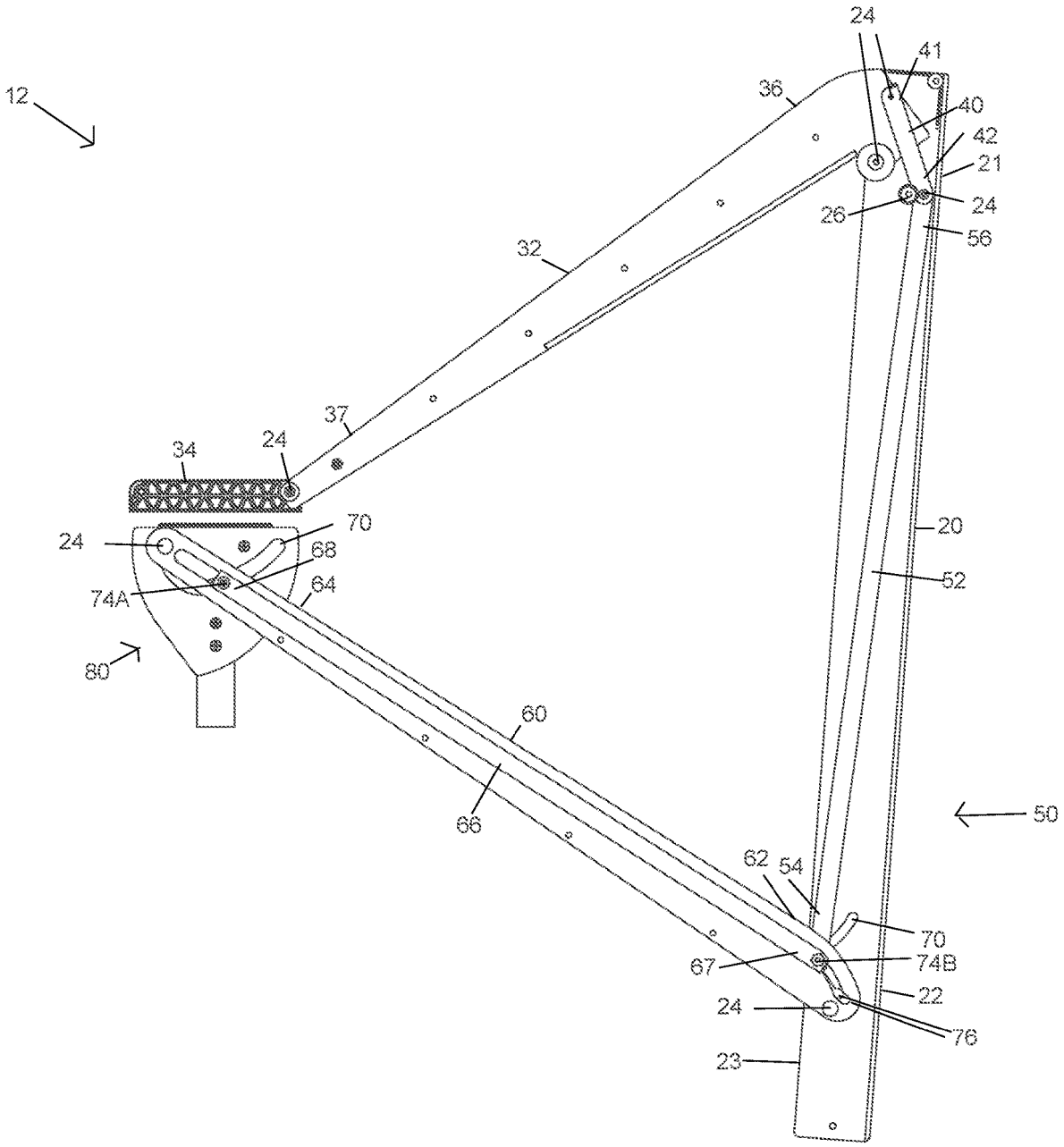
FIG. 19 is a half frame assembly of one embodiment of the present invention in the half open position.
Figure 20:
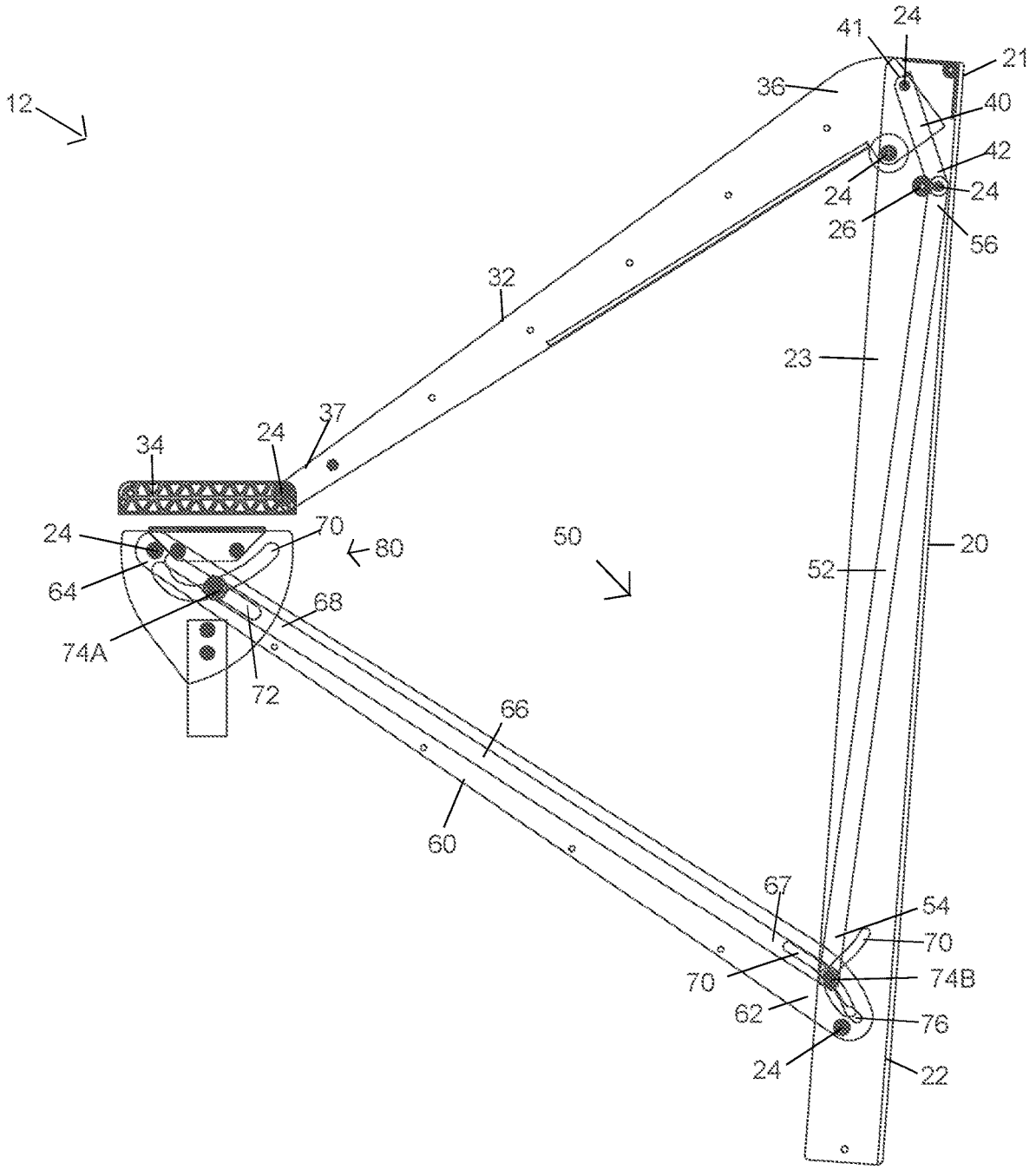
FIG. 20 shows the half frame assembly of FIG. 19 with hidden lines and parts visible.
Figure 21:
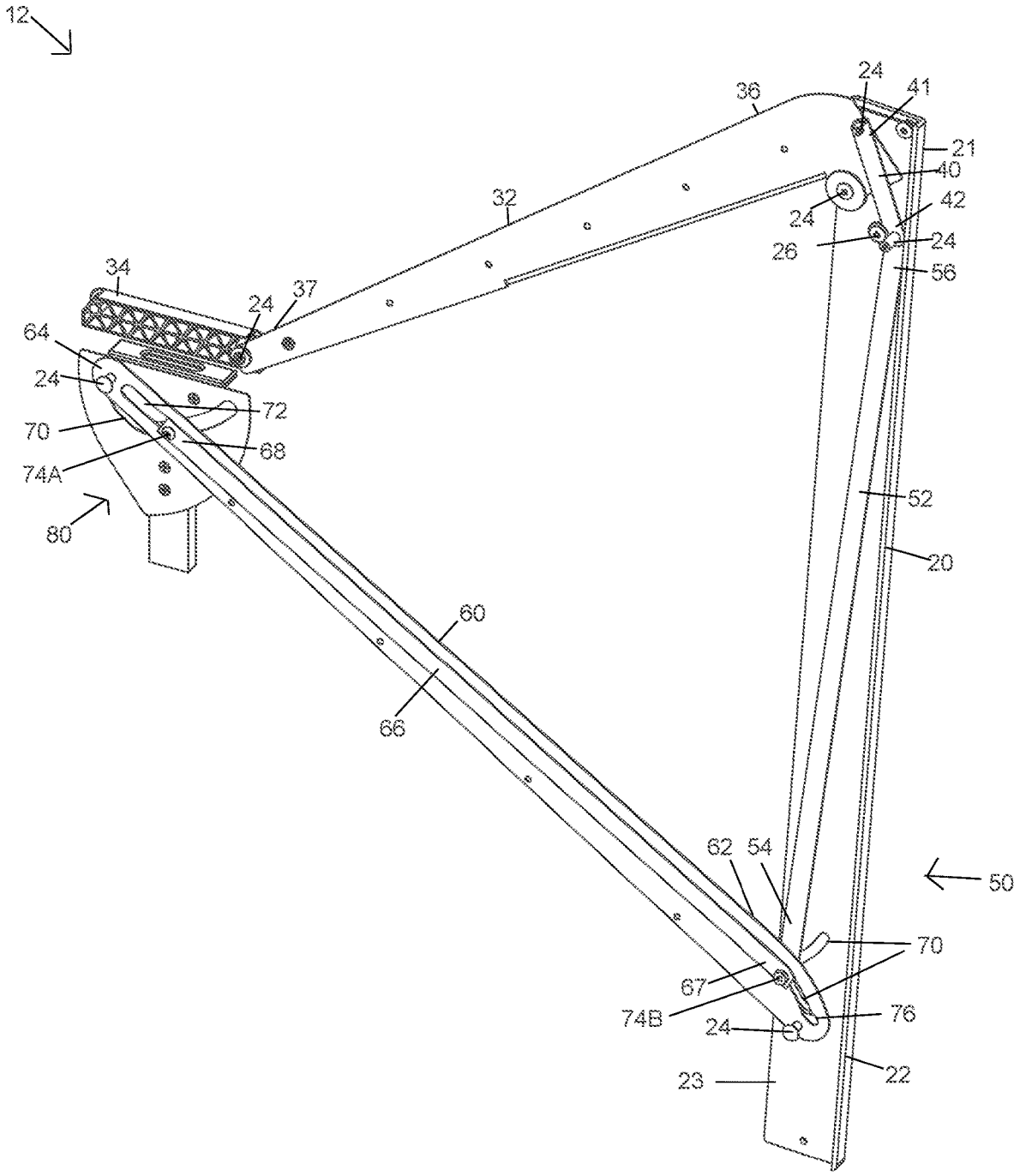
FIG. 21 is a perspective view of the half frame assembly of FIG. 19.
Figure 22:
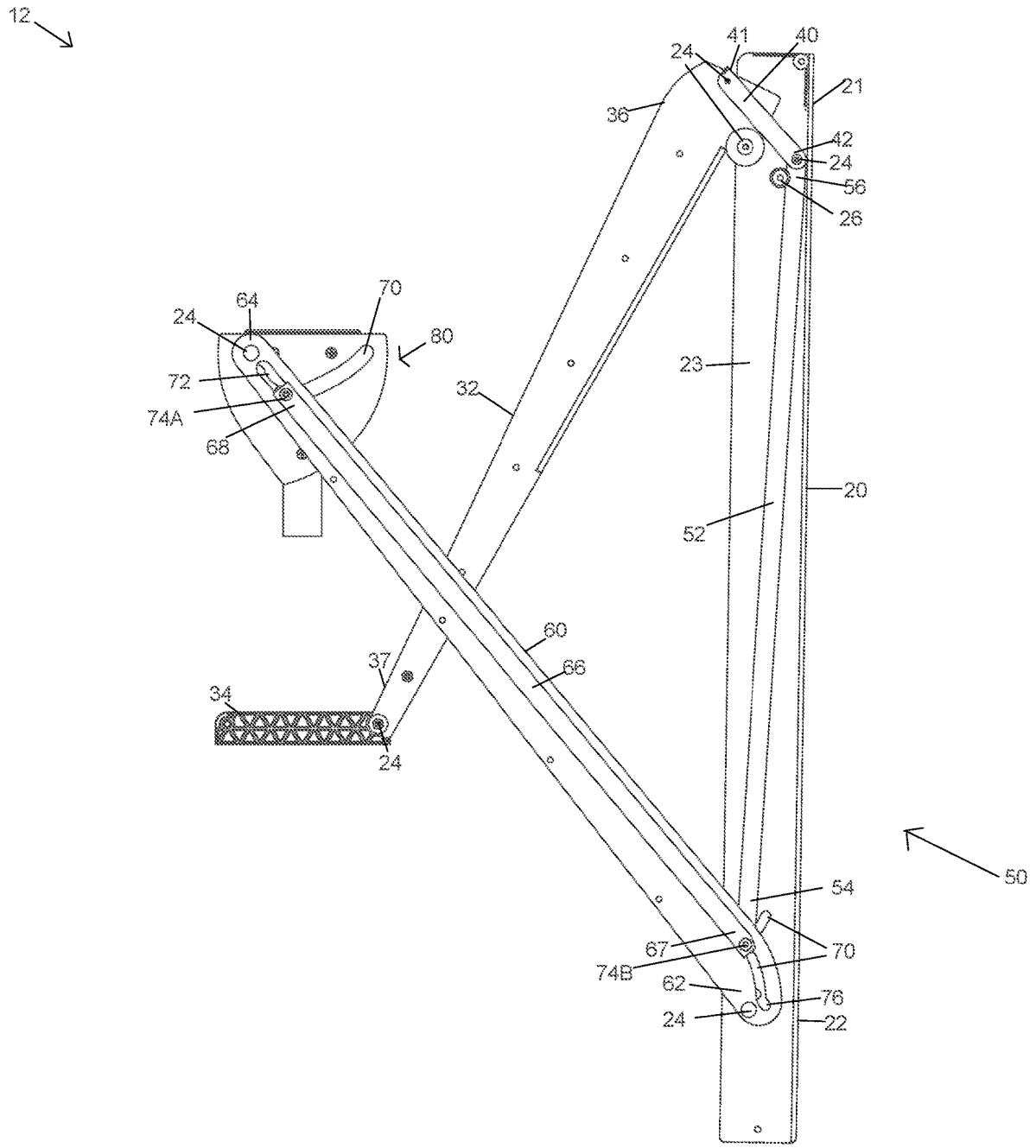
FIG. 22 illustrates a half frame assembly according to one embodiment of the present invention in the almost closed position.
Figure 23:
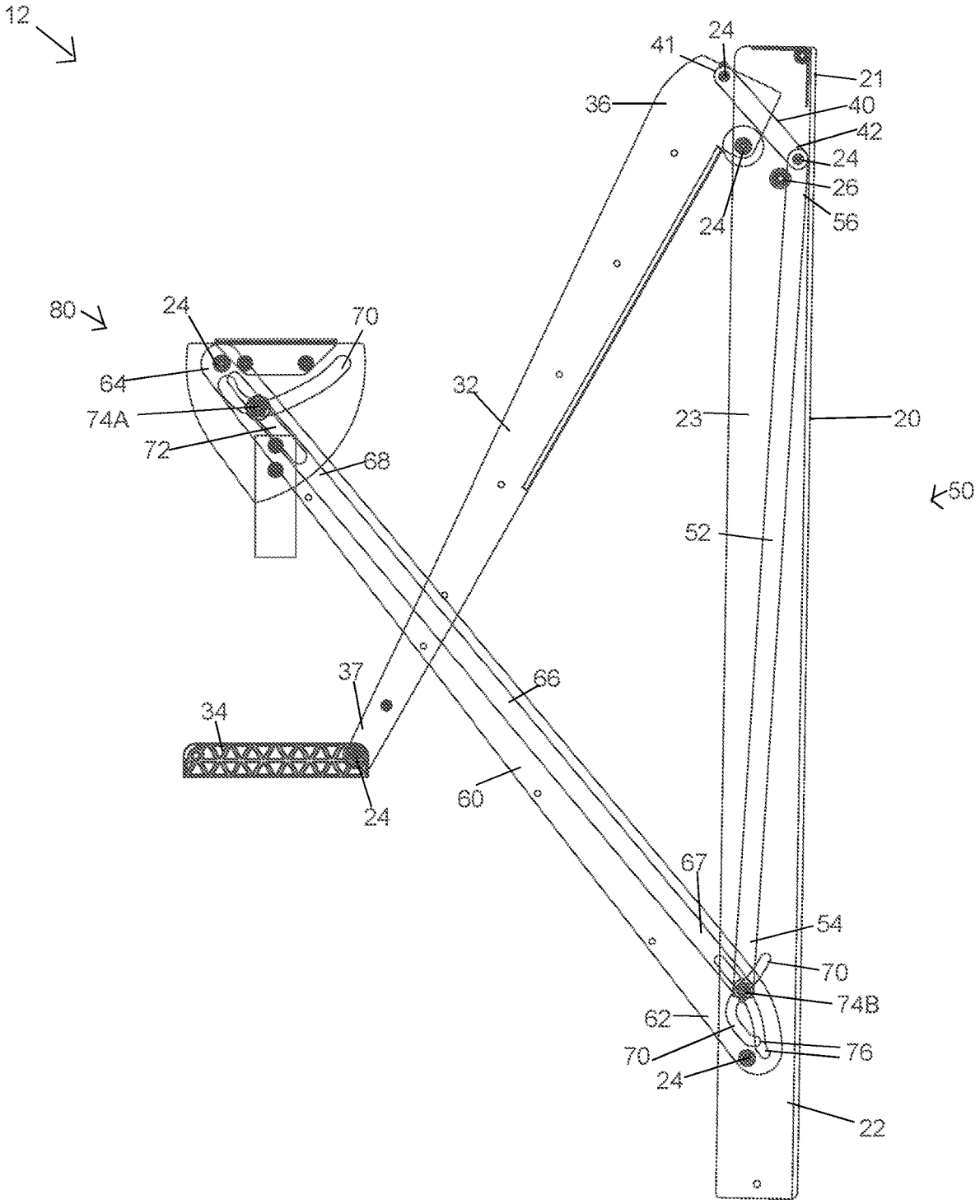
FIG. 23 is an alternative view of the half frame assembly of FIG. 22 with hidden lines and parts visible.
Figure 24:
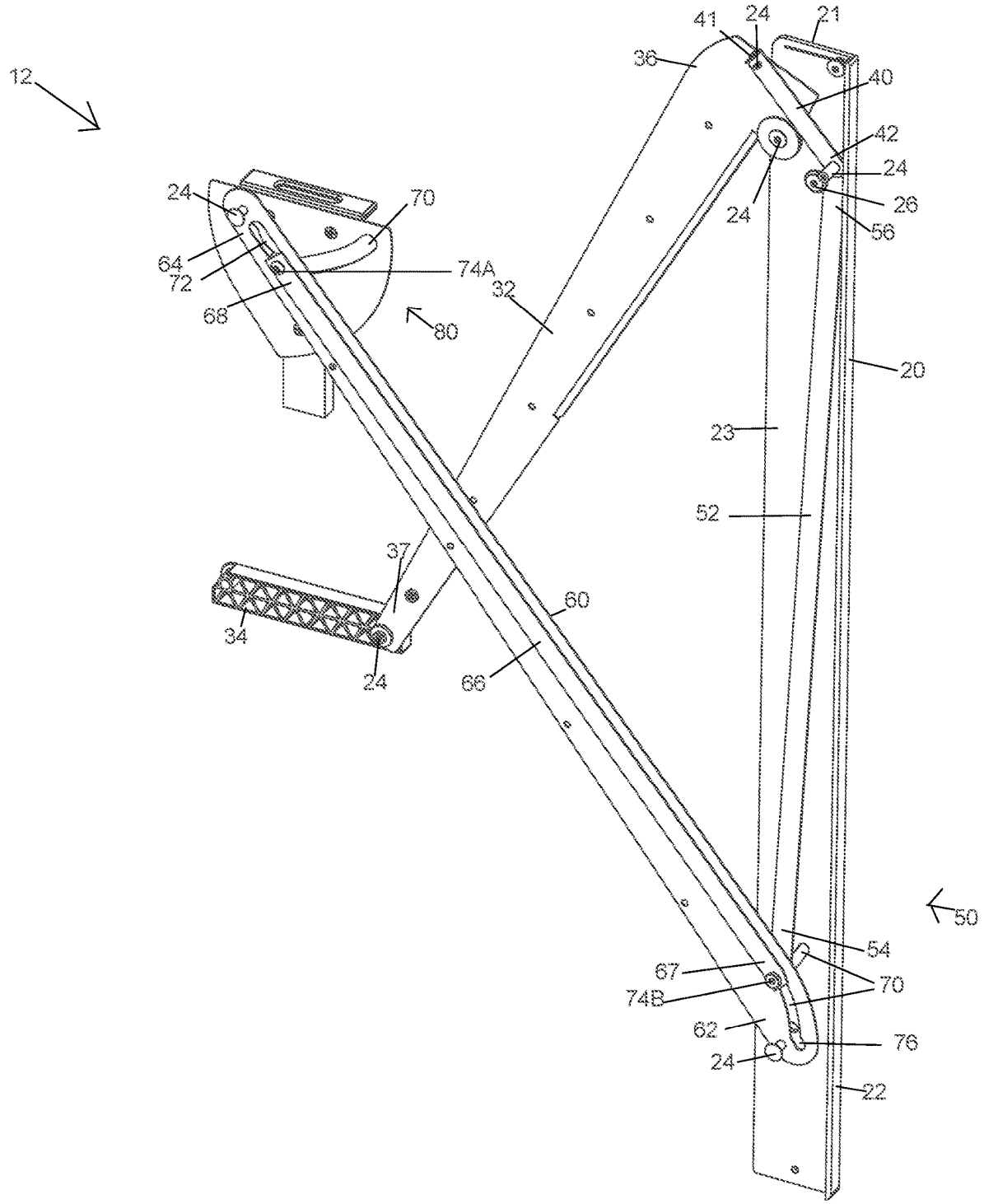
FIG. 24 is a perspective view of the half frame assembly of FIG. 22.
Figure 25:
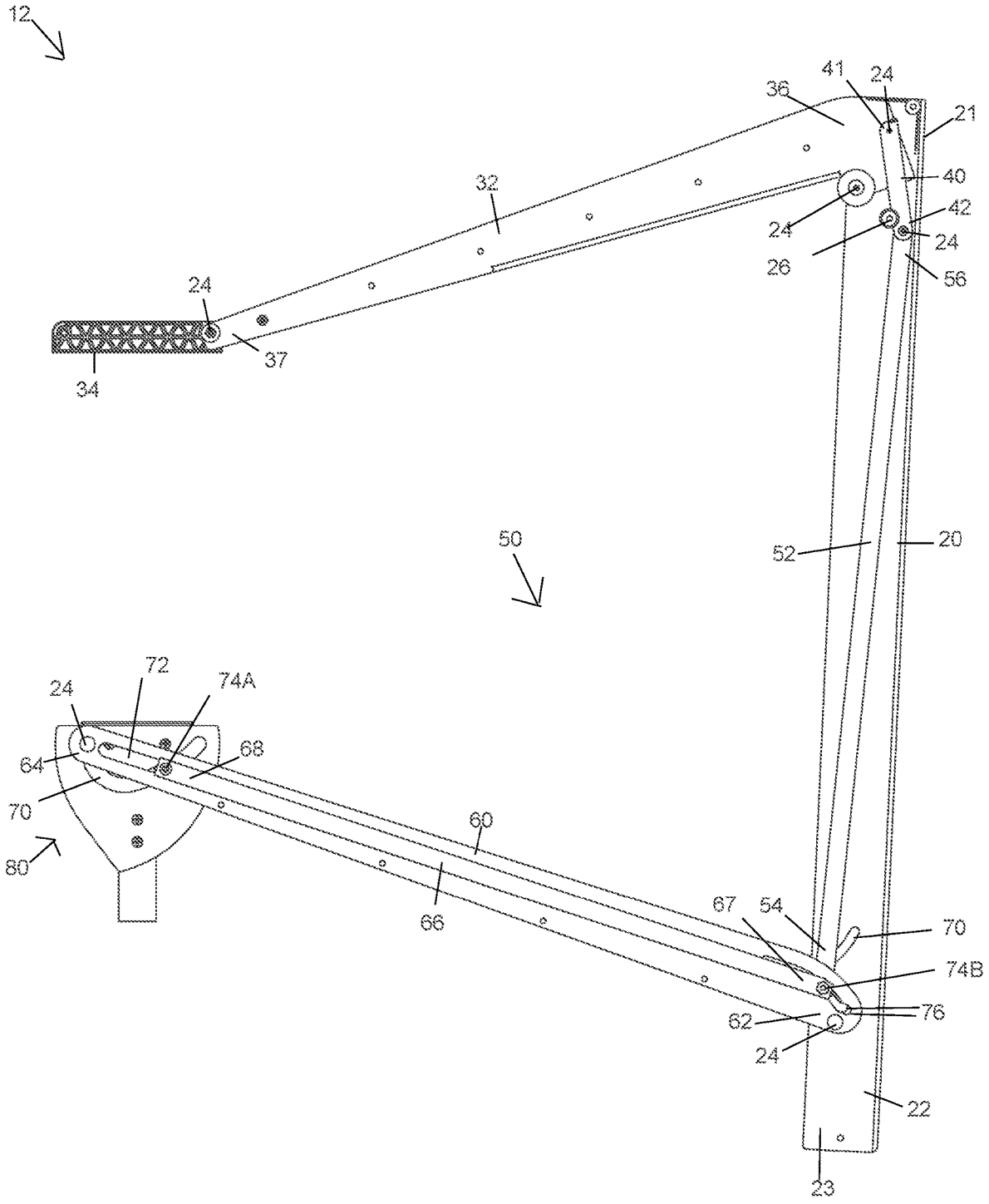
FIG. 25 illustrates a half frame assembly according to one embodiment of the present invention in the almost open position.
Figure 26:
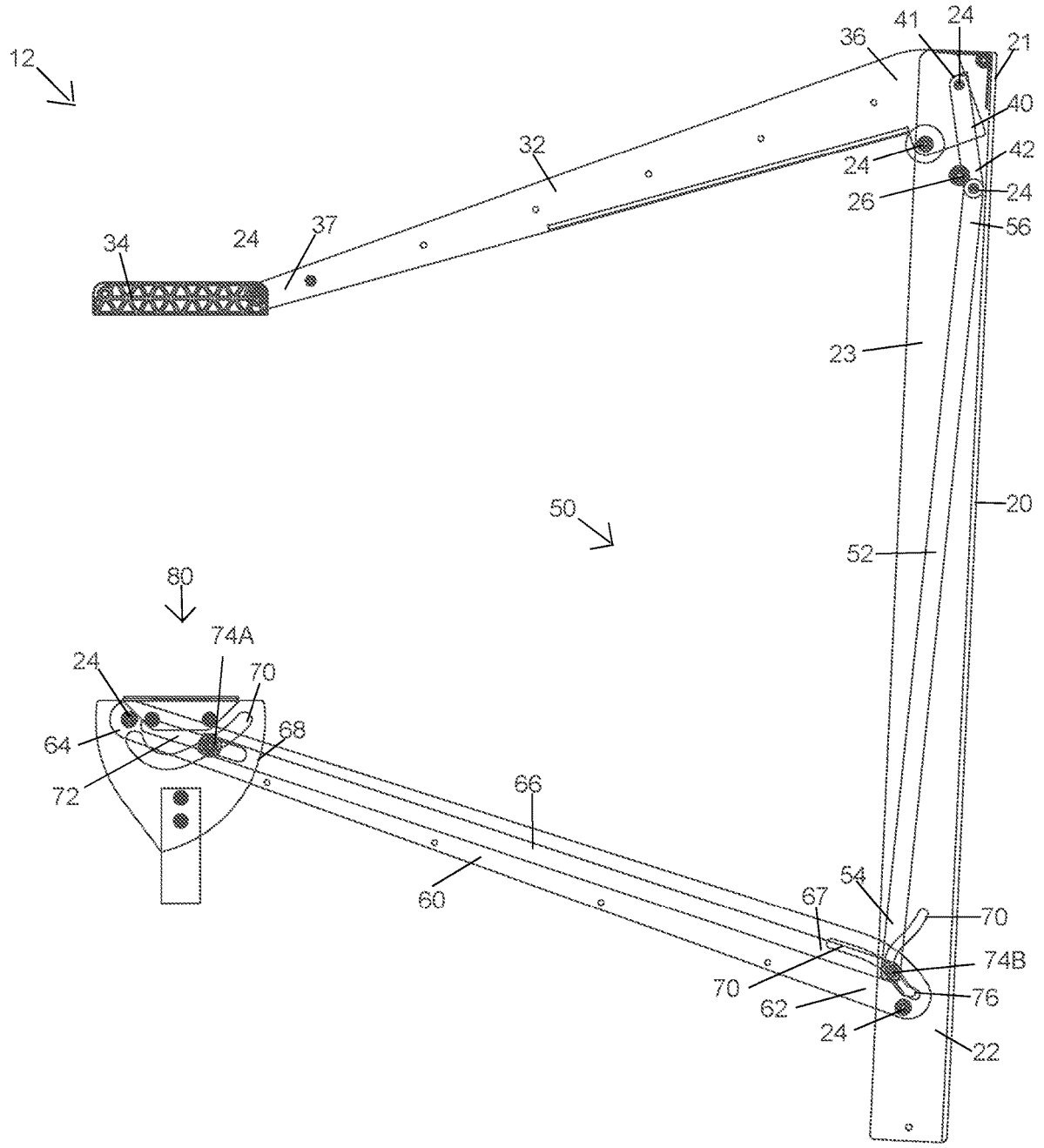
FIG. 26 shows the half frame assembly of FIG. 25 with hidden lines and parts visible.
Figure 27:
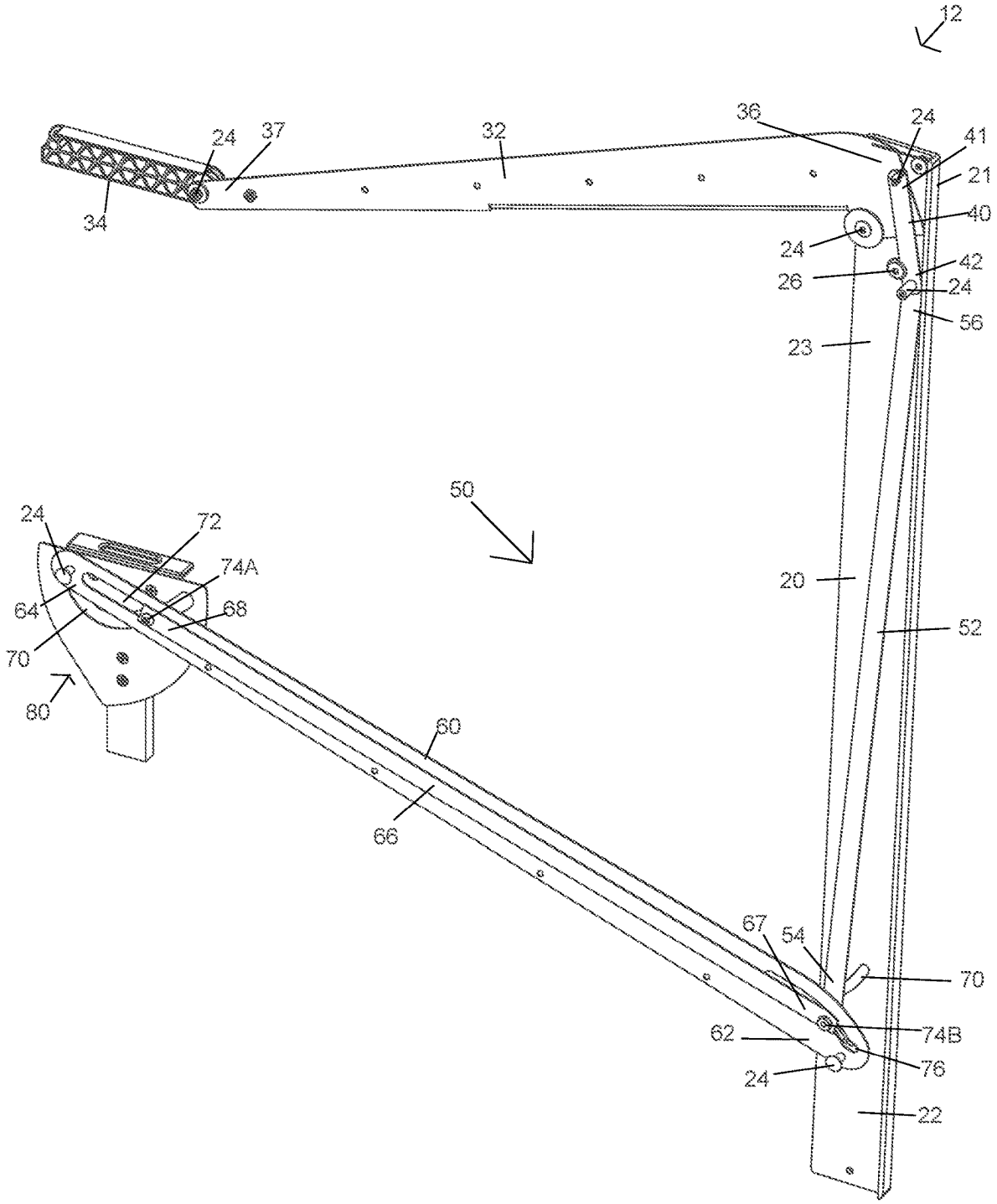
FIG. 27 is a perspective view of the half frame assembly of FIG. 25.
Figure 28:
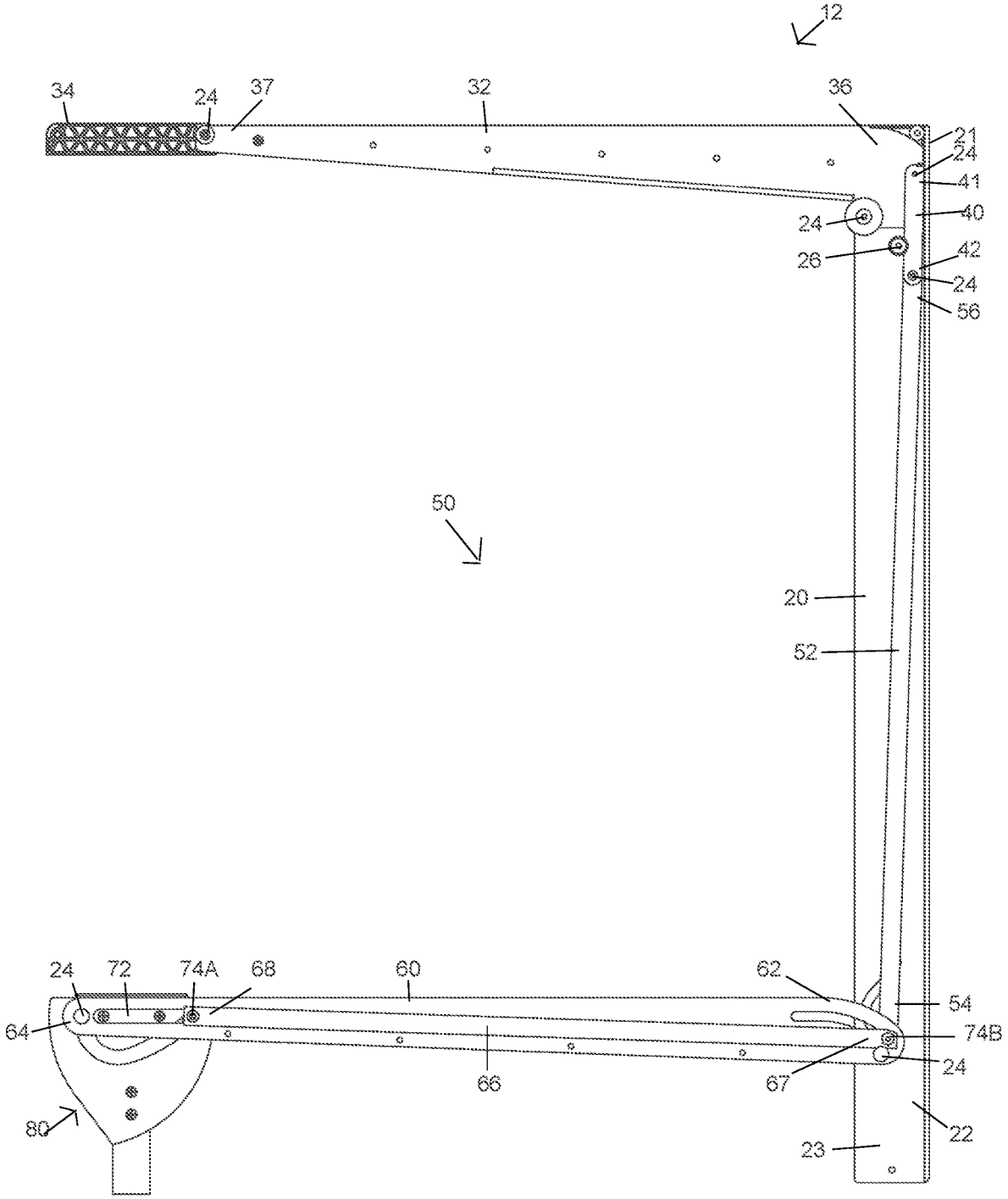
FIG. 28 illustrates a half frame assembly according to one embodiment of the present invention in the open position.
Figure 29:
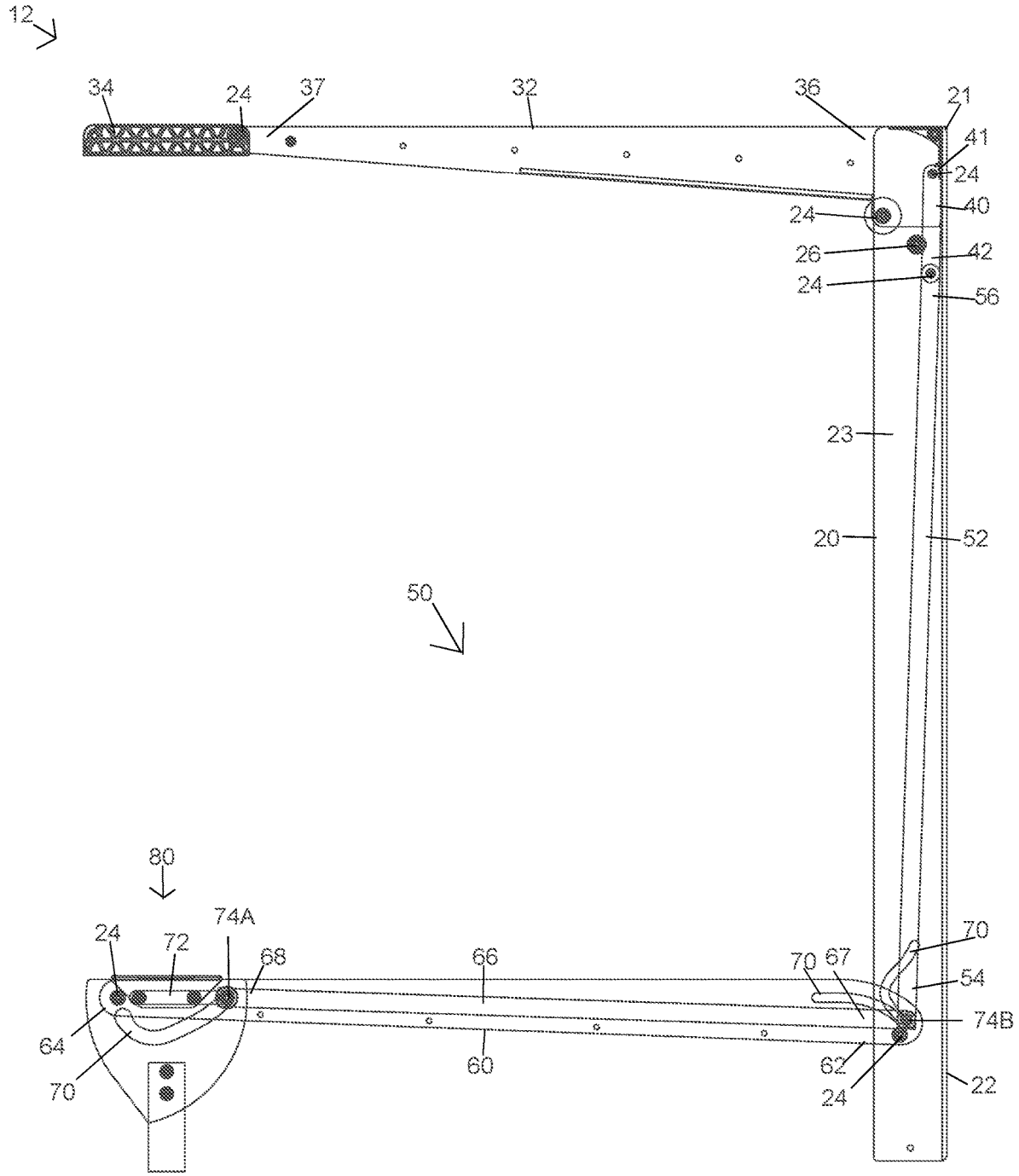
FIG. 29 shows the half frame assembly of FIG. 28 with hidden lines and parts visible.
Figure 30:
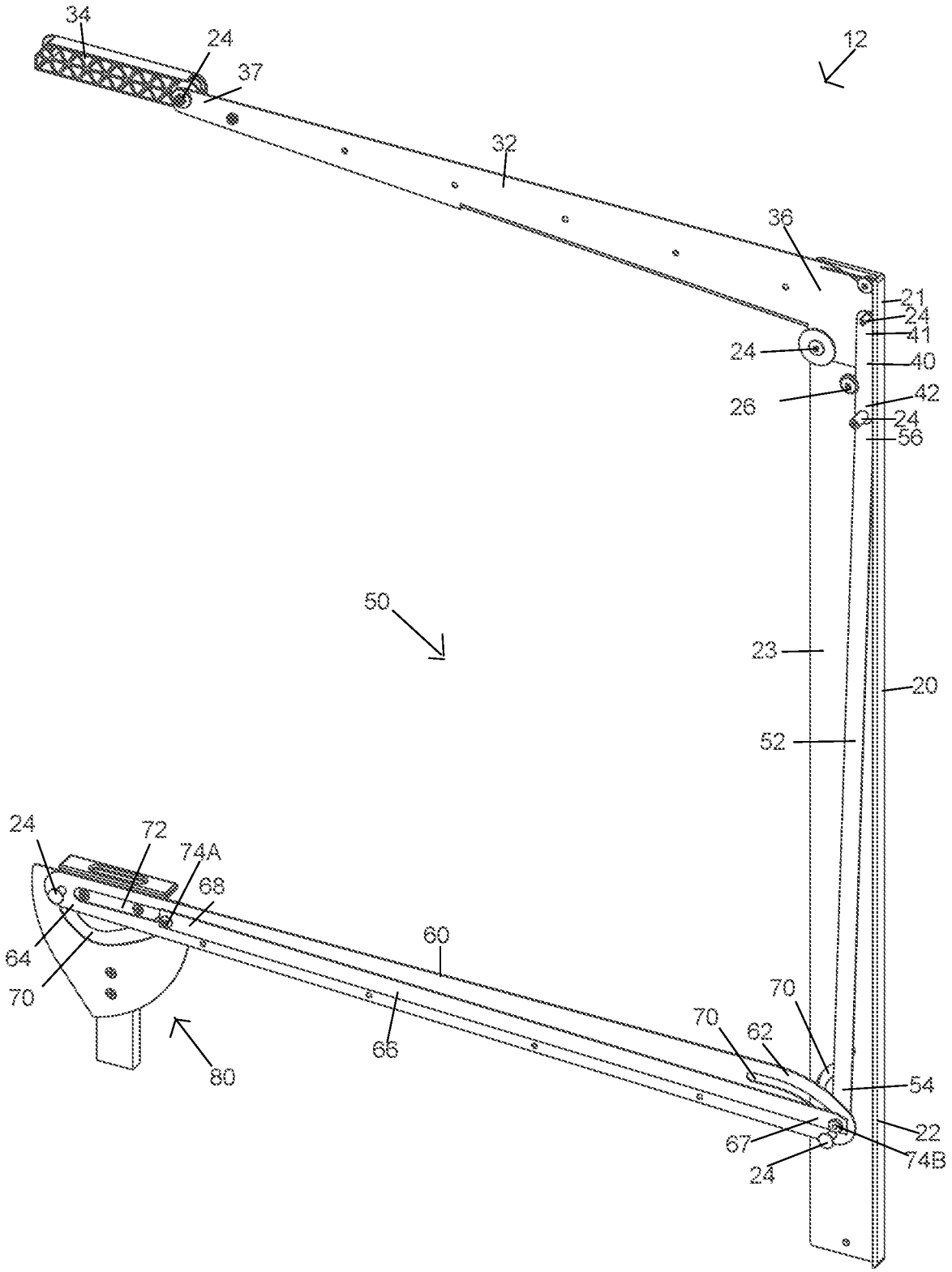
FIG. 30 is a perspective view of the half frame assembly of FIG. 28.
Figure 31:
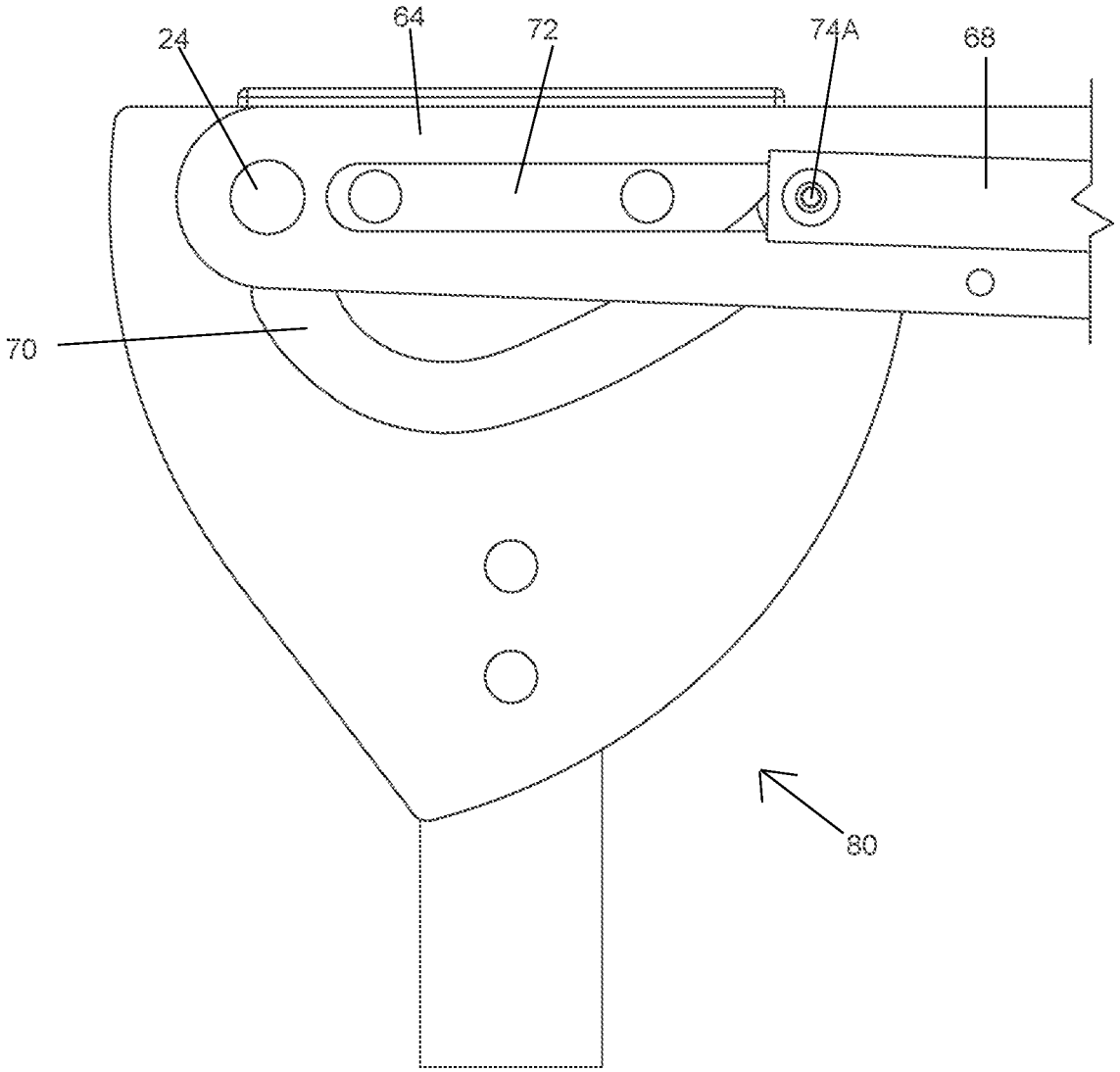
FIG. 31 illustrates a hub according to one embodiment of the present invention with a base strut and strut cam rod in the open position.
Figure 32:
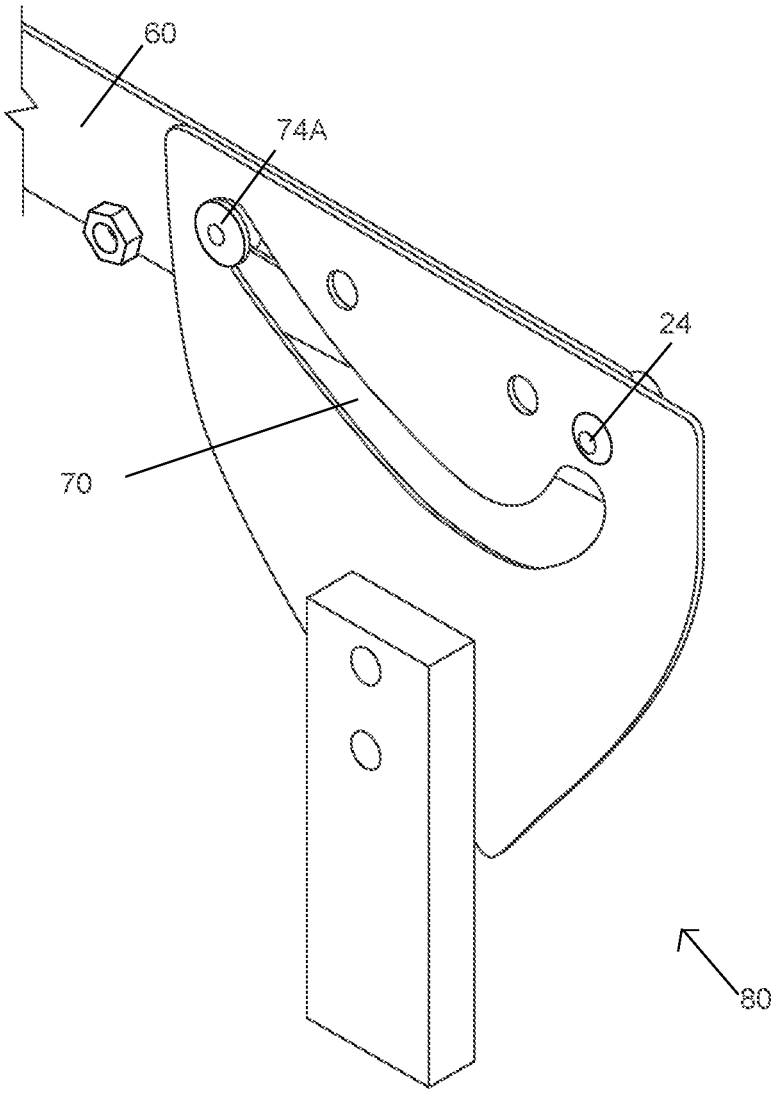
FIG. 32 illustrates the rear view of the hub according to FIG. 31.
Figure 33:
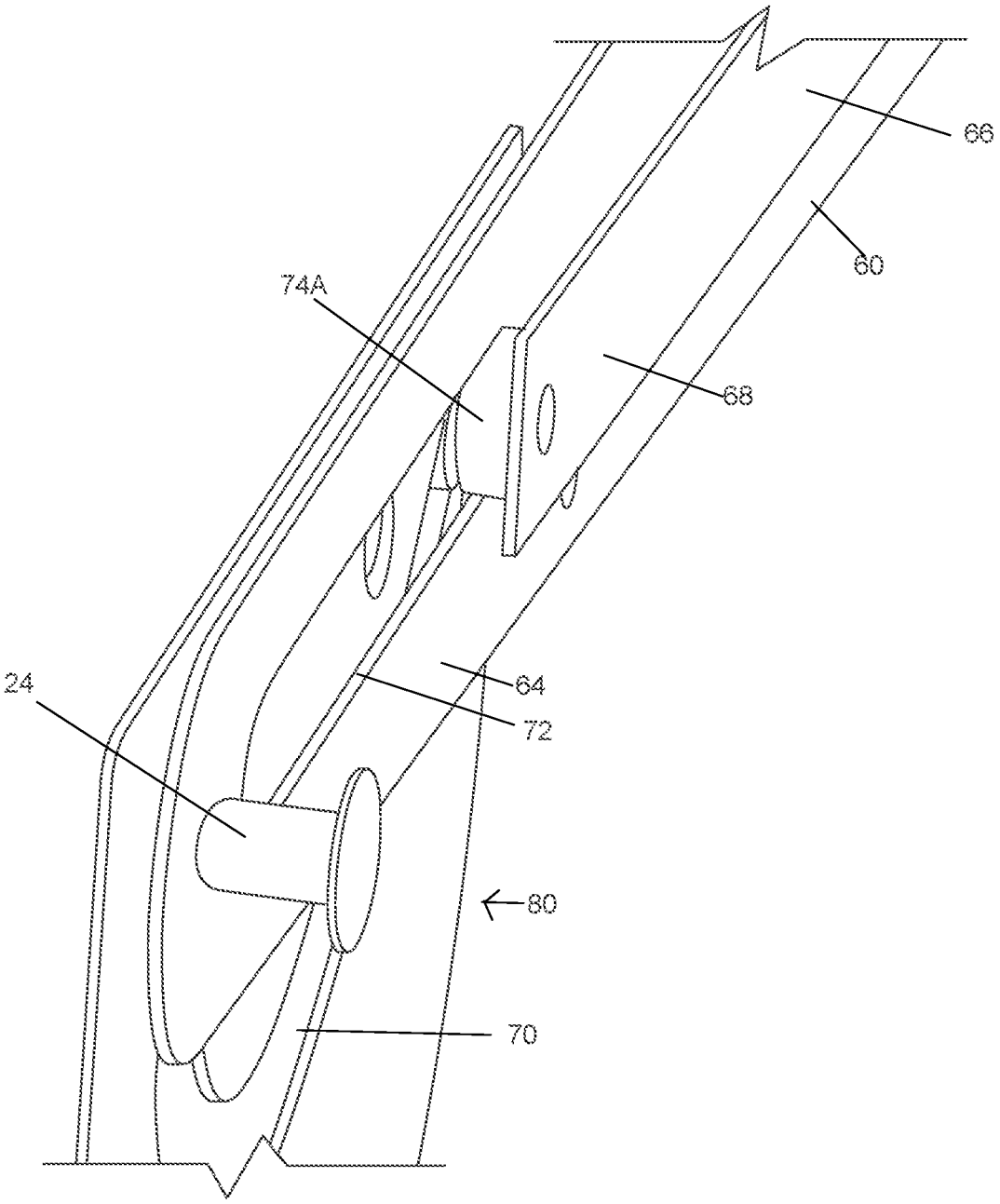
FIG. 33 is a perspective view of the hub according to FIGS. 31 and 32.
Figure 34:
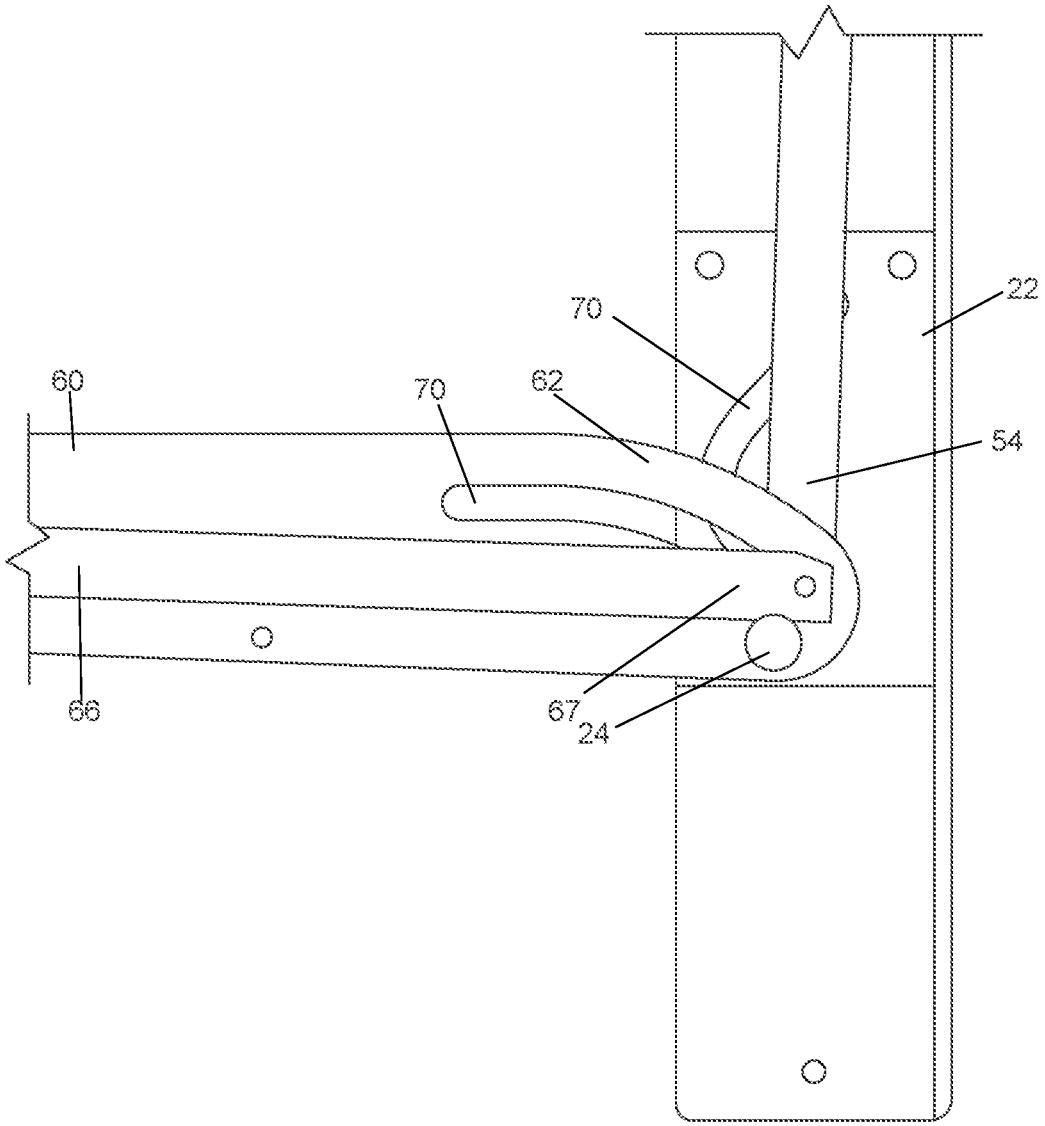
FIG. 34 illustrates the interconnections of a base strut outer end, a strut cam rod outer end and a corner post lower end according to one embodiment of the present invention in the open position.
Figure 35:
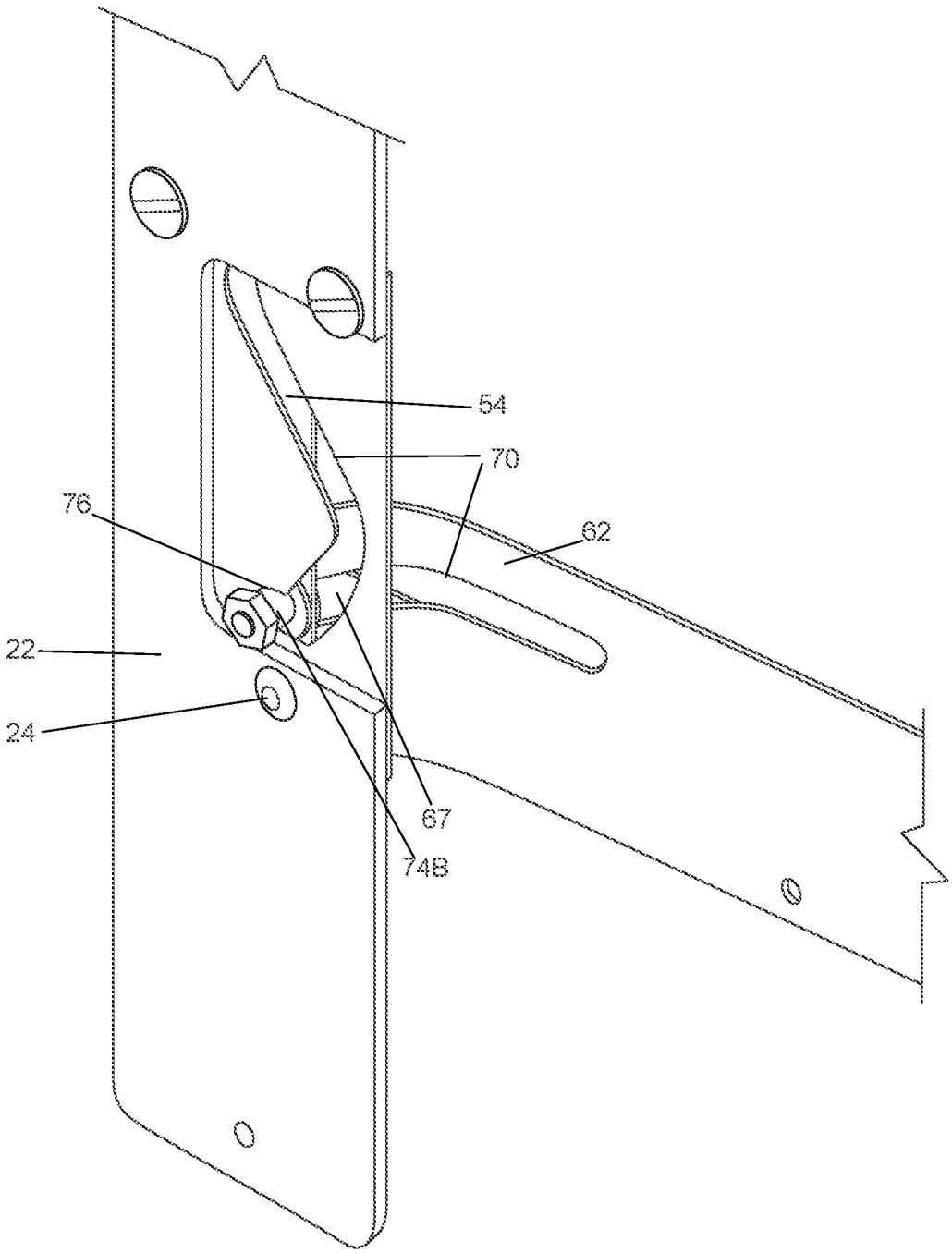
FIG. 35 is the rear view of the lower corner of FIG. 34.
Figure 36:
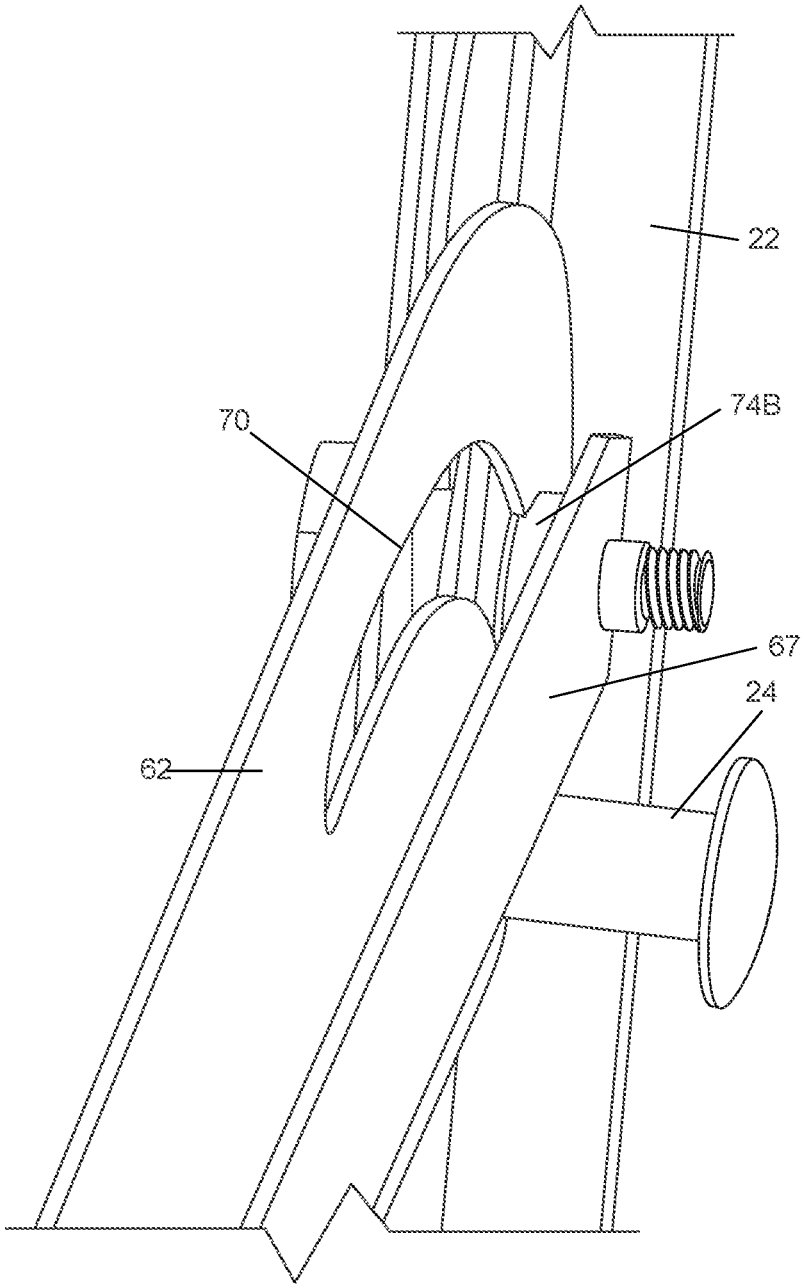
FIG. 36 is a perspective view of FIG. 34.

The play yard 1 of the present invention closes in a reverse operation. First, the central hub 80 is pulled upward, which pulls cam wheels 74B out of extensions 76 and then draws the corner posts 20 inward as well, while the upper rail assemblies 30 collapses downward. The cam actuator assemblies 50 operate to keep the corner posts 20 from collapsing during this process. FIGS. 12 through 14 show a half frame assembly 12 in the closed position.

Most prior art play yards require a lock to keep the play yards in the closed position, particularly when the play yard is being moved or stored. The present invention play yard 1 can be secured in the closed position by a lock. It will be obvious to one skilled in the art that many of the variety of lock mechanisms that are on the market could be adapted to be used with the present invention. However, the present invention play yard 1 can also be locked using a corner post locking mechanism that is located in the upper corners of the corner posts 20 and can be released through use of pull tab.

In the open position of one embodiment of the present invention, the upper rails 32 will have at least a 4-inch gap to prevent any part of a child's body from getting crushed between the upper rails 32 if the play yard 1 would unexpectedly close with a child in it. This gap is accomplished via the upper joint members 34, which should be at least 4 inches in length.

It will be obvious to one skilled in the art that the upper rail assemblies 30, cam actuator assemblies 50 and corner posts 20 can be made from a variety of materials. Currently, many prior art play yards use metal tubing for at least the upper lower and side rails. Those tubes are then compressed into the corners. The use of the metal tubes make the prior art play structures bulkier and heavier than the embodiments of the present invention made from flat metal pieces. It also makes them more expensive to make and ship.

Instead of using metal tubes, one embodiment of the present invention has most of the parts made from sheets of metal. Construction of many of the play yard 1 parts from sheet metal, instead of metal tubing, creates a thinner, lighter structure overall, which is easier to fabricate and easier to transport. Construction from metal sheets is generally faster and less expensive than construction from other materials. In one embodiment of the present invention, the flat metal pieces can be made from stamped steel and all pieces are cut with a 2-mm or 3-mm clearance (other clearances may be acceptable depending on the manufacturing process) on all parts for flashing, which may occur during the stamping of the steel in production. The clearance can be varied depending on the manufacturing needs.

Figure 47:
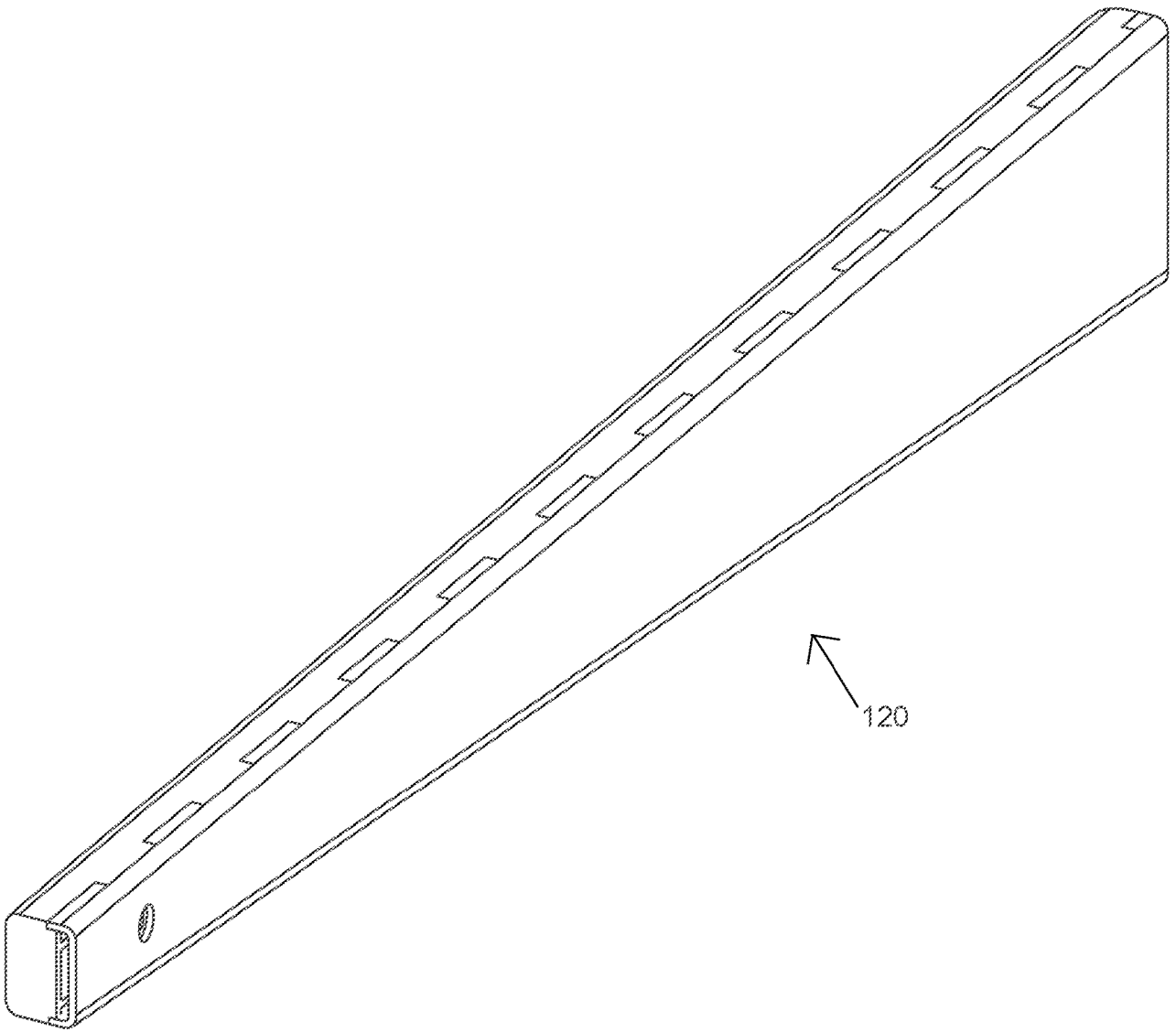
FIG. 47 is one embodiment of a plastic case for a rail.

In order to prevent the thinner metal from buckling under pressure, one embodiment of the present invention enclose certain of the flat metal pieces within interlocking plastic cases 120. FIG. 47 shows one embodiment of a plastic case 120 for an upper rail 32. The inside top and bottom of the plastic cases 120 may have ribs, in one embodiment, which provide support to the flat metal parts, provide additional strength, resist torqueing, and prevent the metal from buckling. The plastic cases 120 can be fabricated relatively easily and snapped around select sheet-metal upper pieces. It will be obvious to one skilled in the art that there are many ways to secure the plastic cases 120 to the metal pieces. One possible way is to use rivets to attach the plastic cases to the sheet metal pieces to provide additional support and prevent buckling.

The rails 32 of the upper rail assemblies 30 are the parts most likely to benefit from the additional support of the plastic cases 120. Additionally, the rails 32 can be designed such that they are wider toward the upper corners 21 of the corner posts 20 and narrower toward the upper joint member 34.

While not shown in the Figures, it will be obvious to one skilled in the art that the sidewalls and floor of the play yard 1 may be made of fabric, mesh, or any similarly pliable materials that are appropriate for children's play yards.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover all modifications and variations of this disclosure provided they come within the scope of the appended claims and their equivalents. Among other things, the following invention may be embodied as methods or devices. The detailed descriptions of the various embodiments of the present invention should not be taken in a limiting sense.

What is claimed is:

1. A play yard apparatus comprising:

at least three corner posts, each corner post with an upper end and a lower end;

at least three foldable upper rail assemblies, each upper rail assembly having two opposing outer ends, positioned between and pivotably connected at the outer ends of the rail assemblies to the upper ends of adjacent corner posts;

a central hub; and cam actuator assemblies connected to each corner post and to the central hub, wherein each cam actuator assembly comprises:

a base strut with an inner end pivotably connected to the central hub and an outer end pivotably connected to the lower end of a corresponding corner post;

a strut cam rod slidably attached by a first cam wheel to a cam slot in the inner end of the base strut and a second cam slot in the central hub and also slidably attached by a second cam wheel to a cam slot in the outer end of the base strut and a second cam slot in the lower end of the corner post;

an actuator rod with a lower end and an upper end, the lower end of the actuator rod slidably attached by the second cam wheel to the cam slot in the outer end of the base strut and to the second cam slot in the lower end of the corner post; and a transfer link with an upper end and lower end, the lower end of the transfer link pivotably attached to the upper end of the actuator rod, and the upper end of the transfer link pivotably attached to the corresponding outer end of an upper rail assembly;

whereby, as the central hub is pushed downward, the actuator rods and the transfer link are pulled downward, thereby pulling the upper rail assemblies into an approximately horizontal position, and the base struts and the strut cam rods are pushed to the lower ends of the corner posts into approximately horizontal positions; and whereby the cam actuator assemblies enable an up and down motion of the central hub to control the motion and position of the corner posts and the upper rail assemblies and to move the play yard apparatus between an open state and a closed state.

2. The apparatus of claim 1, wherein the upper ends of the corner posts move inward and outward and the corner posts do not remain parallel during the opening and closing of the apparatus.

3. The apparatus of claim 1, also comprising a locking mechanism located on at least one upper end of one corner post to secure the play yard in the closed position.

4. The apparatus of claim 1, wherein the up and down motion of the central hub and each cam actuator assembly determines a joint angle at the central hub and formed by an intersection of a longitudinal orientation of each base strut and a floor plane of the apparatus that is parallel to a surface on which the corner posts of the apparatus stand, and wherein these joint angles, through interaction with the base struts, the strut cam rods, the first cam wheels, the cam slots in the inner end of each base strut, each second cam slot in the central hub, each second cam wheel, the cam slots in the outer end of each base strut, the second cam slot in the lower end of each corner post, the actuator rods, the transfer links, and the upper rail assemblies, control an angle measured at the lower end of each of the corner posts between vertical and the angled position of each of the corner posts and also an angle measured at the upper end of each corner post and formed by the respective orientations of the corner post and a pivotably connected rail of the upper rail assembly and wherein this control of the angles at the upper end and the lower end of each corner post enables the up and down motion of the central hub to control the motion of the corner posts and the upper rail assemblies so that the play yard can move from the open state to the closed state and vice versa primarily through the motion of the hub.

5. The apparatus of claim 1, wherein each outer end of each upper rail assembly pivotably connects to the adjacent corner post and also pivotably connects to the upper end of an adjacent transfer link which, in turn, pivotably connects at the lower end of the transfer link to the upper end of the actuator rod.

6. The apparatus of claim 1, also comprising guideposts that are attached to the upper end of each of the corner posts and against which each of the transfer links rest and are movably secured.

7. The apparatus of claim 1, also comprising at least one extension in the cam slot located on the lower end of at least one corner post, wherein when the play yard apparatus is in the open state the position of the corresponding actuator rod and its cam actuator assembly is locked by resting the second cam wheel in the corresponding extension.

8. The apparatus of claim 1, wherein the corner posts, the rails, the actuator rods, the base struts and the strut cam rods are made from sheet metal.

9. The apparatus of claim 8, further comprising a plurality of ribbed plastic cases that encompass the rails to provide additional strength to the rails.

* * * * *